US011281155B2

(12) United States Patent
Nishiyama et al.

(10) Patent No.: US 11,281,155 B2
(45) **Date of Patent: *Mar. 22, 2022**

(54) PROCESS CARTRIDGE AND IMAGE FORMING APPARATUS

(71) Applicant: Brother Kogyo Kabushiki Kaisha, Nagoya (JP)

(72) Inventors: Hideshi Nishiyama, Owariasahi (JP); Atsushi Fukaya, Toyohashi (JP); Aya Adachi, Nagoya (JP); Ryosuke Hayashi, Nagoya (JP); Masaaki Furukawa, Nagoya (JP); Shougo Sato, Seto (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/068,497

(22) Filed: Oct. 12, 2020

(65) Prior Publication Data

US 2021/0026294 A1 Jan. 28, 2021

Related U.S. Application Data

(63) Continuation of application No. 15/931,186, filed on May 13, 2020, now Pat. No. 10,831,151, which is a (Continued)

(30) Foreign Application Priority Data

Mar. 31, 2016 (JP) ..... 2016-073467
Mar. 31, 2016 (JP) ..... 2016-073470
Mar. 31, 2016 (JP) ..... 2016-073471

(51) Int. Cl.
*G03G 21/18* (2006.01)
*G03G 21/10* (2006.01)
*G03G 21/12* (2006.01)

(52) U.S. Cl.
CPC ..... *G03G 21/1814* (2013.01); *G03G 21/105* (2013.01); *G03G 21/12* (2013.01); (Continued)

(58) Field of Classification Search
CPC .. G03G 21/1814; G03G 21/105; G03G 21/12; G03G 21/1817; G03G 21/1821; G03G 2221/183
See application file for complete search history.

(56) References Cited

U.S. PATENT DOCUMENTS 5,289,241 A 2/1994 Sugiyama et al.
5,398,098 A 3/1995 Fukunaga et al.
(Continued)

FOREIGN PATENT DOCUMENTS

JP H06012005 A 1/1994
JP H07-104631 A 4/1995
(Continued)

OTHER PUBLICATIONS

Jan. 21, 2020—(JP) Notice of Reasons for Refusal—JP App No. 2016-073467, Eng Tran.
(Continued)

*Primary Examiner* — Ryan D Walsh
(74) *Attorney, Agent, or Firm* — Banner & Witcoff, Ltd.

(57) ABSTRACT

A process cartridge including a drum cartridge, a developing cartridge, and a waste toner container, is provided. The drum cartridge includes a photosensitive drum including a photosensitive layer and a rotation axis extending in an axial direction, a drum cleaner arranged to contact the photosensitive drum, a cleaner frame configured to accommodate the drum cleaner therein, and a waste toner conveyer tube connected with the cleaner frame. The developing cartridge is movable to be attached to and detached from the drum cartridge and includes a developer roller. The waste toner (Continued)

container is movable to be attached to and detached from the drum cartridge. When the developing cartridge and the waste toner container are attached to the drum cartridge, the waste toner container is connected with the waste toner conveyer tube and is located on an opposite side of the developing cartridge to the photosensitive drum.

6 Claims, 45 Drawing Sheets

Related U.S. Application Data continuation of application No. 16/720,436, filed on Dec. 19, 2019, now Pat. No. 10,684,587, which is a continuation of application No. 16/228,132, filed on Dec. 20, 2018, now Pat. No. 10,579,011, which is a continuation of application No. 16/114,305, filed on Aug. 28, 2018, now Pat. No. 10,197,969, which is a continuation of application No. 15/474,507, filed on Mar. 30, 2017, now Pat. No. 10,082,765.

(52) U.S. Cl.
CPC ..... *G03G 21/1817* (2013.01); *G03G 21/1821* (2013.01); *G03G 2221/183* (2013.01)

(56) References Cited

U.S. PATENT DOCUMENTS

| | | | |
|---|---|---|---|
| 5,614,996 | A | 3/1997 | Tanda |
| 5,835,822 | A | 11/1998 | Nagasaki et al. |
| 6,339,689 | B1 | 1/2002 | Sugiura |
| 6,418,291 | B1 | 7/2002 | Sakemi |
| 8,805,232 | B2 | 8/2014 | Sakuma |
| 9,098,050 | B2 | 8/2015 | Sato |
| 9,291,986 | B2 | 3/2016 | Sato |
| 9,746,825 | B2 | 8/2017 | Yokoi et al. |
| 10,082,765 | B2 * | 9/2018 | Nishiyama ..... G03G 21/1814 |
| 2003/0039484 | A1 | 2/2003 | Naito et al. |
| 2008/0095559 | A1 | 4/2008 | Shimizu et al. |
| 2010/0074646 | A1 | 3/2010 | Miyahara et al. |
| 2012/0039622 | A1 | 2/2012 | Cho |
| 2012/0213566 | A1 | 8/2012 | Sato |
| 2013/0164032 | A1 | 6/2013 | Sato et al. |
| 2013/0259532 | A1 | 10/2013 | Kubota et al. |
| 2013/0266347 | A1 | 10/2013 | Kubota et al. |
| 2014/0186082 | A1 | 7/2014 | Yoshikawa et al. |
| 2014/0205321 | A1 | 7/2014 | Jang et al. |
| 2015/0050044 | A1 | 2/2015 | Sato |
| 2015/0261173 | A1 | 9/2015 | Sato |
| 2015/0277368 | A1 | 10/2015 | Nishiyama et al. |
| 2015/0338820 | A1 | 11/2015 | Sato |
| 2016/0109827 | A1 | 4/2016 | Yoshida et al. |
| 2016/0202637 | A1 | 7/2016 | Sato |
| 2017/0219995 | A1 | 8/2017 | Sato et al. |
| 2017/0255157 | A1 | 9/2017 | Sato et al. |
| 2017/0285566 | A1 | 10/2017 | Shimizu et al. |
| 2017/0285567 | A1 | 10/2017 | Fukaya et al. |
| 2018/0095418 | A1 | 4/2018 | Sato et al. |
| 2018/0267459 | A1 | 9/2018 | Sato et al. |
| 2018/0364638 | A1 | 12/2018 | Nishiyama et al. |
| 2019/0072896 | A1 | 3/2019 | Sato |
| 2019/0094797 | A1 | 3/2019 | Fukaya et al. |
| 2019/0121288 | A1 | 4/2019 | Nishiyama et al. |
| 2019/0196391 | A1 | 6/2019 | Sato et al. |
| 2020/0019111 | A1 | 1/2020 | Sato et al. |
| 2020/0125027 | A1 | 4/2020 | Nishiyama et al. |

FOREIGN PATENT DOCUMENTS

| | | | |
|---|---|---|---|
| JP | H07-175390 | A | 7/1995 |
| JP | H07-271162 | A | 10/1995 |
| JP | H08-062966 | A | 3/1996 |
| JP | 2000-231313 | A | 8/2000 |
| JP | 2001-094271 | A | 4/2001 |
| JP | 2001-142301 | A | 5/2001 |
| JP | 2001-235933 | A | 8/2001 |
| JP | 2011-118040 | A | 6/2011 |
| JP | 2011-197197 | A | 10/2011 |
| JP | 2013-160795 | A | 8/2013 |
| JP | 2014-232270 | A | 12/2014 |
| JP | 2015-036765 | A | 2/2015 |

OTHER PUBLICATIONS

Jan. 21, 2020—(JP) Notice of Reasons for Refusal—JP App No. 2016-073471, Eng Tran.

* cited by examiner

PROCESS CARTRIDGE AND IMAGE FORMING APPARATUS

CROSS REFERENCE TO RELATED APPLICATION

This application is a Continuation of U.S. application Ser. No. 15/931,186, filed on May 13, 2020, which Continuation of U.S. application Ser. No. 16/720,436, filed on Dec. 19, 2019, now U.S. Pat. No. 10,684,587, which is a Continuation of U.S. application Ser. No. 16/228,132, filed on Dec. 20, 2018, now U.S. Pat. No. 10,579,011, which is a is a Continuation of U.S. application Ser. No. 16/114,305, filed on Aug. 28, 2018, now U.S. Pat. No. 10,197,969, which is a Continuation of U.S. application Ser. No. 15/474,507, filed on Mar. 30, 2017, now U.S. Pat. No. 10,082,765, which claims priority under 35 U.S.C. § 119 from Japanese Patent Applications Nos. 2016-073467, 2016-073470, and 2016-073471, each filed on Mar. 31, 2016. The entire subject matters of the applications are incorporated herein by reference.

BACKGROUND

Technical Field

An aspect of the present disclosure relates to a process cartridge and an image forming apparatus.

Related Art

An image forming apparatus, having a process cartridge and a fuser device, to form an image on a sheet is known. The process cartridge may include a cartridge that contains a photosensitive drum and a cartridge that contains a developer roller. The process cartridge may be in a separable configuration such that the cartridge with the photosensitive drum and the cartridge with the developer roller are mutually separable.

In the process cartridge, the developer roller may be arranged on one side of the photosensitive drum, and the fuser device may be arranged on an opposite side of the photosensitive drum to the developer roller, along a conveying direction so that the sheet may be conveyed to pass by the developer roller, through the photosensitive drum to have a toner image formed thereon, and to the fuser device to have the toner image fixed on the sheet.

In the process cartridge, after transferring the toner image from the photosensitive drum to the sheet, it may be preferable that waste toner being remainder of the toner image may be scraped off from a circumferential surface of the photosensitive drum by a cleaning blade. The waste toner removed from the photosensitive drum may be stored in a waste toner container, which may be located between the photosensitive drum and the fuser device.

SUMMARY

In this regard, while the waste toner container may be located between the photosensitive drum and the fuser device, a capacity volume to contain the waste toner may be limited, and the waste toner container may soon be filled up to be exhausted.

The present disclosure is advantageous in that a process cartridge and an image forming apparatus, in which a larger volume of waste toner container removed from a photosensitive drum may be stored, is provided.

According to an aspect of the present disclosure, a process cartridge is provided. The process cartridge includes a drum cartridge, a developing cartridge, and a waste toner container. The drum cartridge includes a photosensitive drum including a photosensitive layer and a rotation axis extending in an axial direction, a drum cleaner arranged to contact the photosensitive drum, a cleaner frame configured to accommodate the drum cleaner therein, and a waste toner conveyer tube connected with the cleaner frame. The developing cartridge is movable to be attached to and detached from the drum cartridge and includes a developer roller. The waste toner container is movable to be attached to and detached from the drum cartridge. When the developing cartridge and the waste toner container are attached to the drum cartridge, the waste toner container is connected with the waste toner conveyer tube and is located on an opposite side of the developing cartridge to the photosensitive drum.

BRIEF DESCRIPTION OF THE ACCOMPANYING DRAWINGS

Figure 17A:
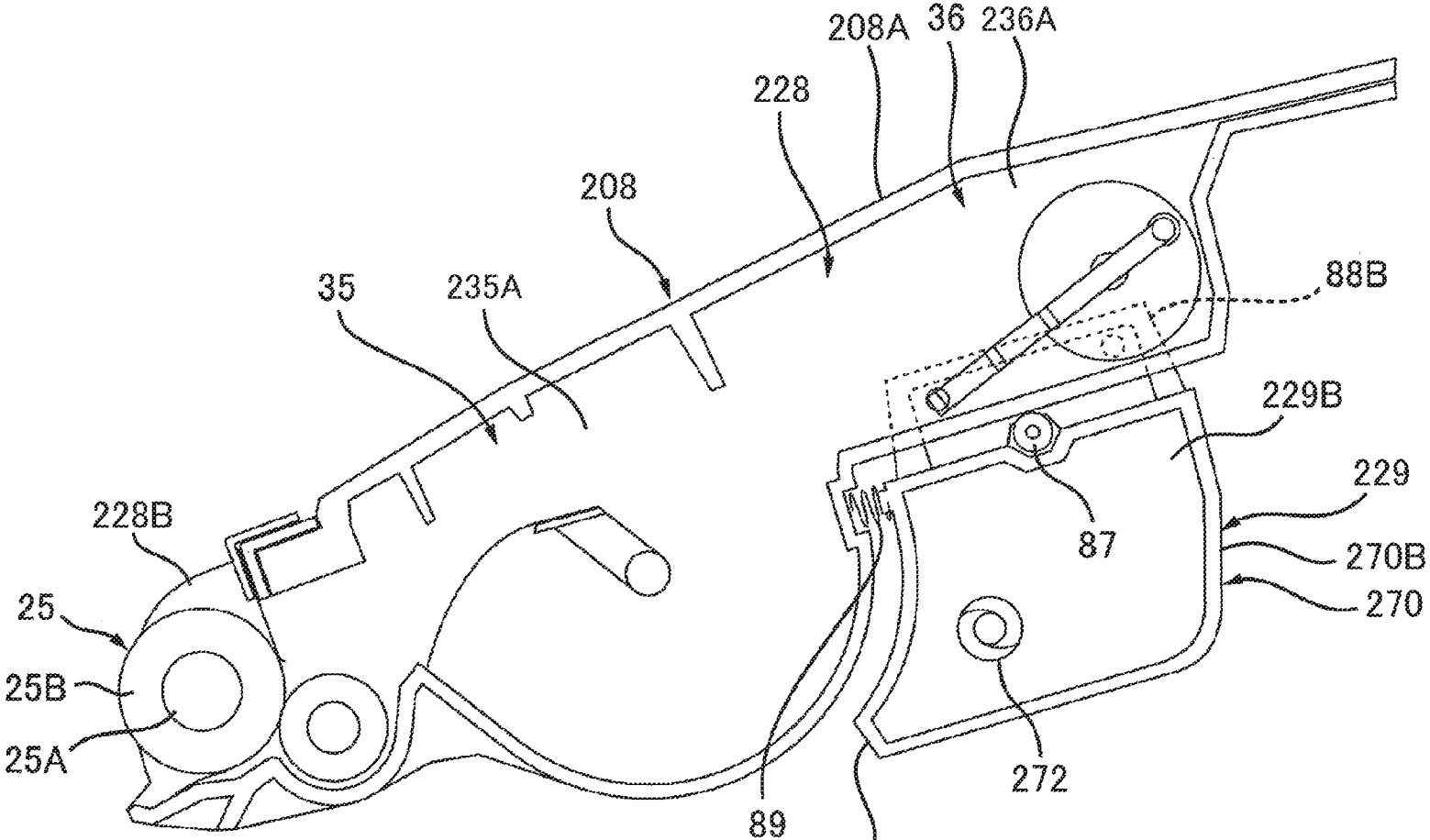
Figure 17B:
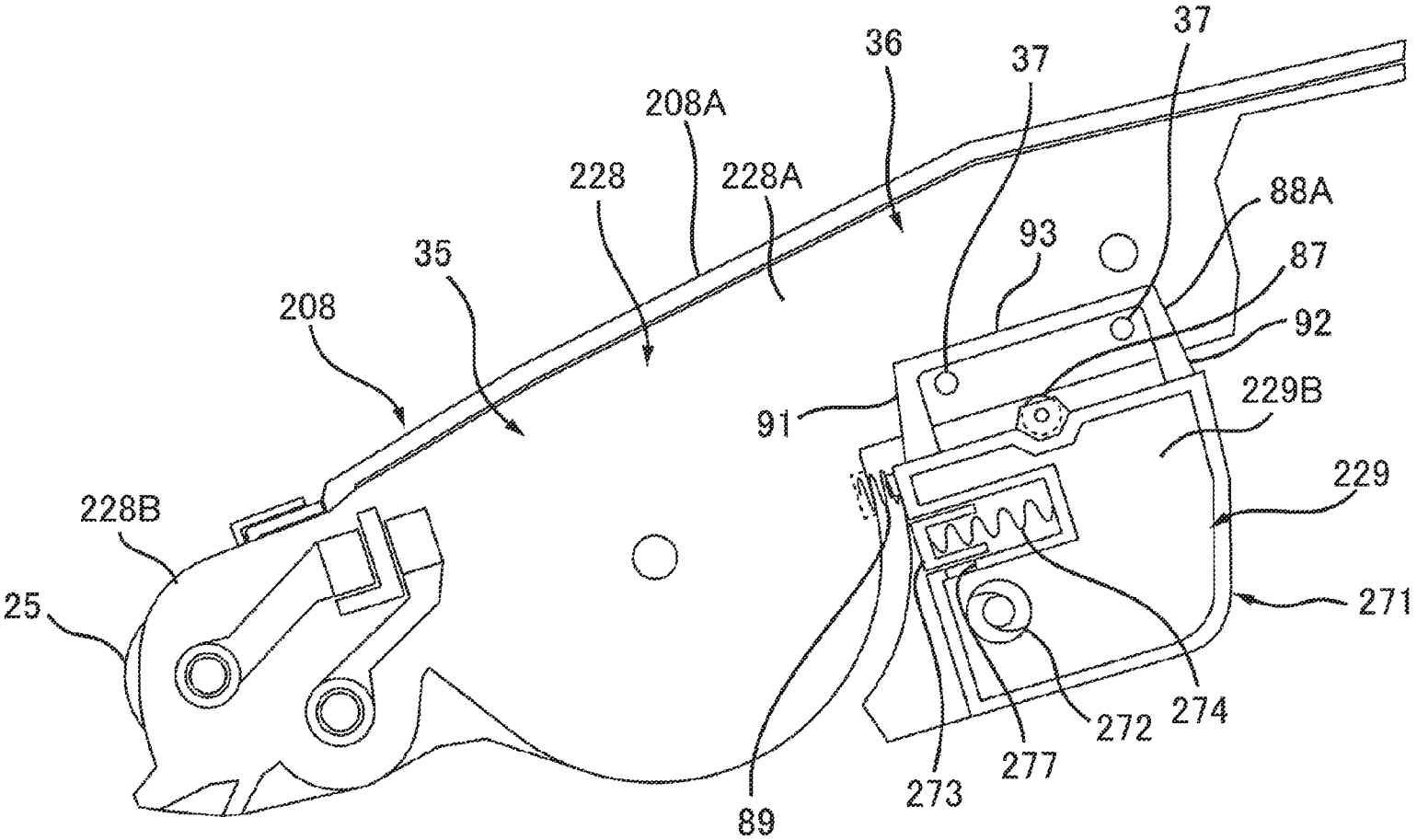
Figure 18:
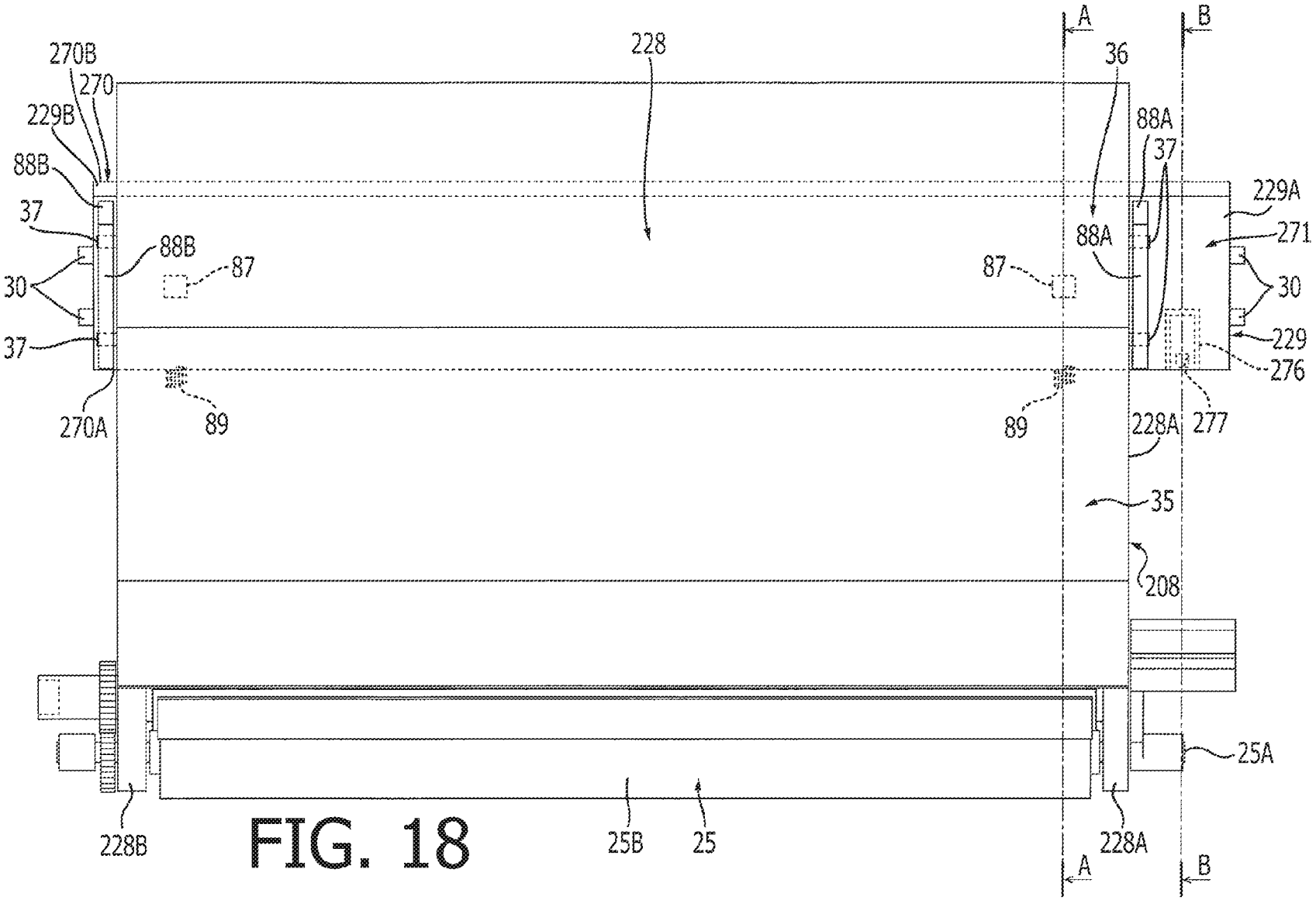

FIG. 17A is a cross-sectional view of a developing cartridge and a waste toner container according to the second embodiment of the present disclosure viewed at a line A-A shown in FIG. 18. FIG. 17B is a cross-sectional view of the developing cartridge and the waste toner container in the process cartridge according to the second embodiment of the present disclosure viewed at a line B-B shown in FIG. 18.

FIG. 18 is a plan view of the developing cartridge according to the second embodiment of the present disclosure.

Figure 19:
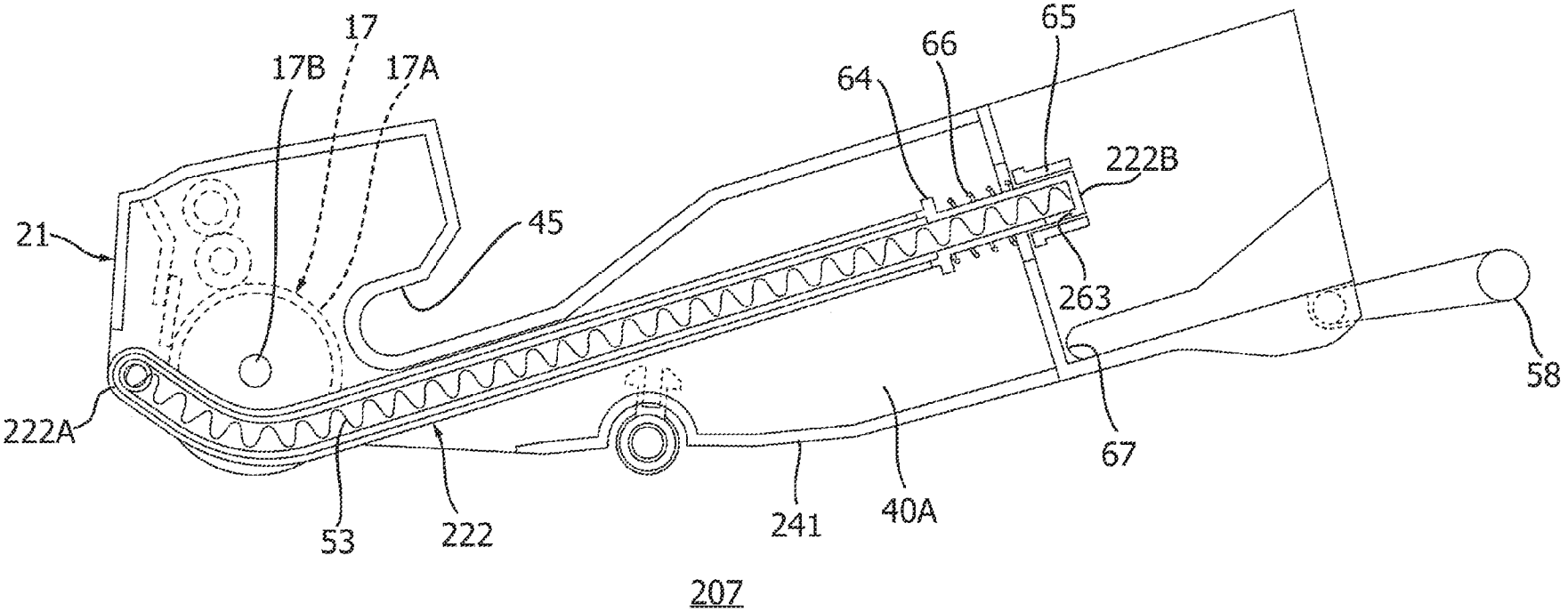
Figure 20:
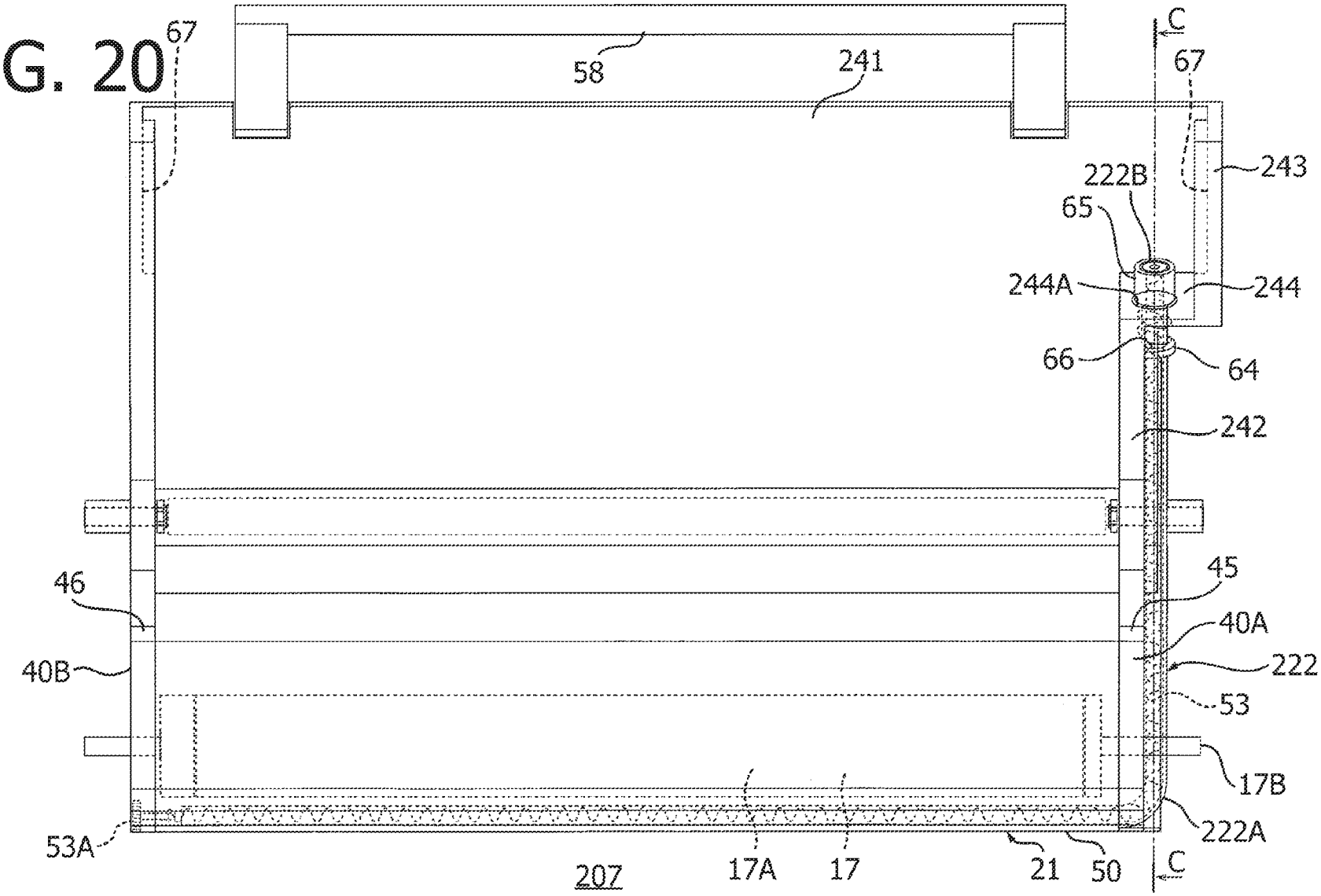

FIG. 19 is a cross-sectional view of a drum cartridge according to the second embodiment of the present disclosure viewed at a line C-C shown in FIG. 20.

FIG. 20 is a plan view of the drum cartridge according to the second embodiment of the present disclosure.

Figure 21:
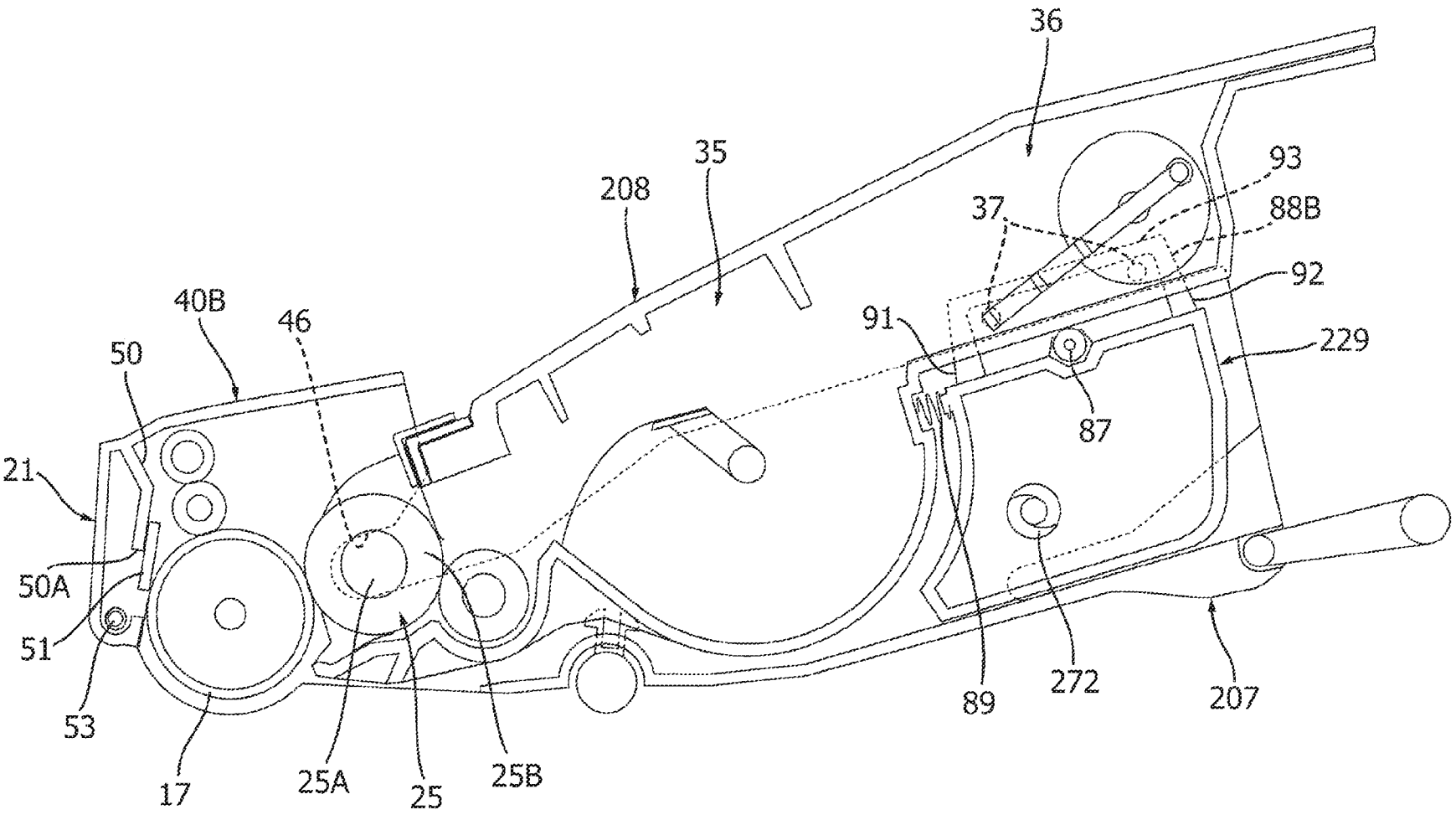
Figure 23:
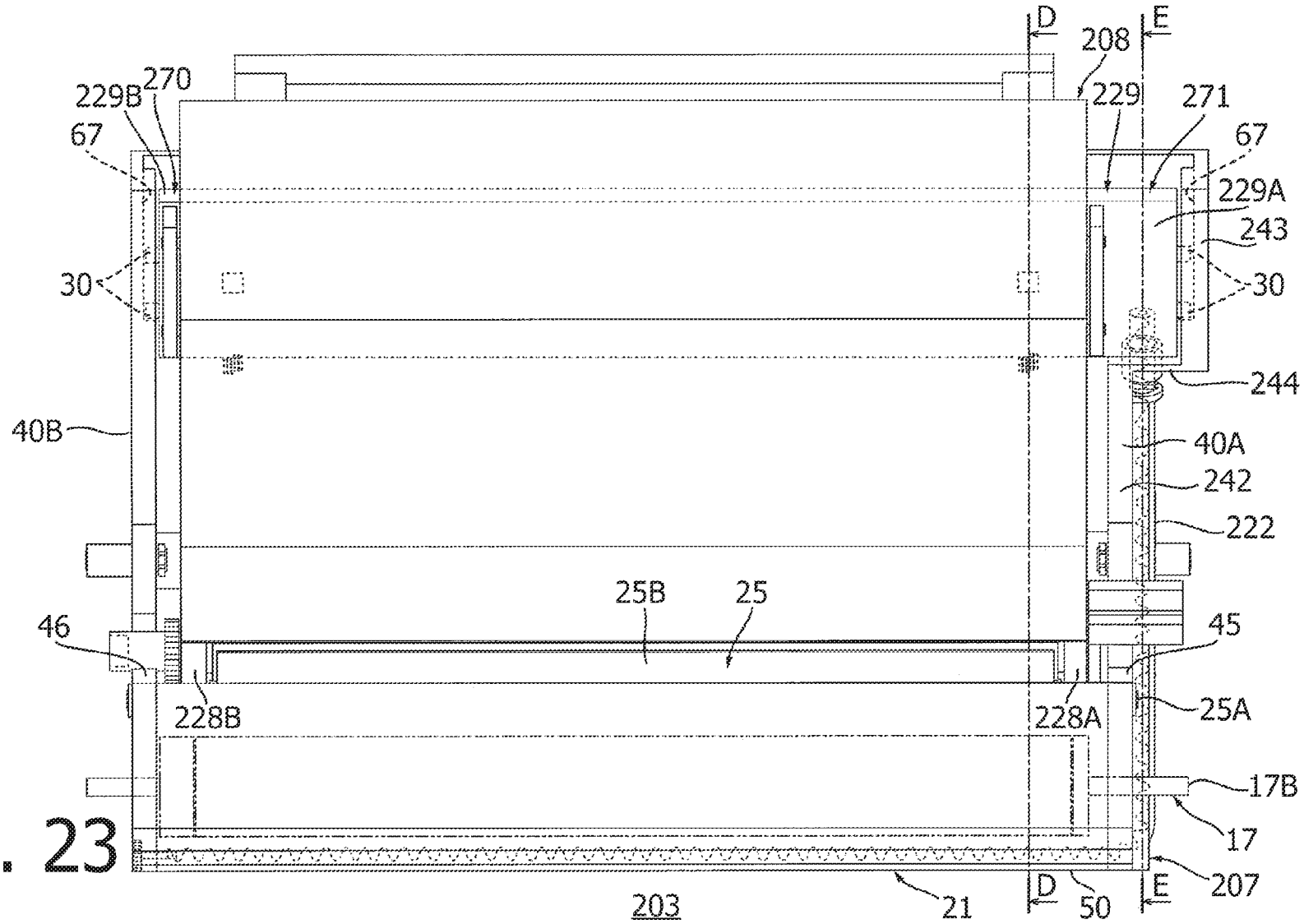

FIG. 21 is a cross-sectional view of the process cartridge according to the second embodiment of the present disclosure viewed at a line D-D shown in FIG. 23.

Figure 22:
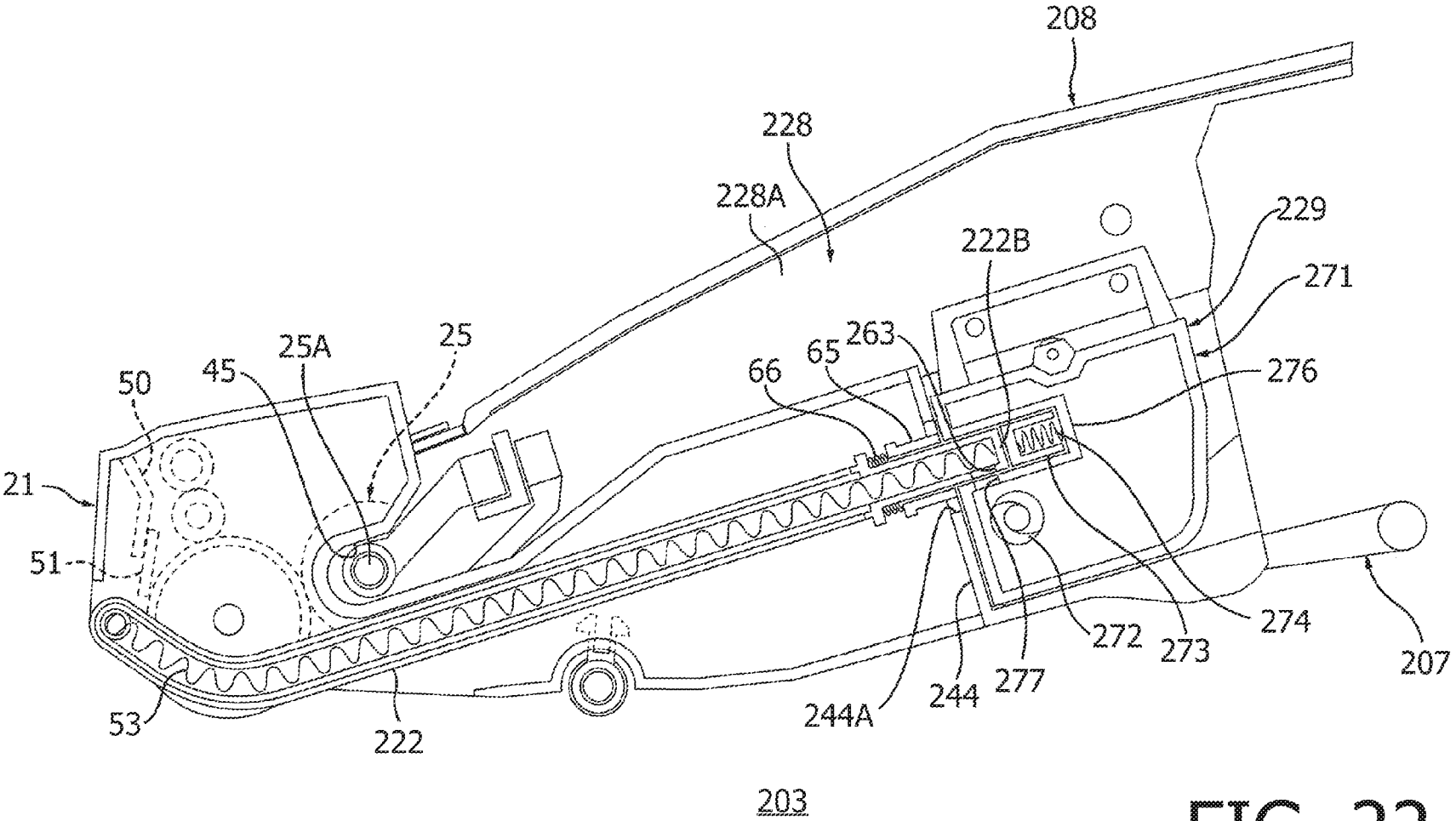

FIG. 22 is a cross-sectional view of the process cartridge according to the second embodiment of the present disclosure viewed at the line E-E shown in FIG. 23.

FIG. 23 is a plan view of the process cartridge according to the second embodiment of the present disclosure.

Figure 24:
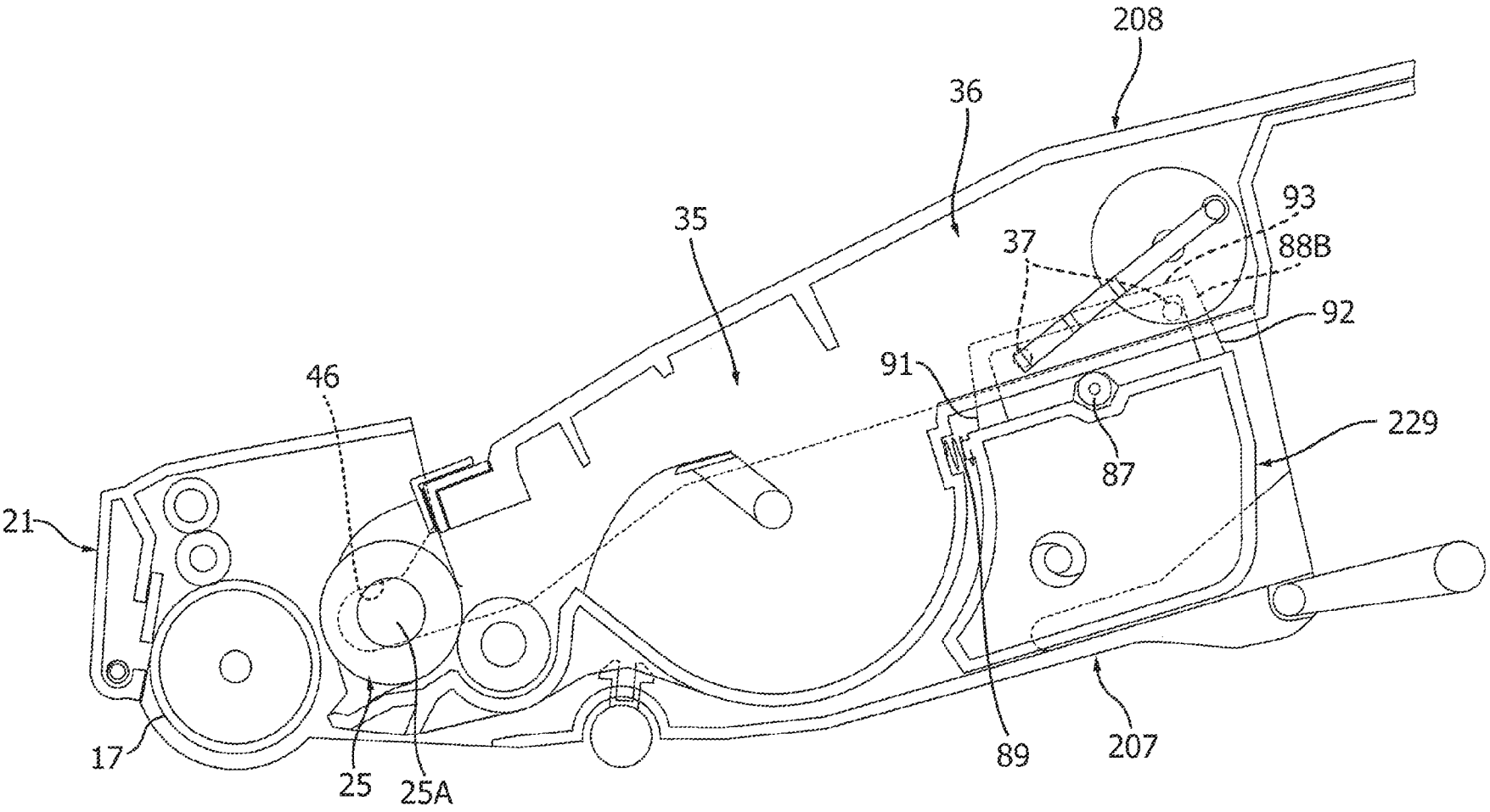

FIG. 24 is a cross-sectional view of the process cartridge according to the second embodiment of the present disclosure with the photosensitive drum being separated from the developer roller.

Figure 25:
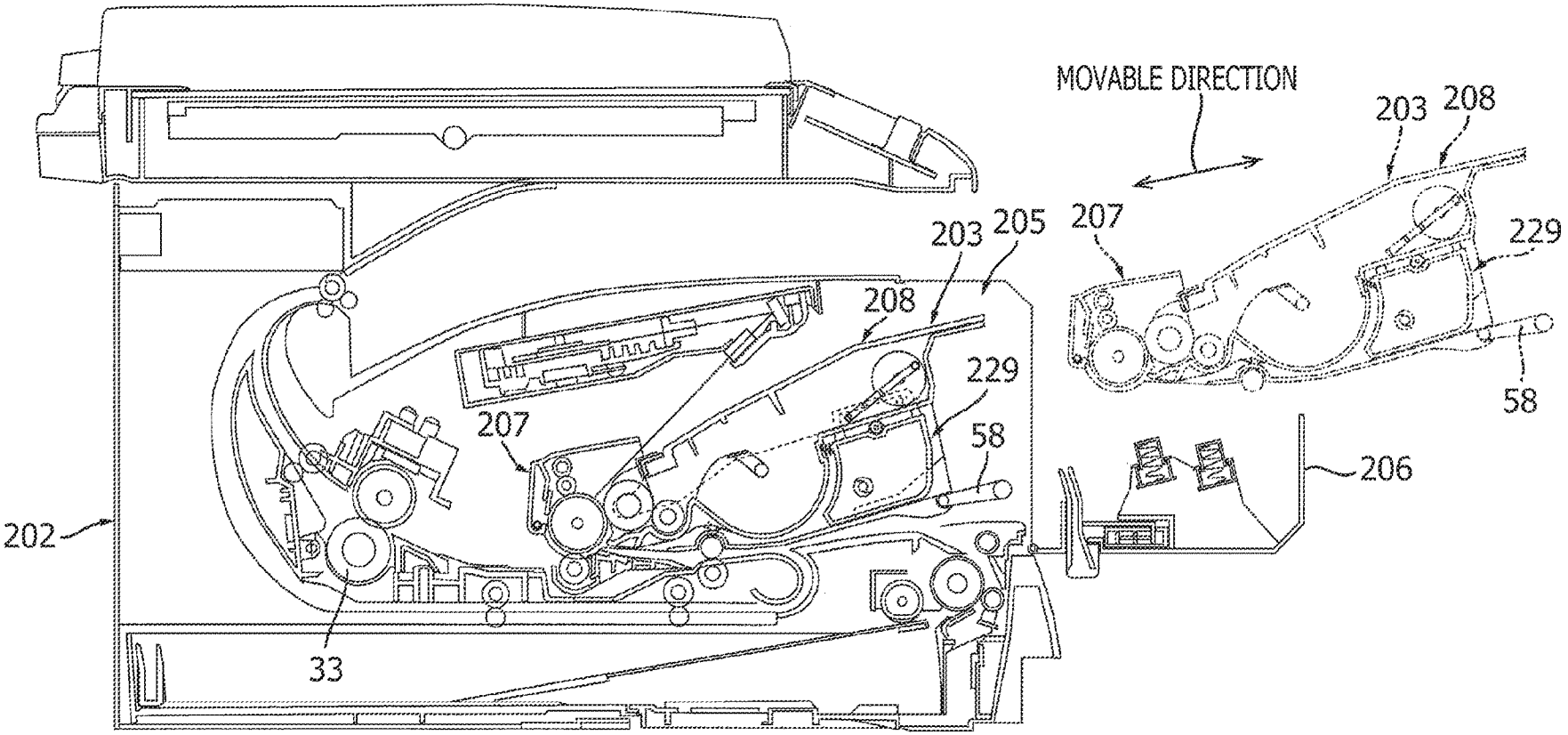

FIG. 25 is a cross-sectional view of the image forming apparatus to illustrate attachment and detachment of the process cartridge to and from a body of the image forming apparatus according to the second embodiment of the present disclosure.

Figure 26:
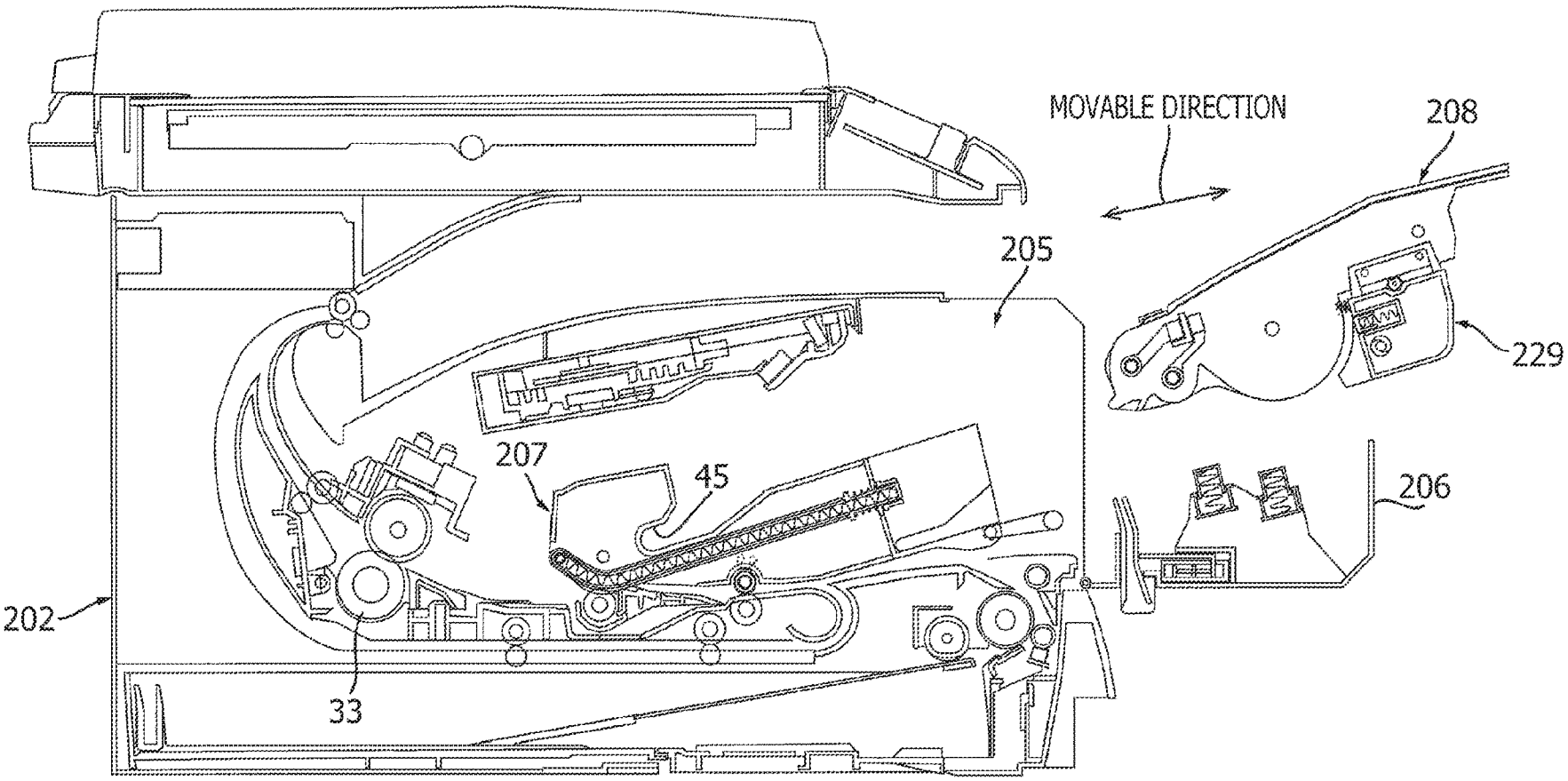

FIG. 26 is a cross-sectional view of the image forming apparatus to illustrate attachment and detachment of the developing cartridge to and from the drum cartridge according to the second embodiment of the present disclosure.

Figure 27A:
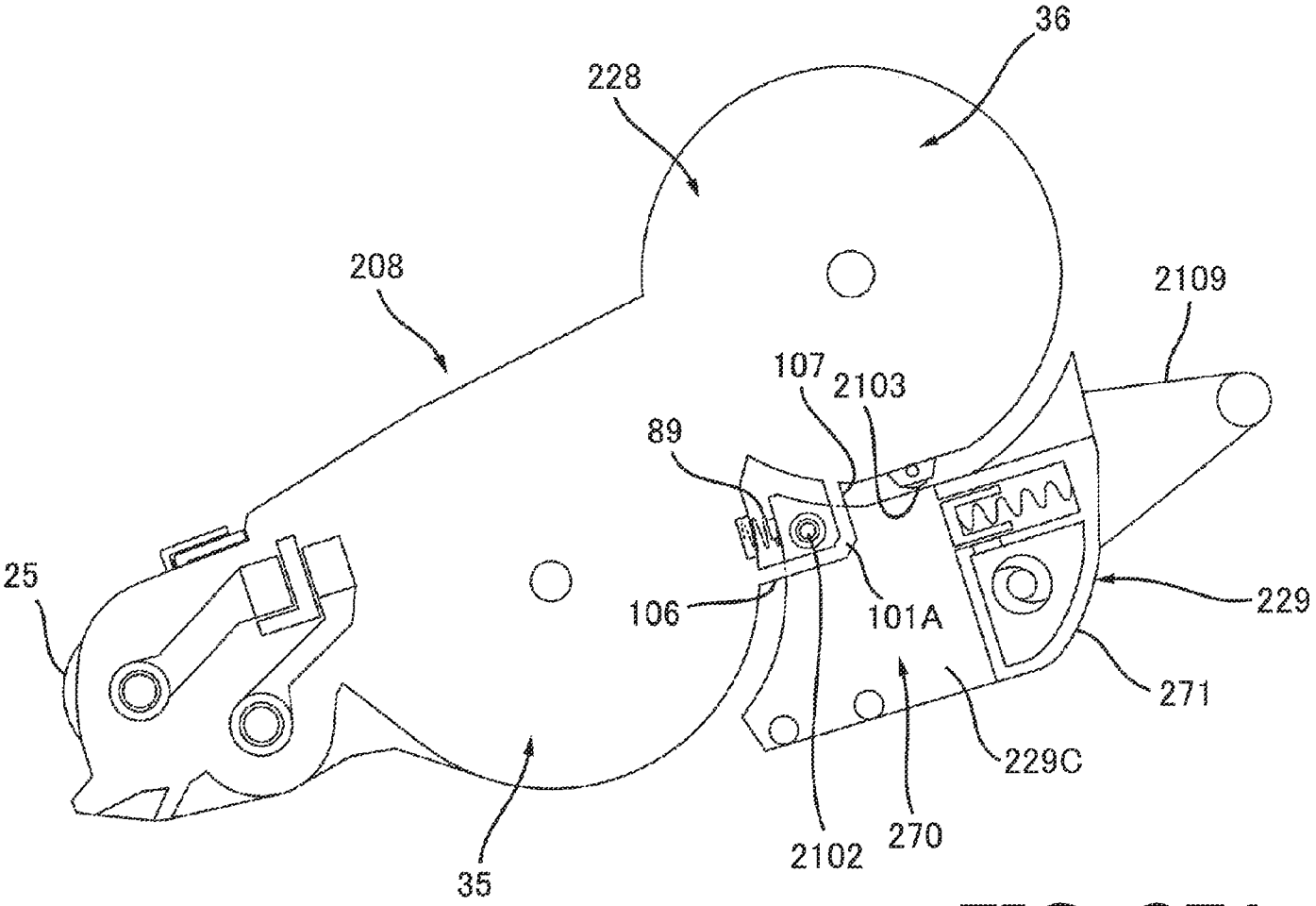
Figure 27B:
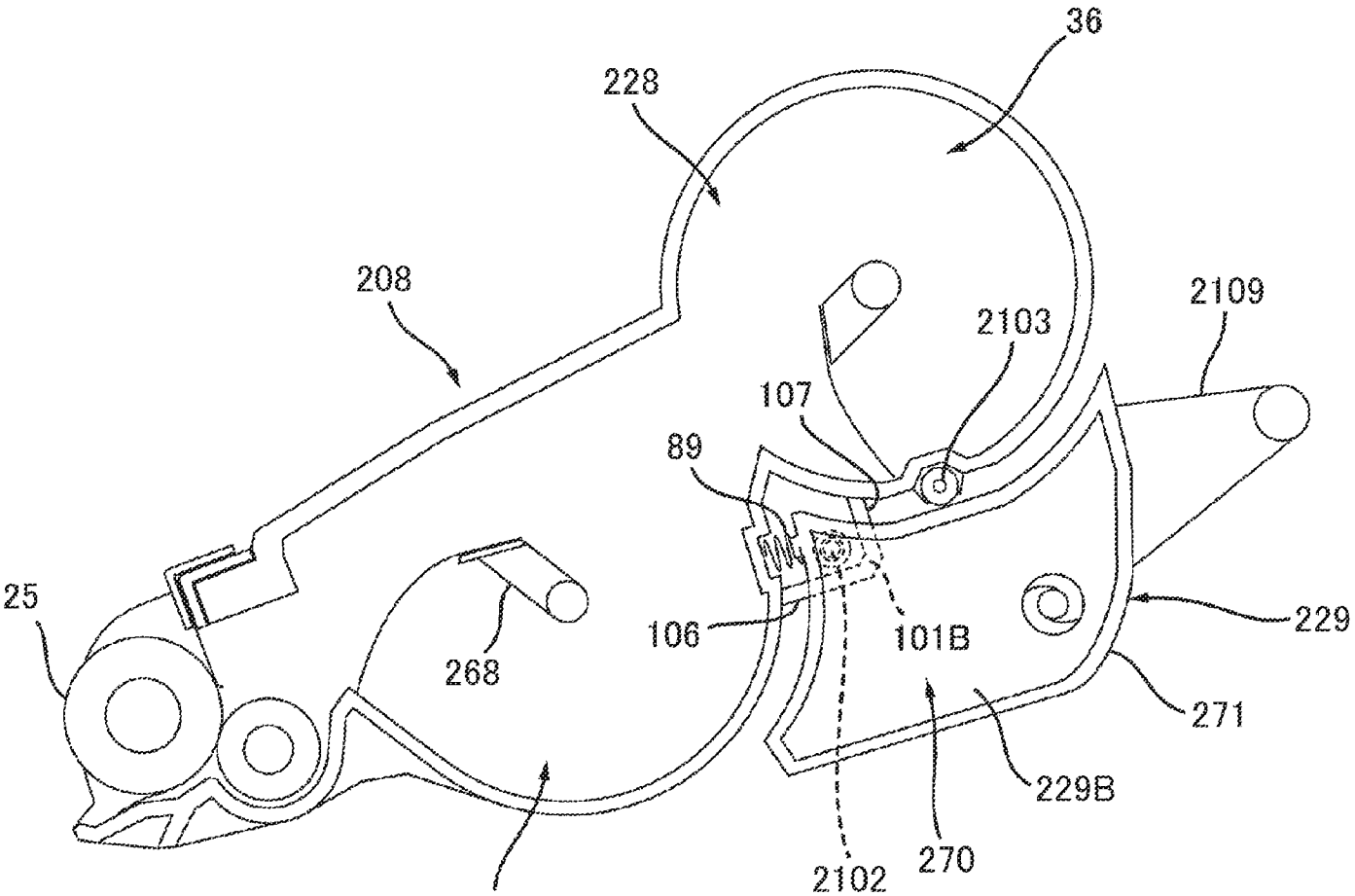

FIG. 27A is a cross-sectional view of a developing cartridge and a waste toner container in a first modified example of the second embodiment of the present disclosure viewed at the line B-B shown in FIG. 18. FIG. 27B is a cross-sectional view of the developing cartridge and the waste toner container in the first modified example of the second embodiment of the present disclosure viewed at the line A-A shown in FIG. 18.

Figure 28A:
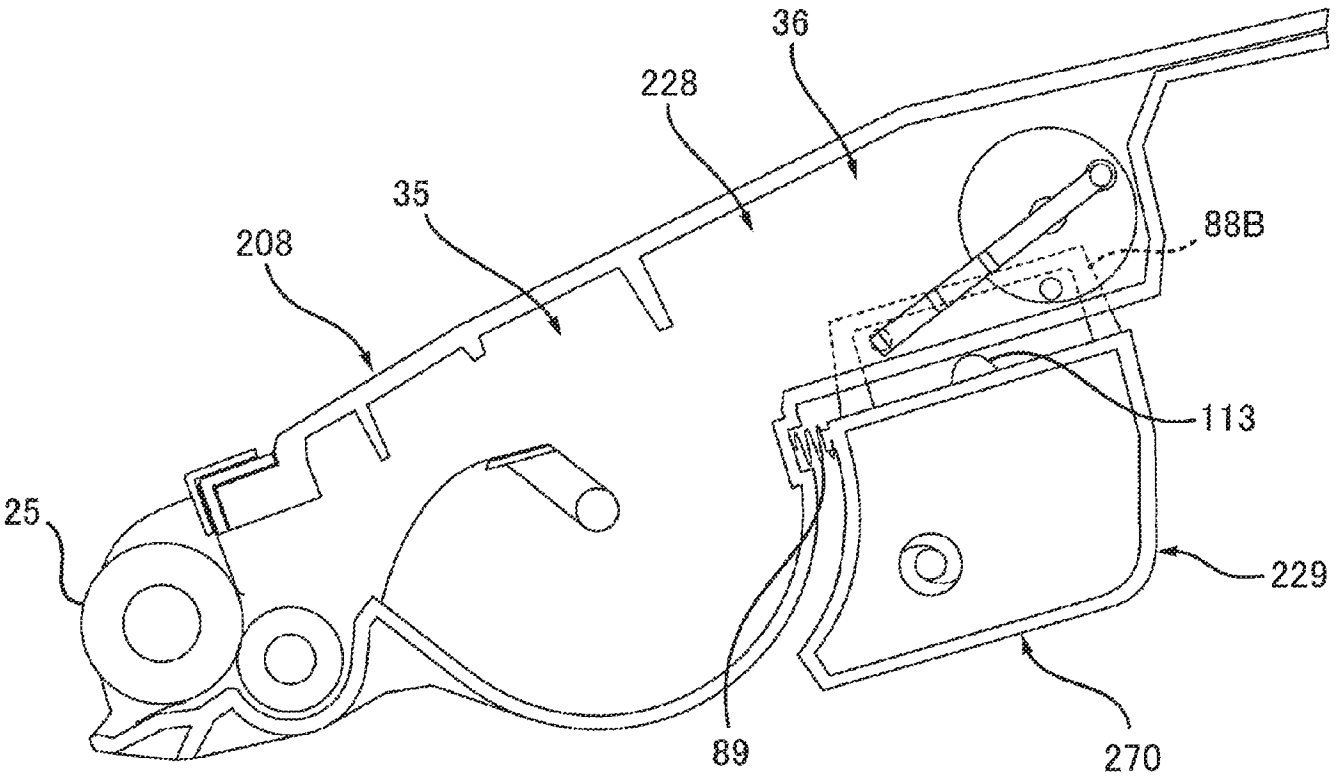
Figure 28B:
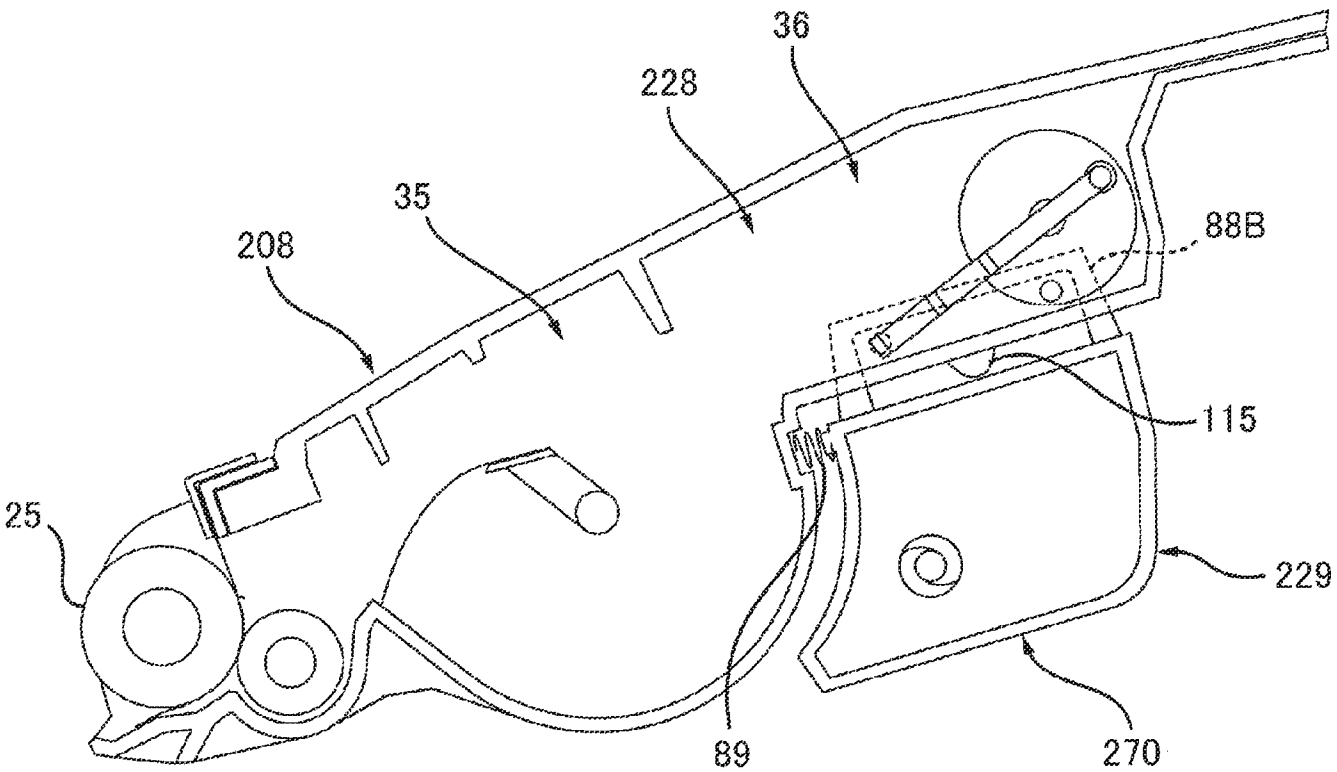

FIG. 28A is a cross-sectional view of the developing cartridge and the waste toner container in a third modified example of the second embodiment of the present disclosure viewed at the line A-A shown in FIG. 18. FIG. 28B is a cross-sectional view of the developing cartridge and the waste toner container in a fourth modified example of the second embodiment of the present disclosure viewed at the line A-A shown in FIG. 18.

Figure 29:
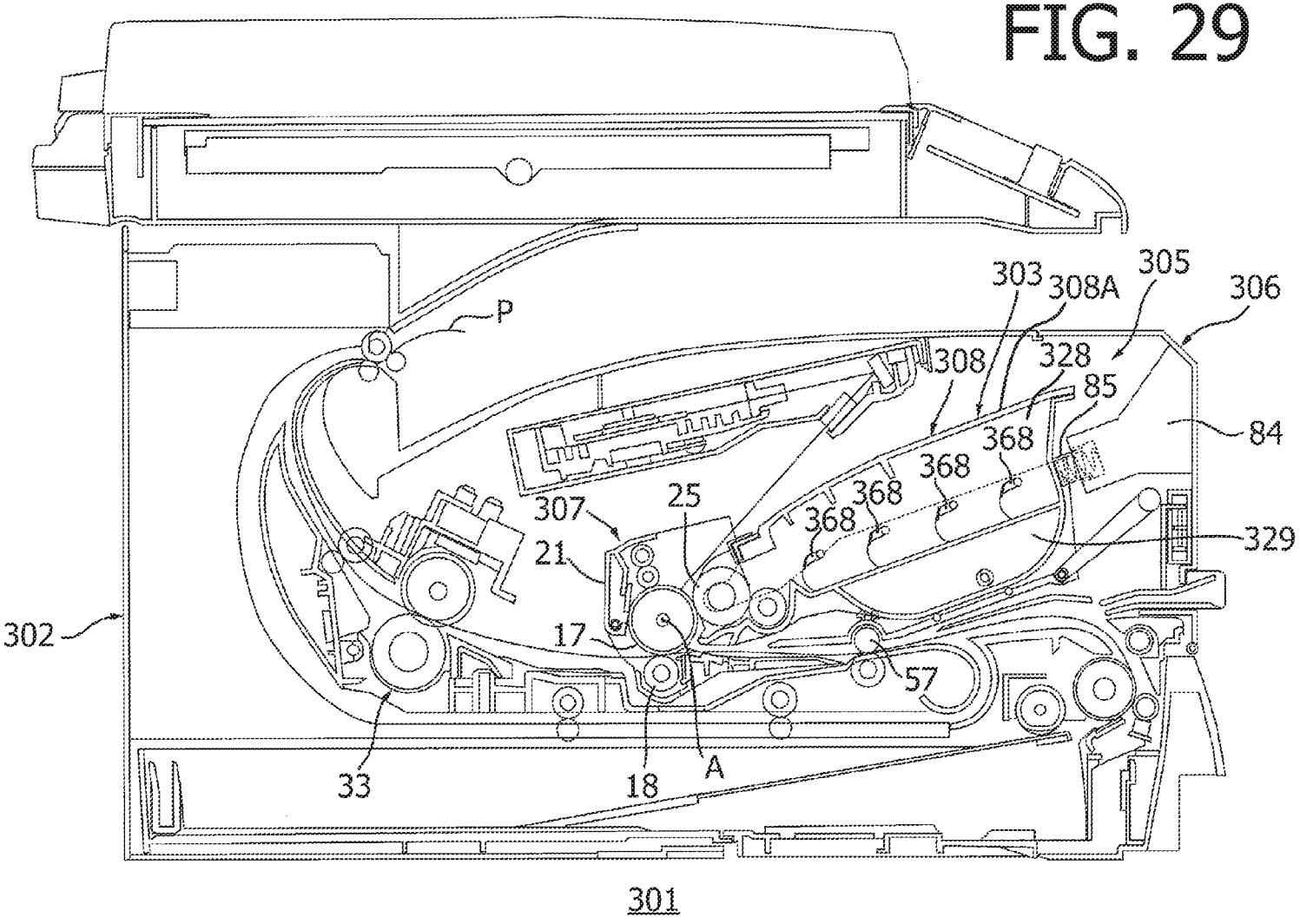

FIG. 29 is a cross-sectional view at a center of an image forming apparatus containing a process cartridge according to a third embodiment of the present disclosure.

Figure 30A:
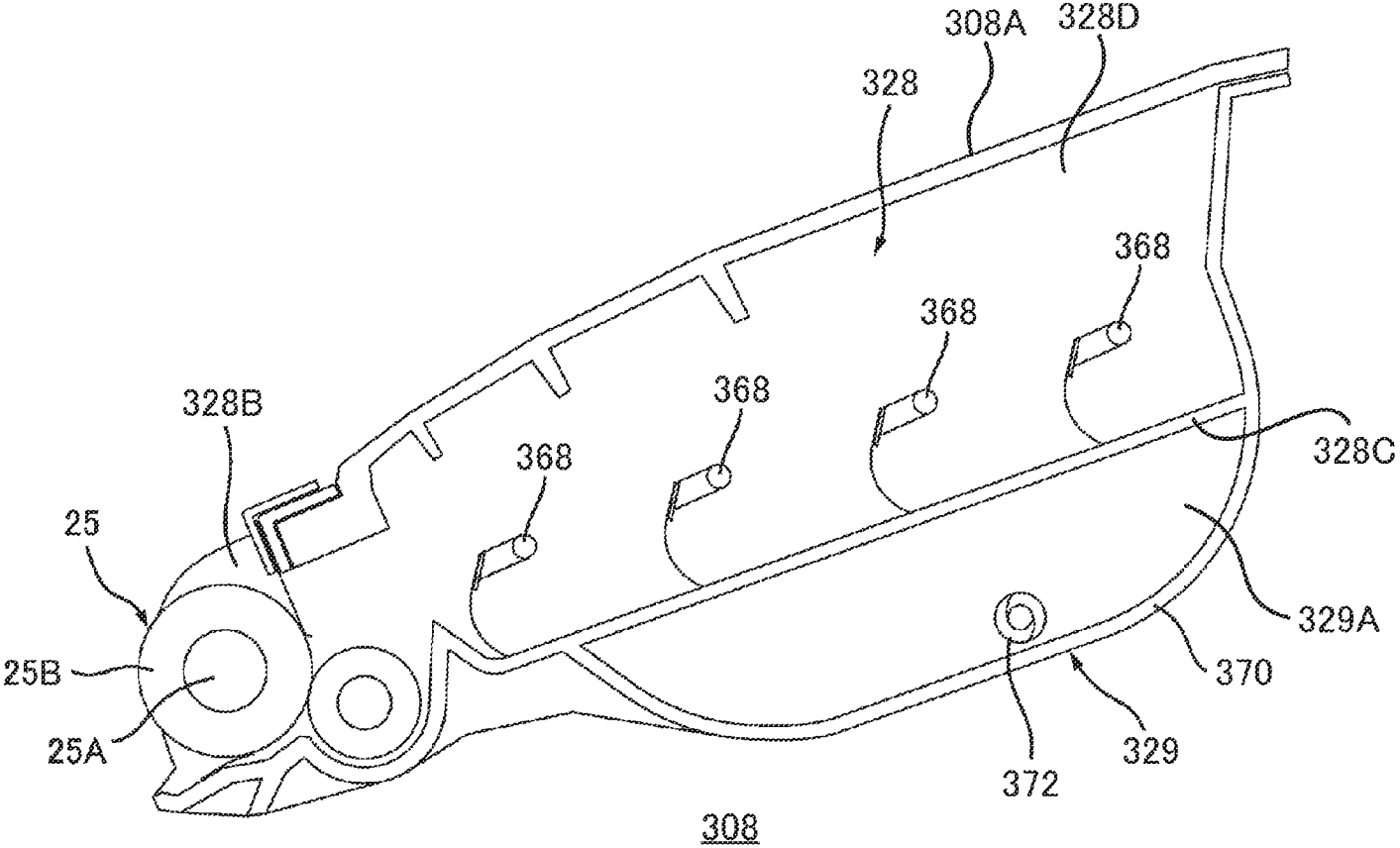
Figure 30B:
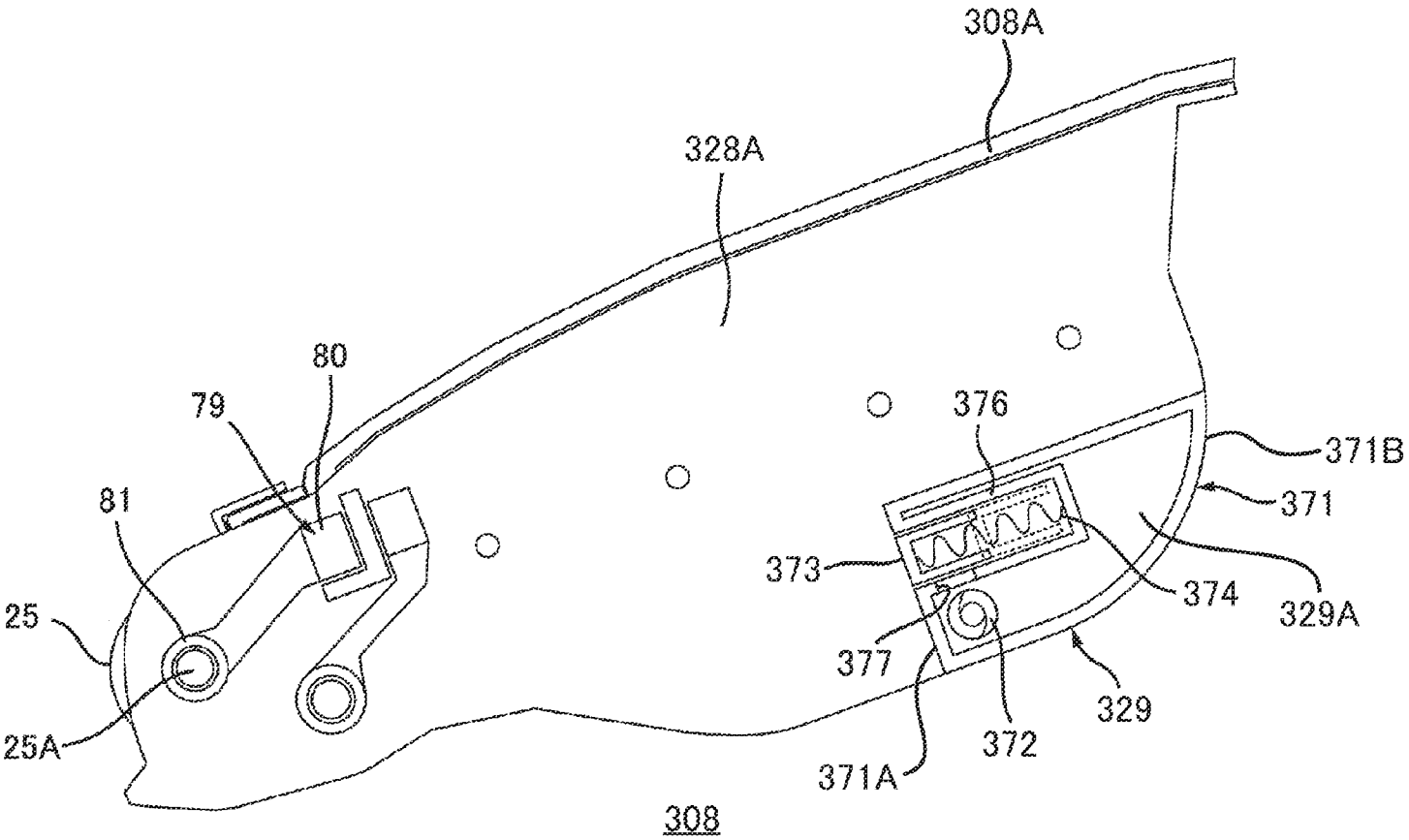

FIG. 30A is a cross-sectional view at a center of a developing cartridge and a waste toner container according to the third embodiment of the present disclosure. FIG. 30B is a sideward cross-sectional view of the developing cartridge and the waste toner container according to the third embodiment of the present disclosure.

Figure 31:
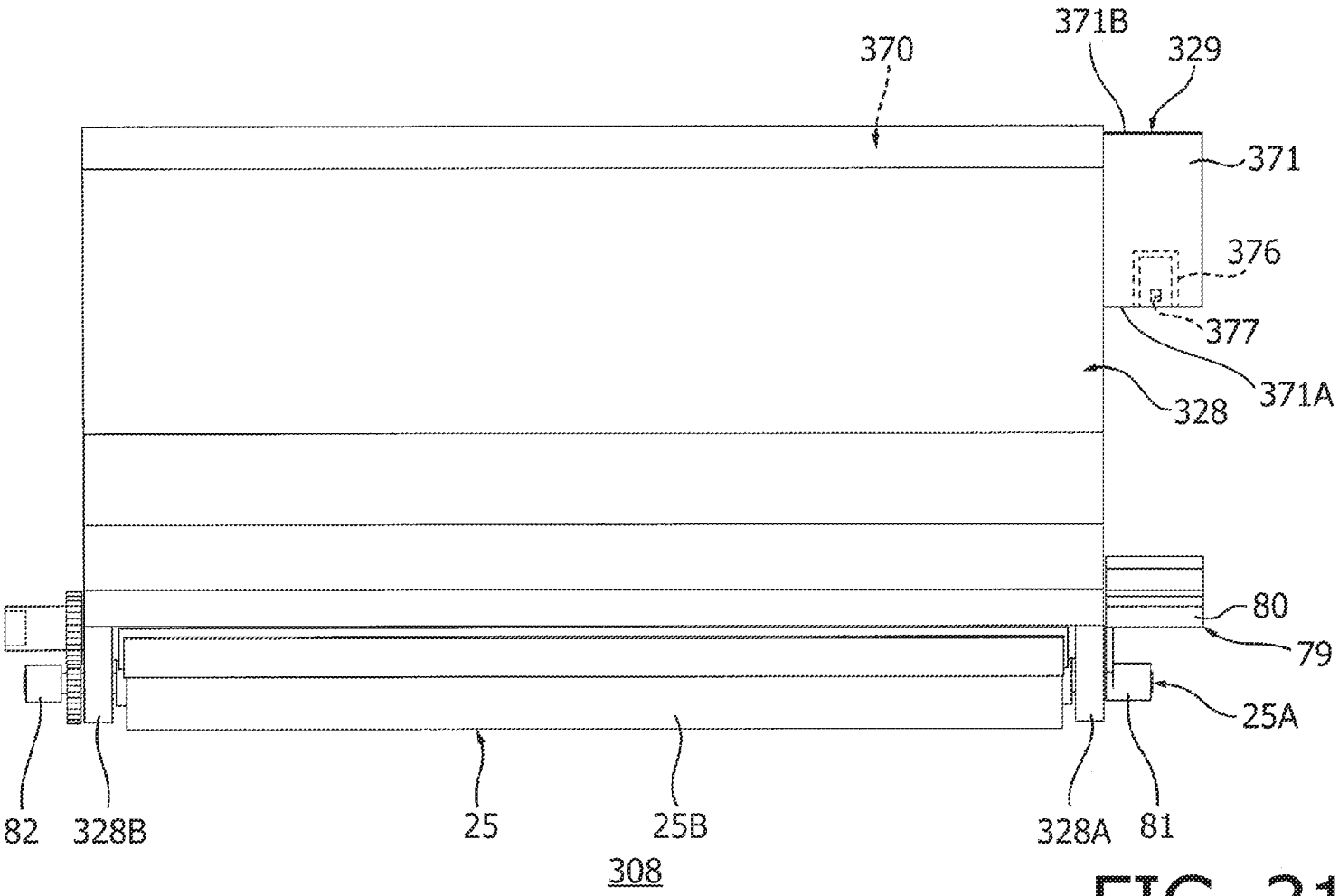

FIG. 31 is a plan view of the developing cartridge and the waste toner container according to the third embodiment of the present disclosure.

Figure 32:
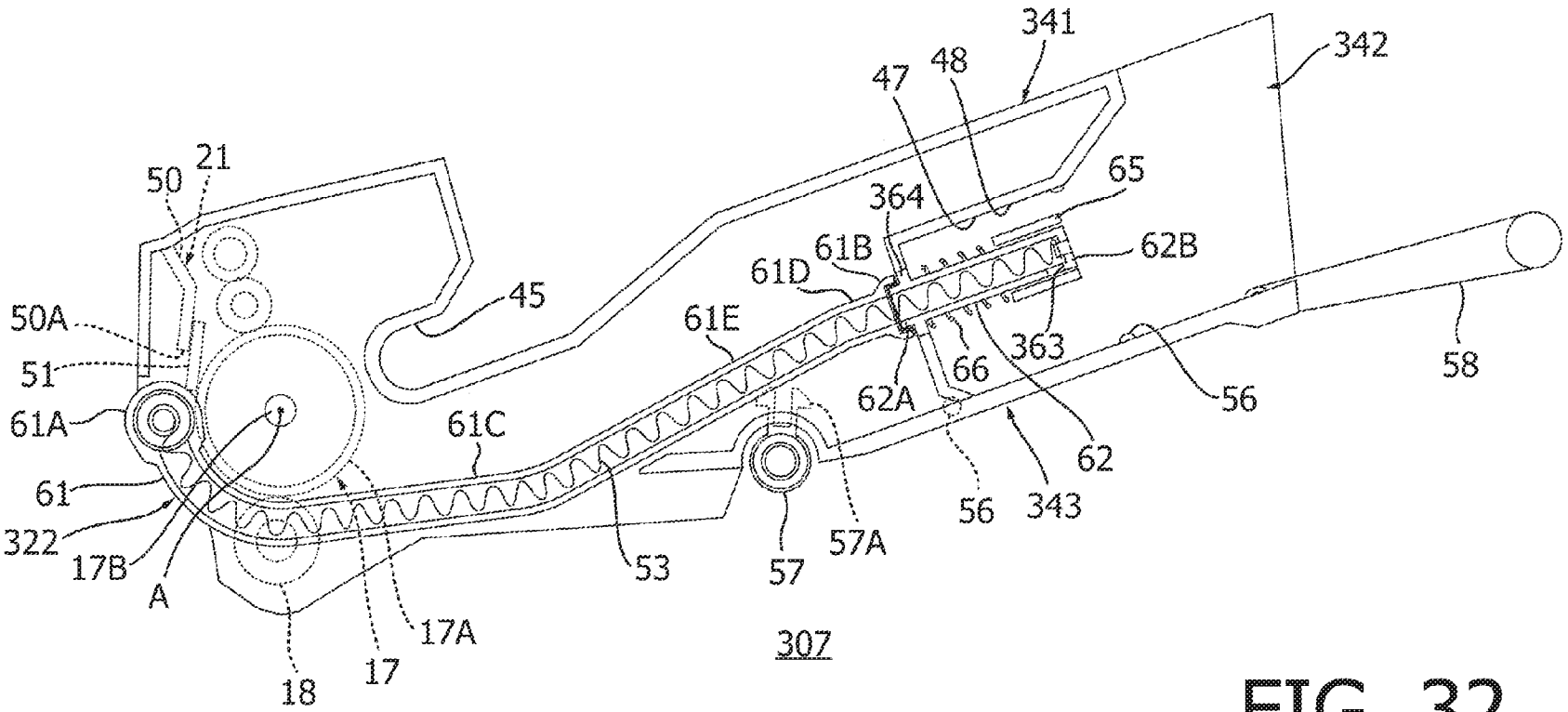

FIG. 32 is a sideward cross-sectional view of a drum cartridge in the process cartridge according to the third embodiment of the present disclosure.

Figure 33:
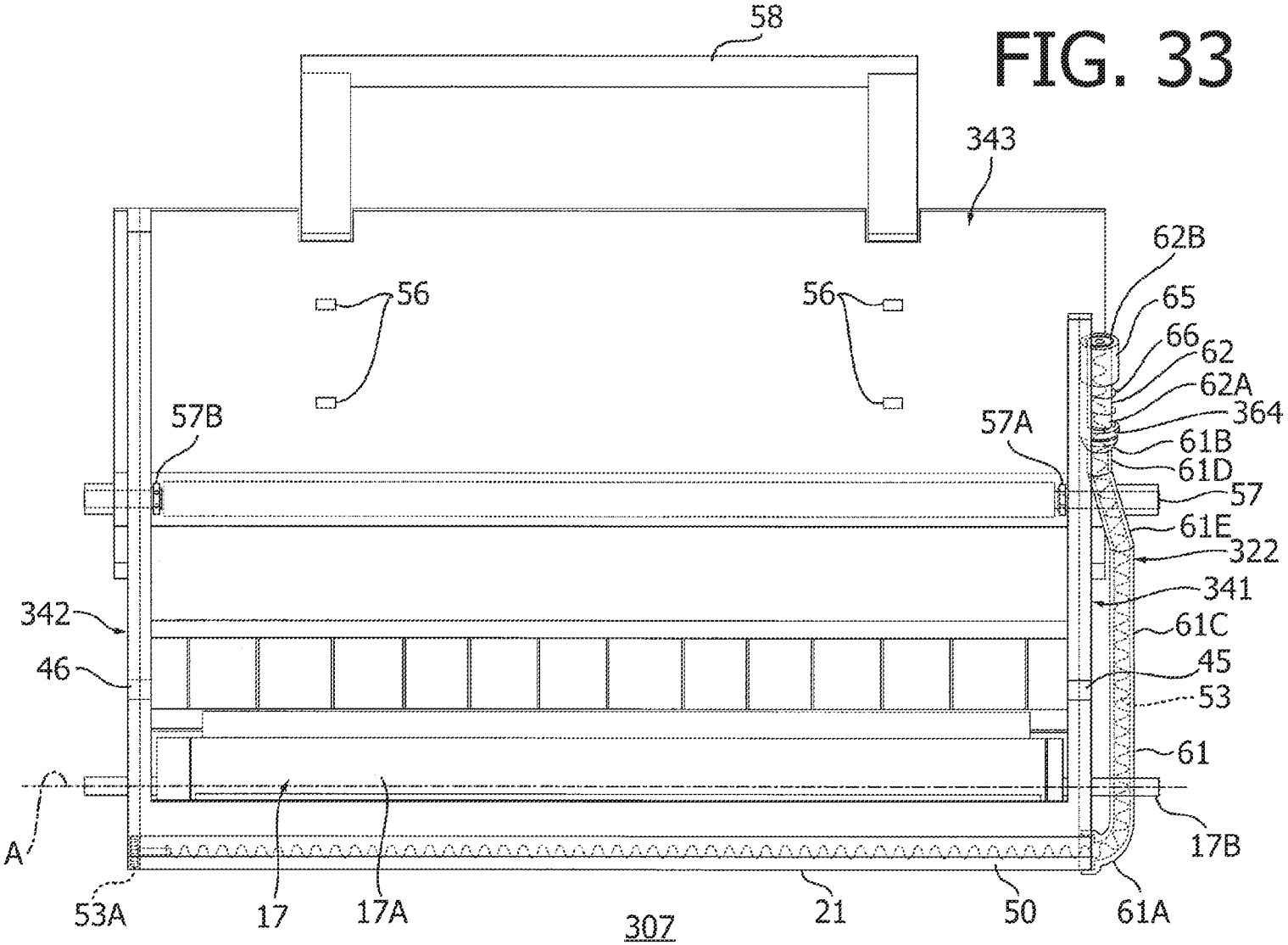

FIG. 33 is a plan view of the drum cartridge according to the third embodiment of the present disclosure.

Figure 34:
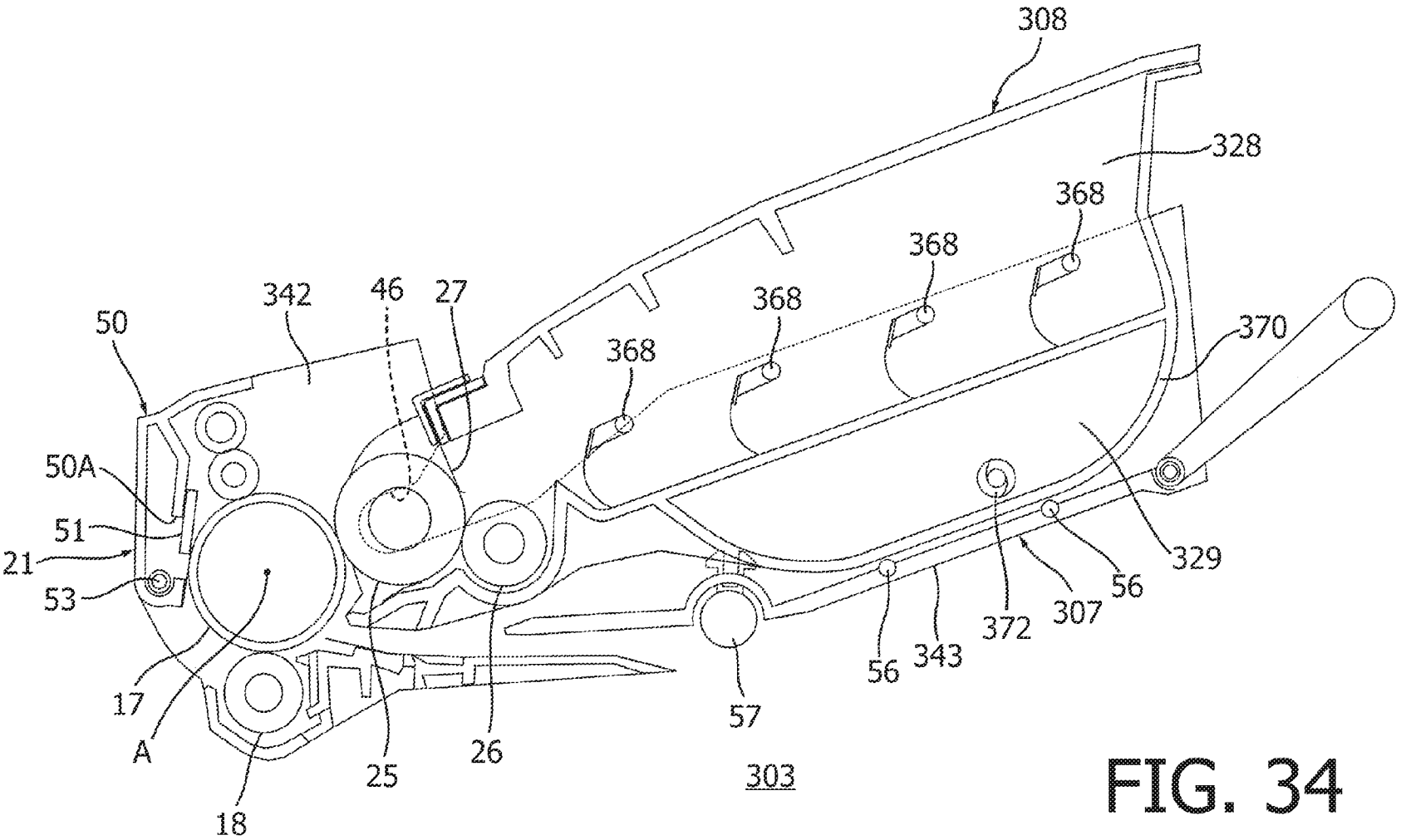

FIG. 34 is a cross-sectional view at a center of the process cartridge according to the third embodiment of the present disclosure.

Figure 35:
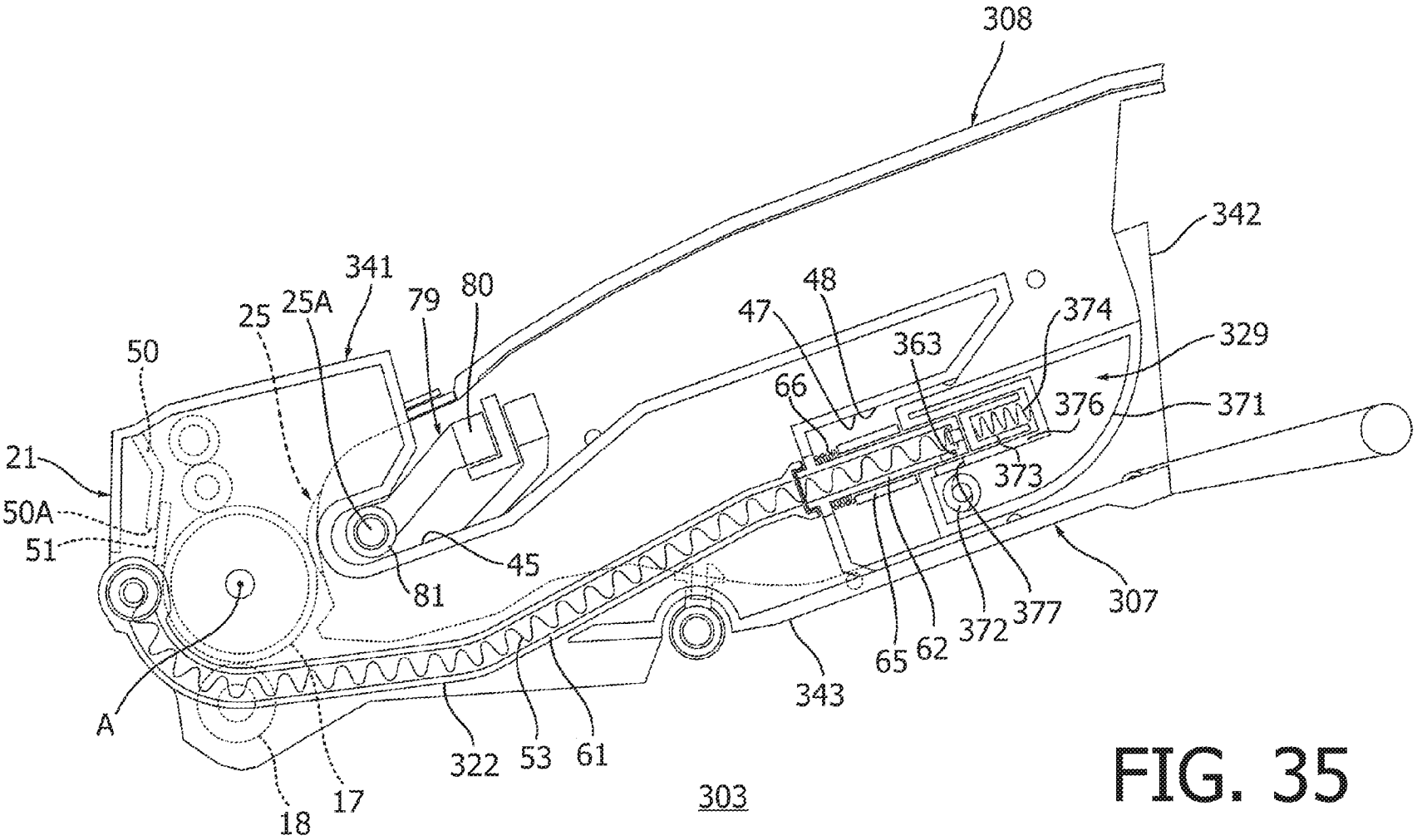

FIG. 35 is a sideward cross-sectional view of the process cartridge according to the third embodiment of the present disclosure.

Figure 36:
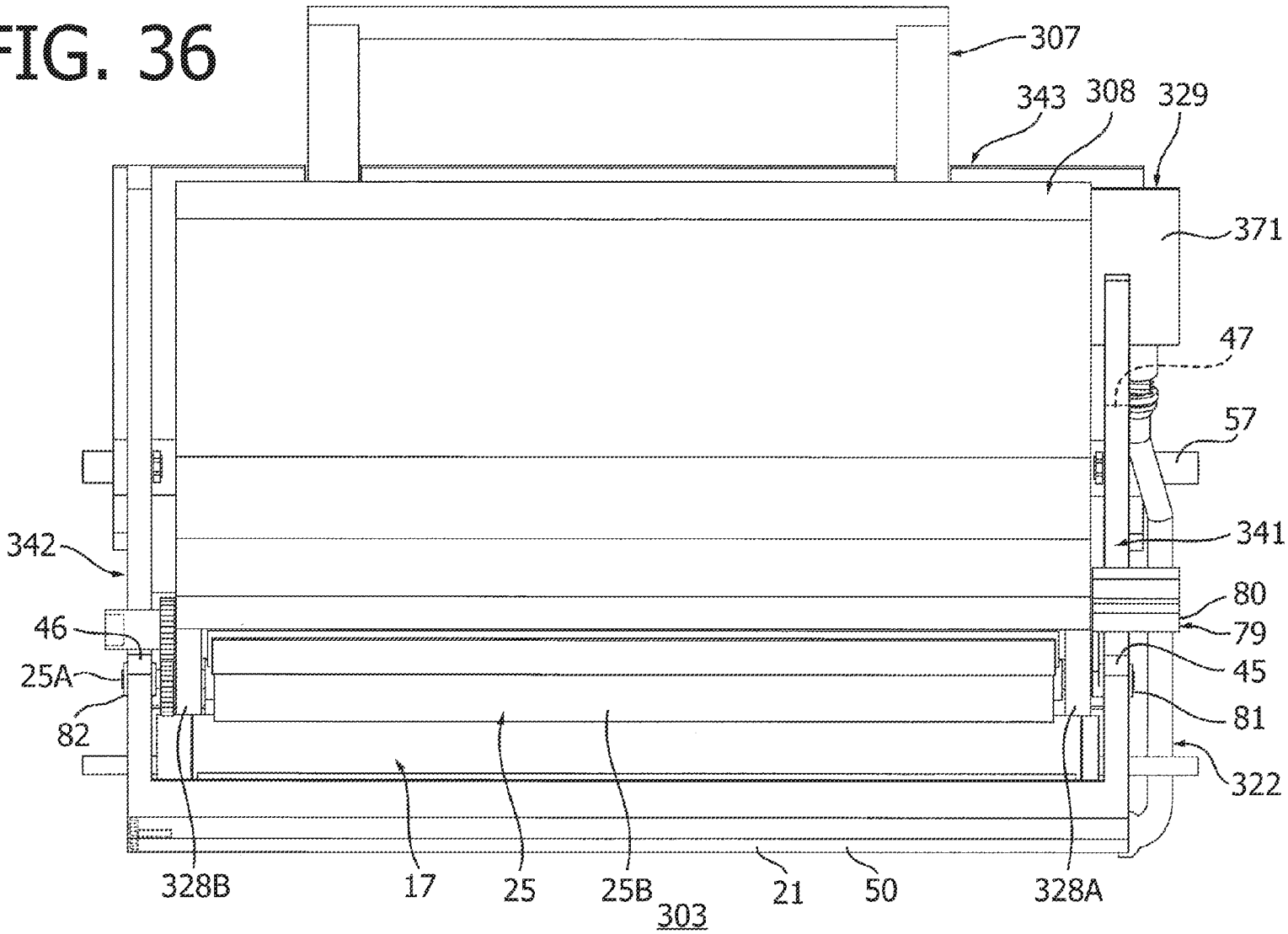

FIG. 36 is a plan view of the process cartridge according to the third embodiment of the present disclosure.

Figure 37:
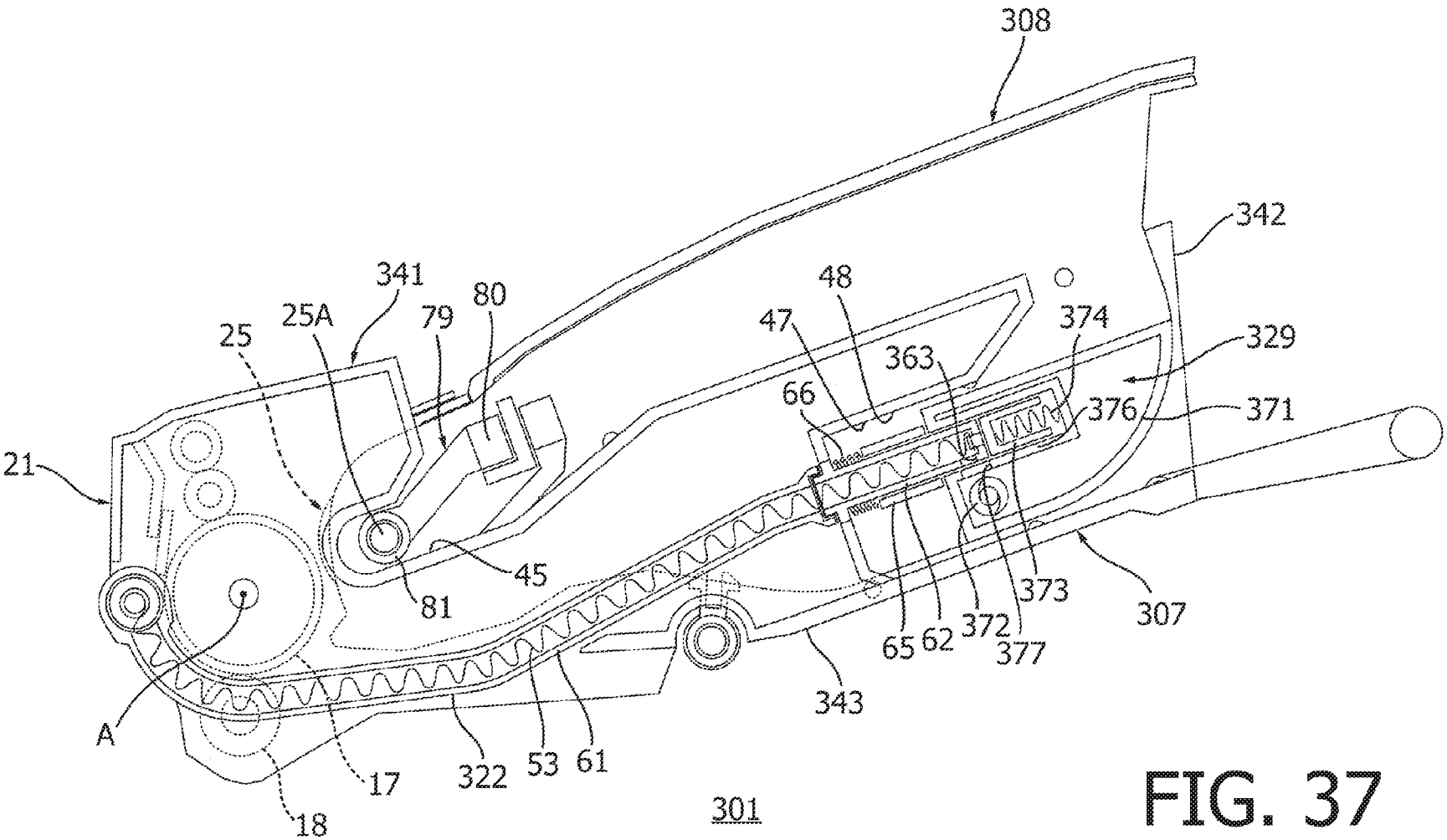

FIG. 37 is cross-sectional view of the process cartridge according to the third embodiment of the present disclosure with the photosensitive drum being separated from the developer roller.

Figure 38:
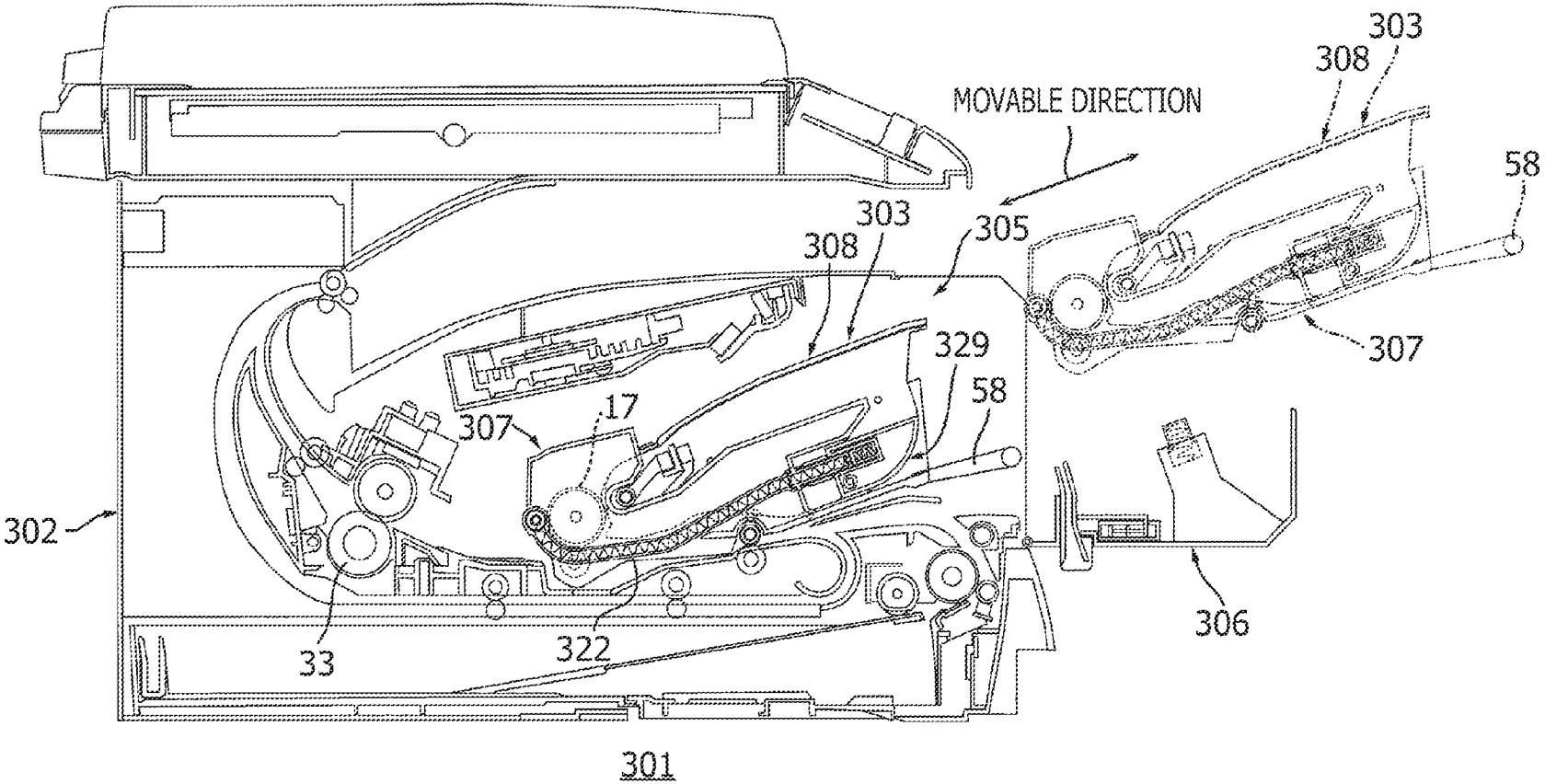

FIG. 38 is a cross-sectional view of the image forming apparatus to illustrate attachment and detachment of the process cartridge to and from a body of the image forming apparatus according to the third embodiment of the present disclosure.

Figure 39:
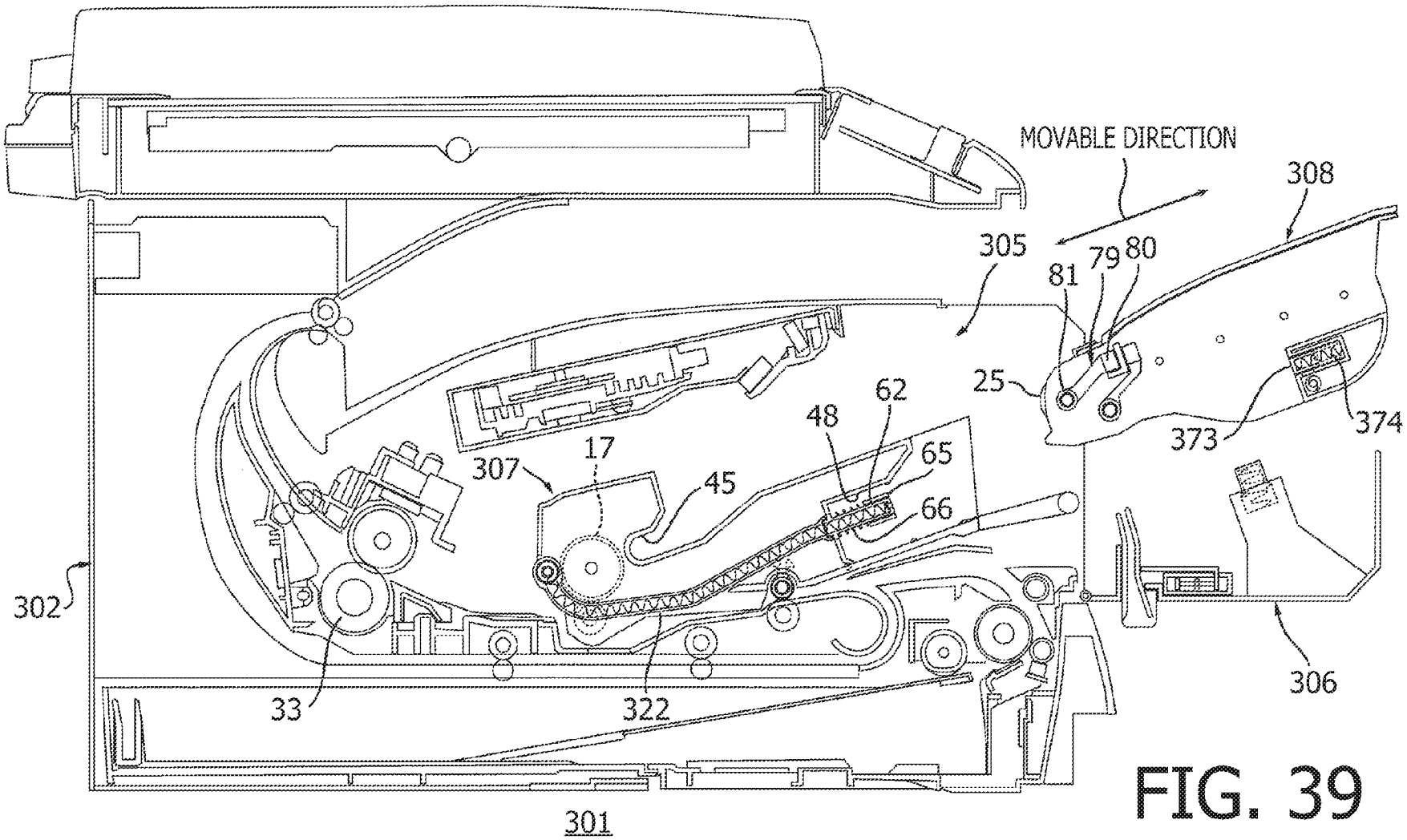

FIG. 39 is a cross-sectional view of the image forming apparatus to illustrate attachment and detachment of the developing cartridge to and from the drum cartridge according to the third embodiment of the present disclosure.

Figure 40:
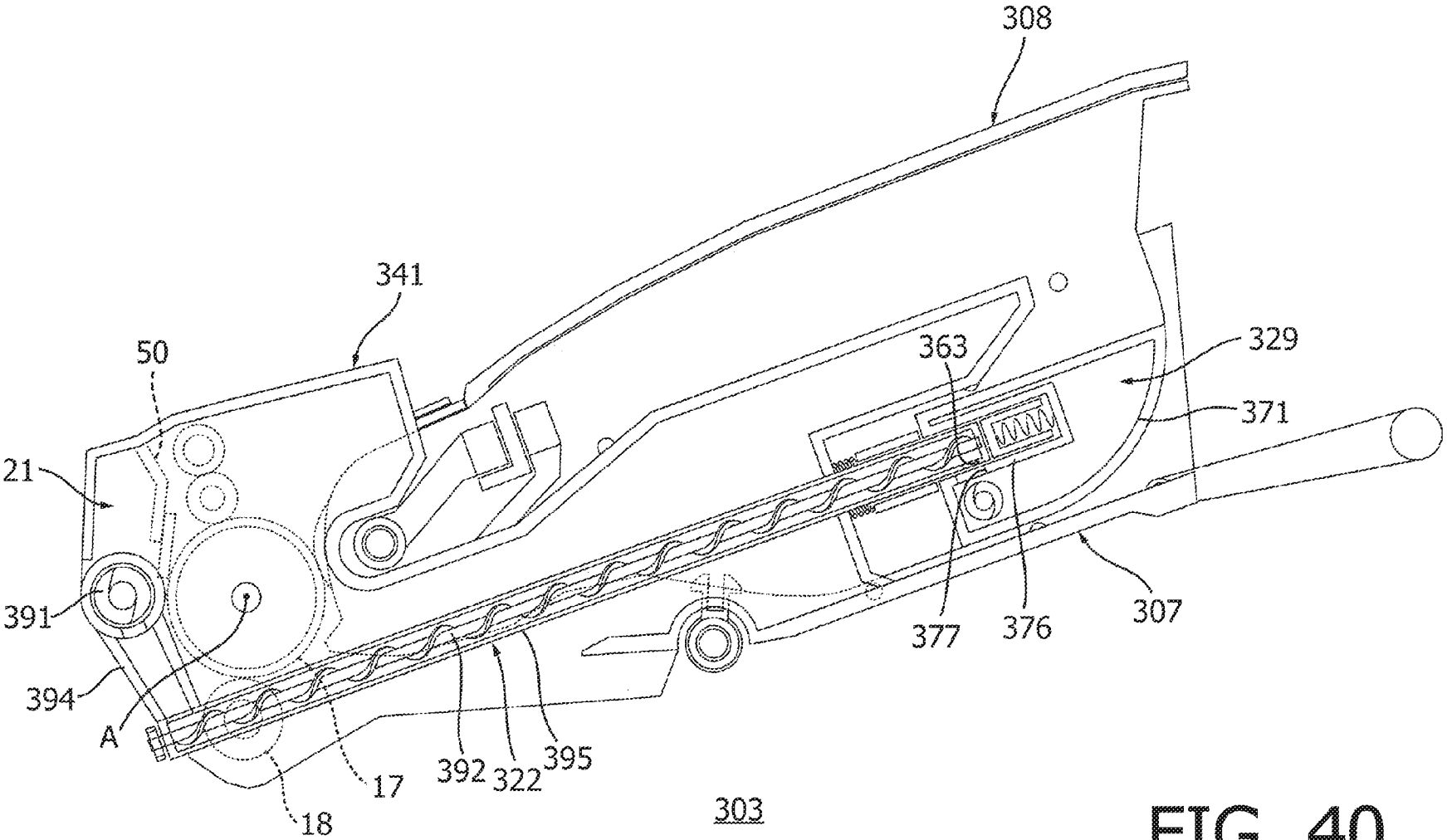

FIG. 40 is a sideward cross-sectional view of a modified example of the process cartridge according to the third embodiment of the present disclosure.

DETAILED DESCRIPTION

Hereinafter, embodiments of the present disclosure will be described with reference to the accompanying drawings. It is noted that various connections may be set forth between elements in the following description. These connections in general, and unless specified otherwise, may be direct or indirect, and this specification is not intended to be limiting in this respect.

I. First Embodiment

1. Overall Configuration of Image Forming Apparatus 1

Figure 1:
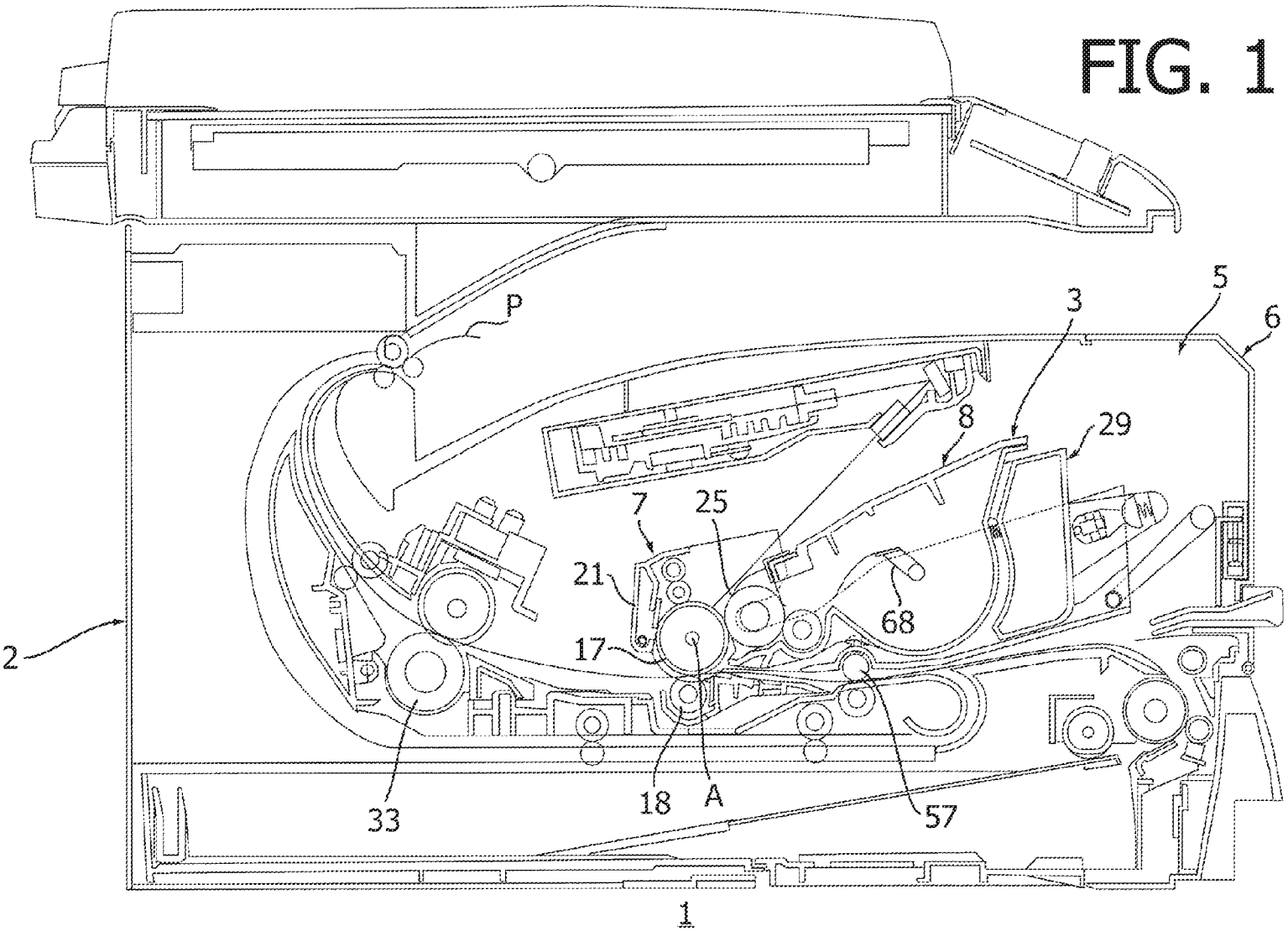
FIG. 1 is a cross-sectional view at a center of an image forming apparatus containing a process cartridge according to a first embodiment of the present disclosure.

An overall configuration of an image forming apparatus 1 according to the first embodiment will be described below. As shown in FIG. 1, the image forming apparatus 1 includes a main body 2, a process cartridge 3 which is attachable to and detachable from the main body 2, a transfer roller 18, and a fuser 33.

1.1 Main Body 2

The main body 2 includes an opening 5 and a cover 6.

The opening 5 and the fuser 33 are, when the process cartridge 3 is attached to the main body 2, located on opposite sides of the process cartridge 3 with regard to a movable direction of the process cartridge 3. In other words, the process cartridge 3 is located between the opening 5 and the fuser 33 in the movable direction of the process cartridge 3 when the process cartridge 3 is attached to the main body 2. The process cartridge 3 is movable with respect to the main body 2 in a predetermined movable direction to be attached to or detached from the main body 2. The movable direction of the process cartridge 3 includes an attaching direction, along which the process cartridge 3 is attachable to the main body 2, and a detaching direction, along which the process cartridge 3 is detachable from the main body 2.

Figure 10:
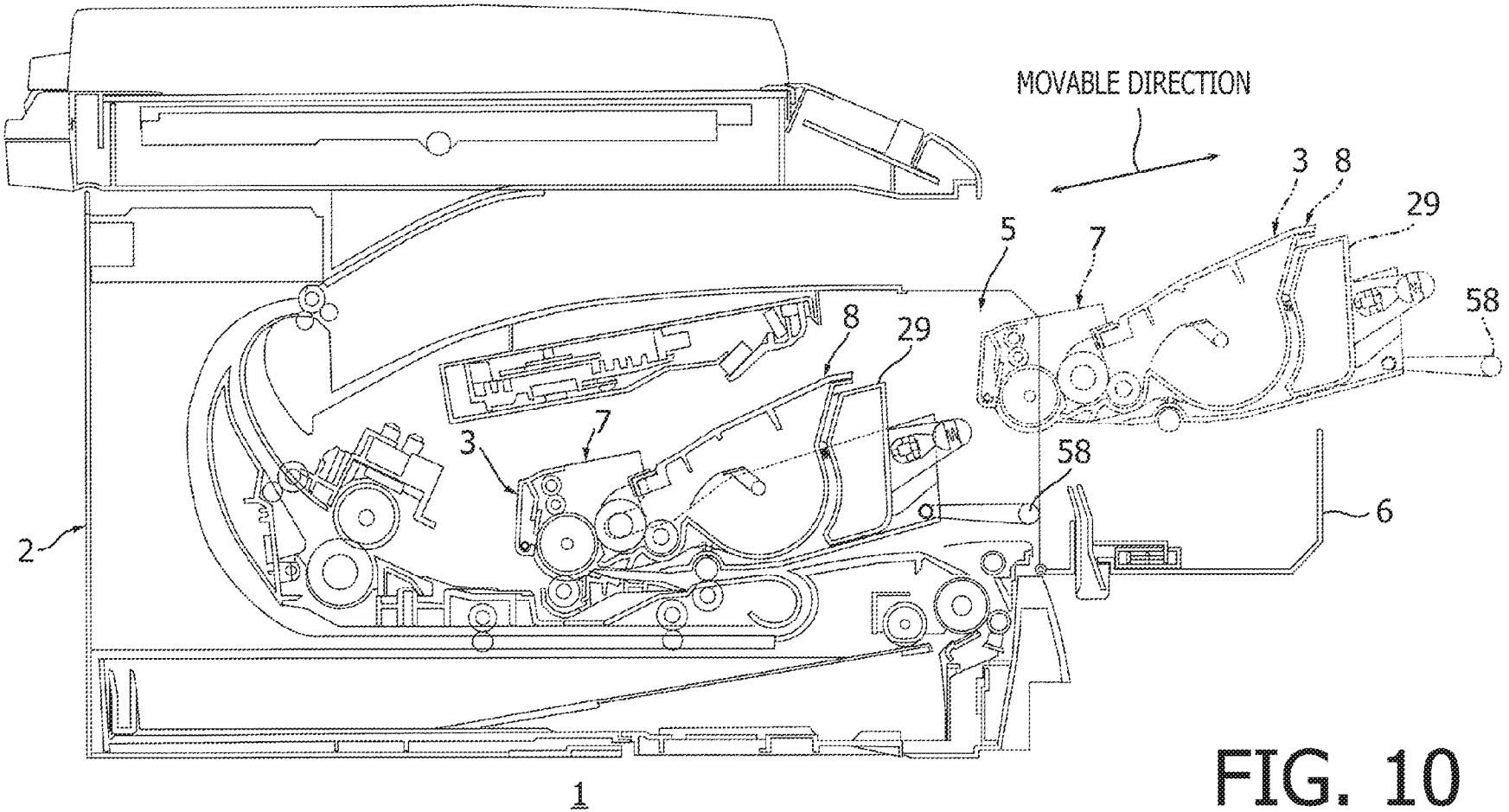
FIG. 10 is a cross-sectional view of the image forming apparatus to illustrate attachment and detachment of the process cartridge to and from a body of the image forming apparatus according to the first embodiment of the present disclosure.

The cover 6 is movable between a closure position (see FIG. 1), in which the cover 6 closes the opening 5, and an open position (see FIG. 10), in which the opening 5 is exposed.

1.2 Process Cartridge 3

The process cartridge 3 may be attached to and detached from the main body 2 through the opening 5. The process cartridge 3 includes a drum cartridge 7, a developing cartridge 8, and a waste toner container 29.

1.2.1 Drum Cartridge 7

Figure 4:
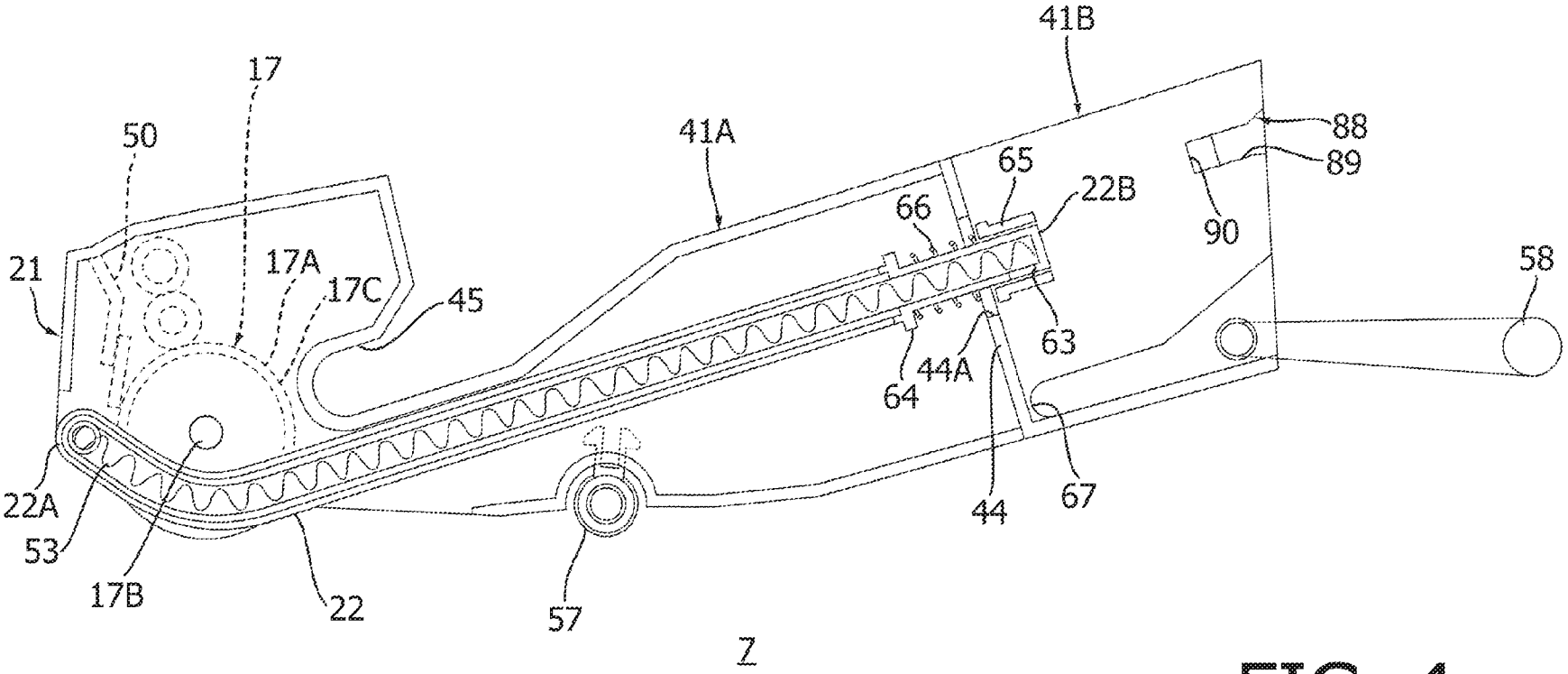
FIG. 4 is a sideward cross-sectional view of a drum cartridge according to the first embodiment of the present disclosure.
Figure 5:
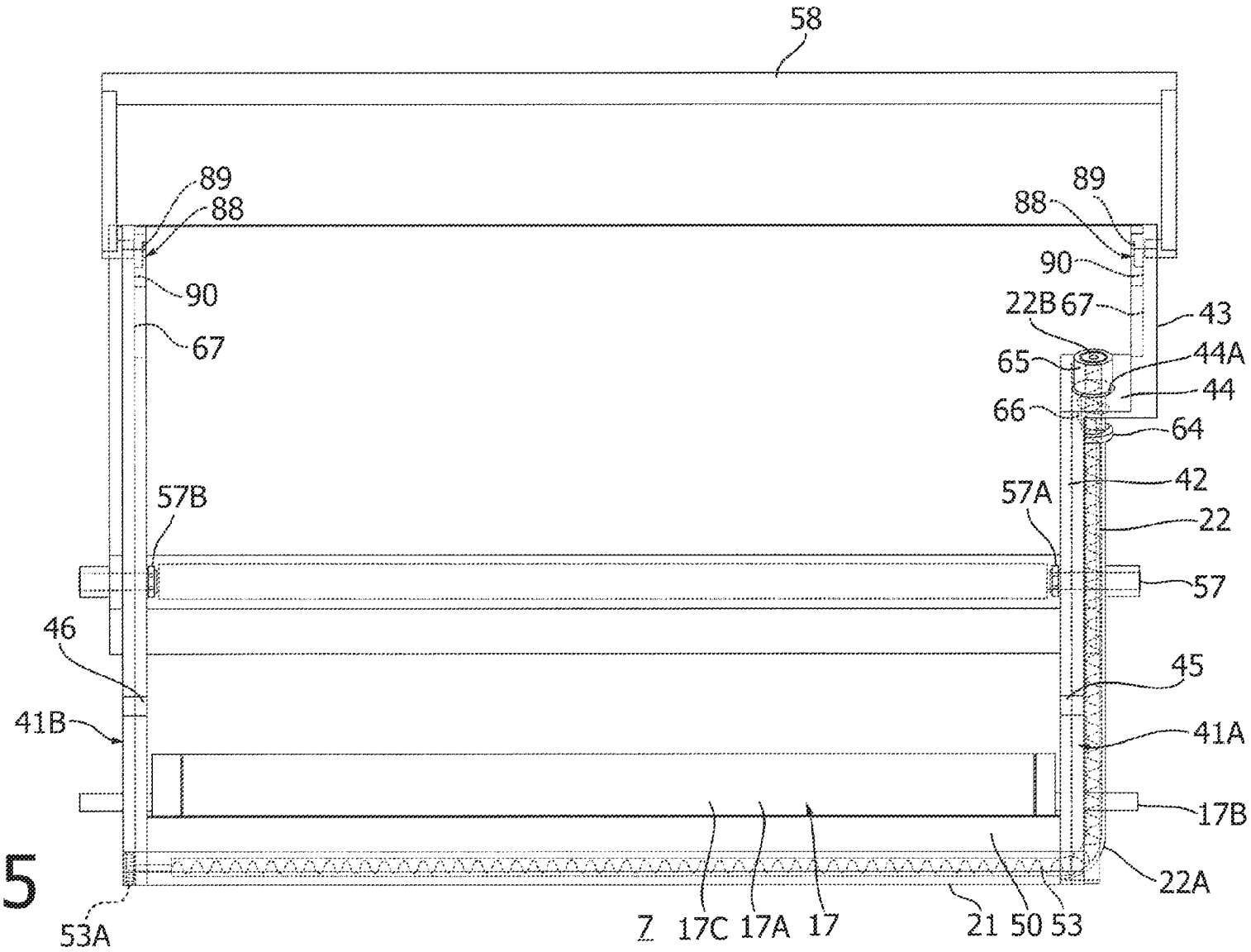
FIG. 5 is a plan view of the drum cartridge according to the first embodiment of the present disclosure.

The drum cartridge 7 includes a photosensitive drum 17, a drum cleaner 51, a cleaner frame 50, and a waste toner conveyer tube 22 (see FIGS. 4 and 5).

The photosensitive drum 17 includes a rotation shaft A and is rotatable about the rotation shaft A.

1.2.2 Developing Cartridge 8

The developing cartridge 8 includes a developer roller 25 and a toner storage 28. The developer roller 25 is arranged to contact the photosensitive drum 17. The developer roller 25 may supply toner in the developing cartridge 8 to the photosensitive drum 17 through the contact. The toner storage 28 may store the toner to be supplied to the photosensitive drum 17. The developing cartridge 8 is detachably attached to the drum cartridge 7. For example, the developing cartridge 8 is movable in a direction orthogonal to an axial direction of the photosensitive drum 17 to be attached to or detached from the drum cartridge 7. The developing cartridge 8 and the fuser 33 are, when the process cartridge 3 is attached to the main body 2, located opposite sides of the photosensitive drum 17 with regard to the attachable/detachable direction of the developing cartridge 8 to and from the drum cartridge 7 through the opening 5. In other words, the photosensitive drum 17 is located between the developing cartridge 8 and the fuser 33 in the attachable/detachable direction of the developing cartridge 8.

The developing cartridge 8 further includes an agitator 68. The agitator 68 is located inside the developing cartridge 8. The agitator 68 may stir the toner in the developing cartridge 8.

1.2.3 Waste Toner Container 29

The waste toner container 29 may accommodate the toner removed from the photosensitive drum 17. The waste toner container 29 is detachably attached to the drum cartridge 7.

1.3 Transfer Roller 18

The transfer roller 18 is arranged to contact the photosensitive drum 17. The transfer roller 18 may transfer a toner image carried on the photosensitive drum 17 to a sheet P.

1.4 Fuser 33

The fuser 33 is, when the process cartridge 3 is attached to the main body 2, located on an opposite side of the process cartridge 3 to the cover 6 with regard to the movable direction of the process cartridge 3. In other words, the process cartridge 3 is located between the fuser 33 and the cover 66 in the movable direction of the process cartridge 3. The fuser 33 may fix the toner image transferred onto the sheet P thereon.

2. Detailed Configuration of the Developing Cartridge 8

2.1 First Wall 28A and Second Wall 28B

Figure 2A:
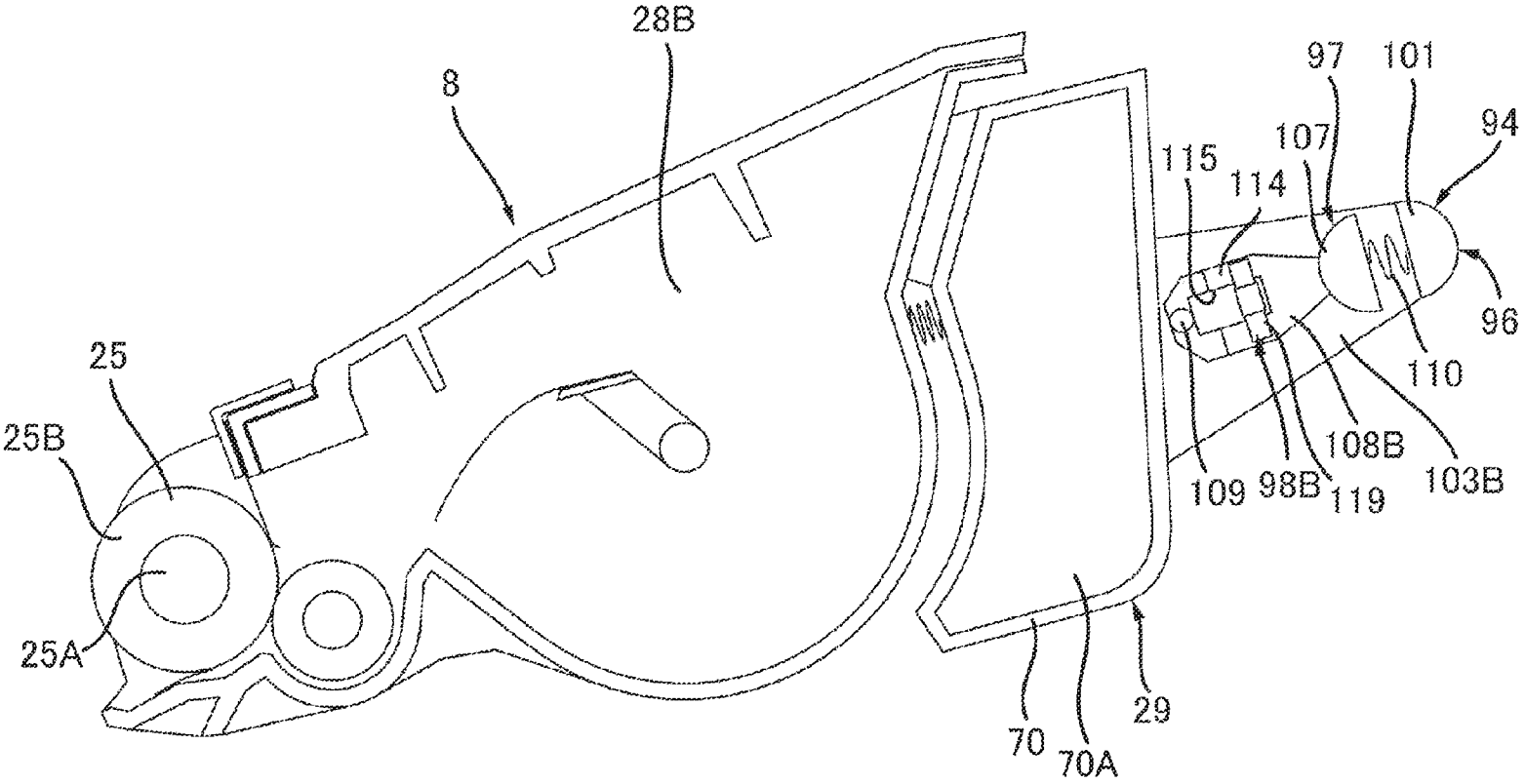
FIG. 2A is a cross-sectional view at a center of a developing cartridge and a waste toner container according to the first embodiment of the present disclosure.
Figure 2B:
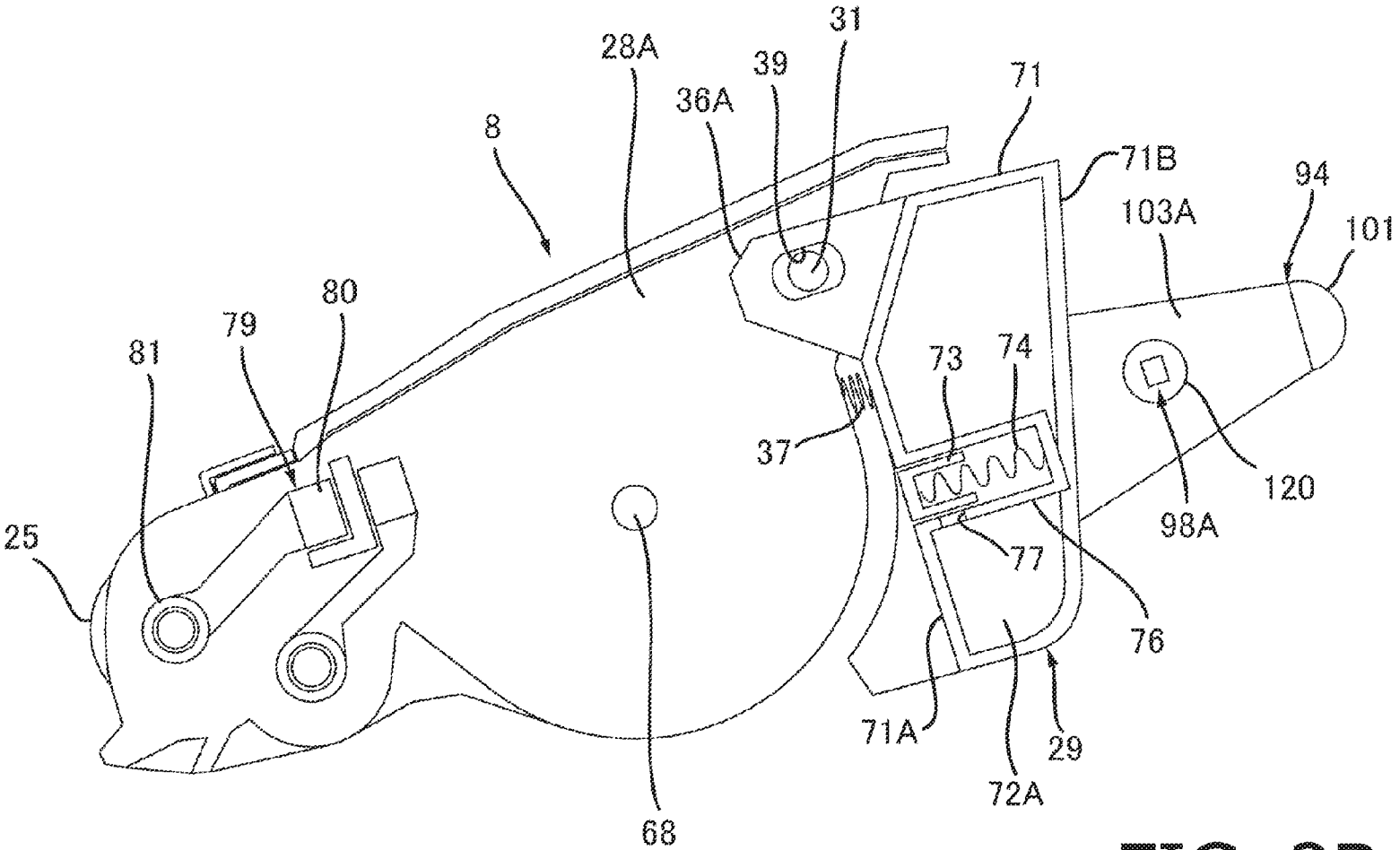
FIG. 2B is a sideward cross-sectional view of the developing cartridge and the waste toner container according to the first embodiment of the present disclosure.
Figure 3:
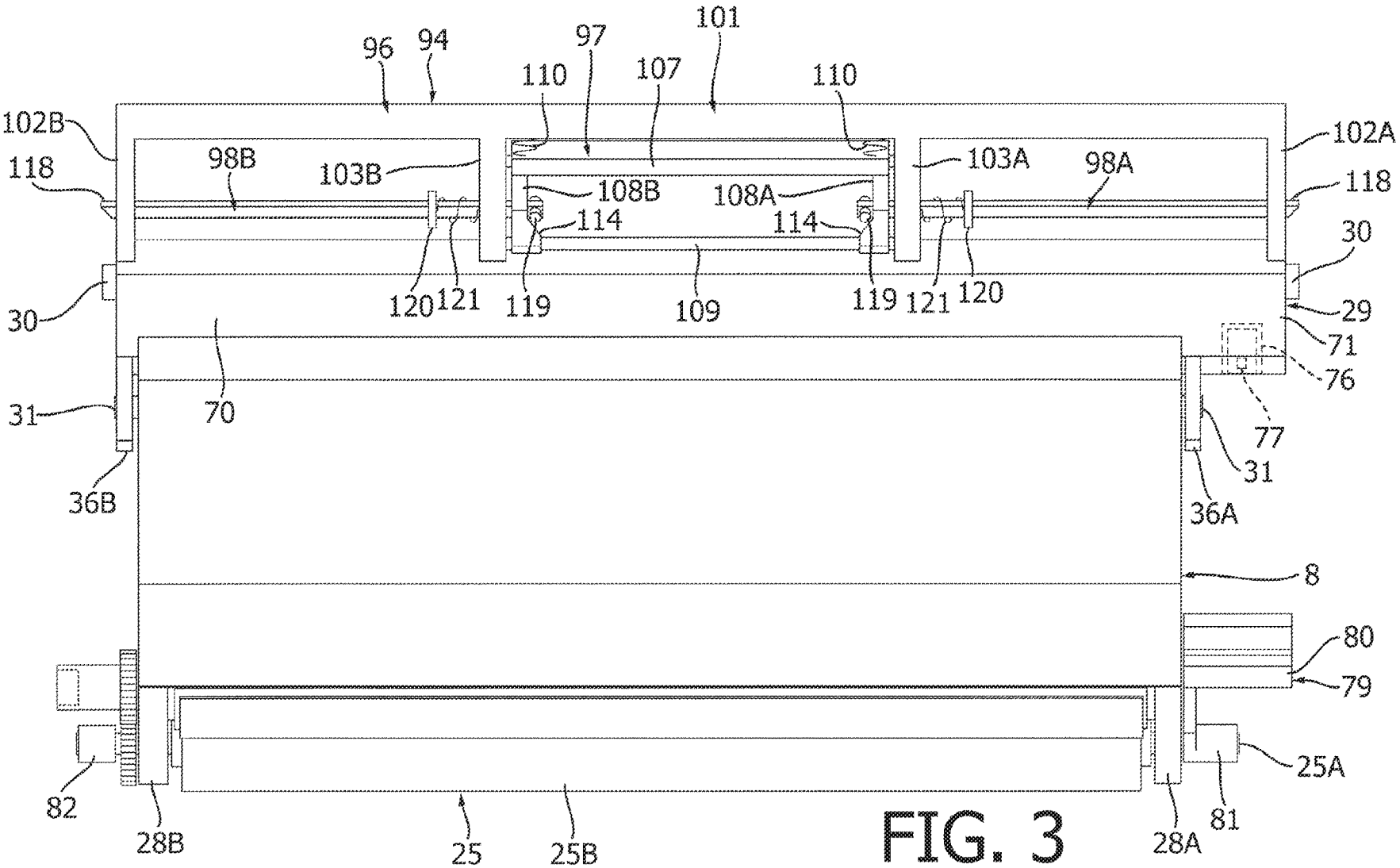
FIG. 3 is a plan view of the developing cartridge and the waste toner container according to the first embodiment of the present disclosure.

The developing cartridge 8 includes, as shown in FIGS. 2A-2B and 3, includes a first wall 28A and a second wall 28B.

The first wall 28A and the second wall 28B are spaced apart along the axial direction from each other. The first wall 28A is located at one end of the developing cartridge 8 with regard to the axial direction, and the second wall 28B is located at the other end of the developing cartridge 8 with regard to the axial direction. The second wall 28B is arranged to face the first wall 28A across a photosensitive drum layer 17C of the photosensitive drum 17, which will be described later, along the axial direction.

The first wall 28A includes a protrusion 31. The protrusion 31 is, as shown in FIG. 2B, located on an opposite side of the agitator 68 to the developer roller 25 with regard to the movable direction. In other words, the agitator 68 is located between the protrusion 31 and the developer roller 25 in the movable direction. The protrusion 31 protrudes, as shown in FIGS. 2A and 3, outward in a direction to be farther away from the second wall 28B along the axial direction.

The second wall 28B includes a protrusion 31, which is formed analogously to the protrusion 31 on the first wall 28A.

2.2 Developer Roller 25

The developer roller 25 is, as shown in FIGS. 2A and 3, arranged to longitudinally extend in the axial direction and is partly exposed outside the developing cartridge 8. The developer roller 25 includes a shaft 25A and a roller body 25B.

The shaft 25A longitudinally extends in the axial direction. The shaft 25A is a rod having a cylindrical shape. The shaft 25A is supported on the first wall 28A at one end thereof and on the second wall 28B at the other end thereof.

The roller body 25B is arranged on a circumference of the shaft 25A. The roller body 25B has a circumferential surface to carry the toner. The roller body 25B is rotatable along with the shaft 25A. The roller body 25B is located between the first wall 28A and the second wall 28B. The roller body 25B may be arranged to contact the circumferential surface of the photosensitive drum 17 to supply the toner to the photosensitive drum 17. Alternately, the roller body 25B may be arranged not to contact the circumferential surface of the photosensitive drum 17 so that the toner may be supplied to the photosensitive drum 17 by a jumping development method.

2.3 Electrode 79 and Bearing 82

The developing cartridge 8 further includes, as shown in FIGS. 2B and 3, an electrode 79 and a bearing 82.

The electrode 79 is located on an opposite side of the first wall 28A to the second wall 28B with regard to the axial direction. In other words, the first wall 28A is located between the electrode 79 and the second wall 28B in the axial direction. The electrode 79 includes an electric terminal 80 and a bearing 81.

The electric terminal 80 is arranged on the first wall 28A. The electric terminal 80 may receive electricity to be applied to the developer roller 25 from a power source of the image forming apparatus 1, which is not shown. The electric terminal 80 protrudes from the side of the first wall 28A outward in a direction opposite from the second wall 28B in the axial direction.

The bearing 81 is connected with the electric terminal 80. The bearing 81 is arranged to fit with one end of the shaft 25A with regard to the axial direction. The bearing 81 is located on an opposite side of the first wall 28A to the roller body 25B with regard to the axial direction. In other words, the first wall 28A is located between the bearing 81 and the roller body 25B in the axial direction.

The electric terminal 80 in the electrode 79 may be in contact with an electrode (not shown) in the image forming apparatus 1 so that electricity input to the electric terminal 80 may be applied to the developer roller 25 transmitted through the bearing 81.

The bearing 82 is arranged to fit with the other end of the shaft 25A with regard to the axial direction. The bearing 82 is located on an opposite side of the second wall 28B to the roller body 25B. In other words, the second wall 28B is located between the bearing 82 and the roller body 25B in the axial direction.

3. Detailed Configuration of the Waste Toner Container 29

3.1 Location of the Waste Toner Container 29

The waste toner container 29 is, as shown in FIG. 1, arranged alongside the developing cartridge 8 with regard to the movable direction. The waste toner container 29 is, when the developing cartridge 8 and the waste toner container 29 are attached to the drum cartridge 7, located on an opposite side of the developing cartridge 8 to the photosensitive drum 17 with regard to the movable direction. In other words, the developing cartridge 8 may be located between the waste toner container 29 and the photosensitive drum 17 in the movable direction. Further, the waste toner container 29 is located on an opposite side of the photosensitive drum 17 to the fuser 33 with regard to the movable direction. In other words, the photosensitive drum 17 may be located between the waste toner container 29 and the fuser 33 with regard to a direction orthogonal to the axial direction of the photosensitive drum 17.

The waste toner container 29 is movable with respect to the drum cartridge 7 in the movable direction of the process cartridge 3 to move with respect to the main body 2 to be attached to or detached from the drum cartridge 7. In other words, the waste toner container 29 is attachable to and detachable from the drum cartridge 7 in the direction orthogonal to the axial direction of the photosensitive drum 17.

3.2 Configuration of the Waste Toner Container 29

A capacity volume of the waste toner container 29 may be, for example, greater than or equal to 5% and smaller than or equal to 50%, or more preferably, greater than or equal to 10% and smaller than or equal to 30%, of a capacity volume of the developing cartridge 8. Thus, an approximate upper limit of the capacity volume of the waste toner container 29 may be determined based on the capacity volume of the developing cartridge 8.

The waste toner container 29 includes, as shown in FIGS. 2B and 3, a main part 70, a protrusive part 71, a shutter 73, a spring 74, an arm 36A, an arm 36B, and a spring 37.

3.2.1 Main Part 70

The main part 70 is arranged to coincide with the developing cartridge 8 along the movable direction. The main part 70 includes a protrusion 30. The main part 70 may provide an inner room 70A to store the waste toner.

The protrusion 30 protrudes outward from the main part 70 along the axial direction from the main part 70 outward in a direction opposite from the protrusive part 71.

3.2.2 Protrusive Part 71

Figure 8:
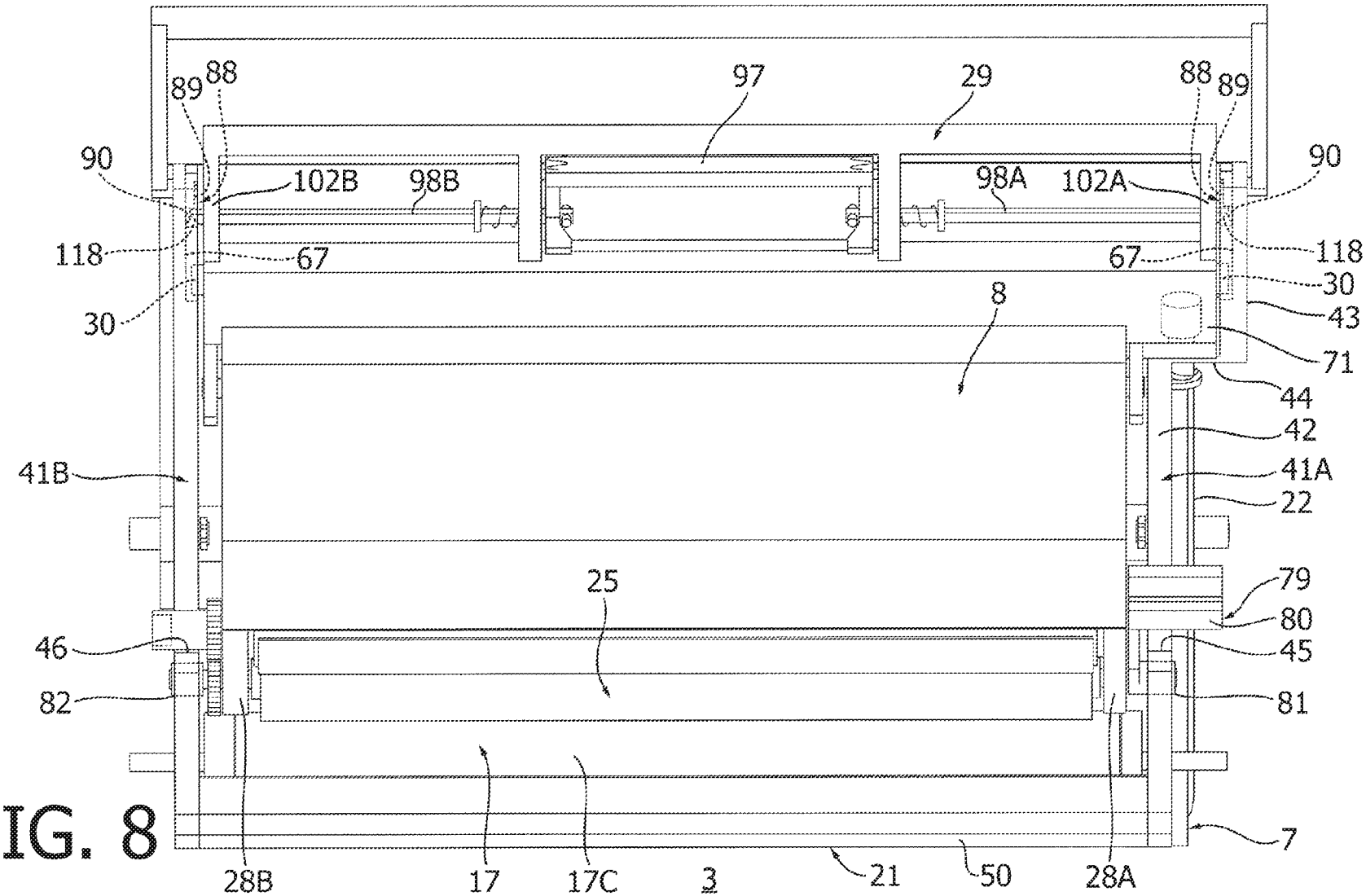
FIG. 8 is a plan view of the process cartridge according to the first embodiment of the present disclosure with a locking protrusion being in a first position.

The protrusive part 71 protrudes from the main part 70 outward with respect to the first wall 28A in the axial direction. The protrusive part 71 may provide an inner room 72A to store the waste toner. The protrusive part 71 is in communication with the main part 70. The protrusive part 71 is, as shown in FIG. 8, when the developing cartridge 8 and the waste toner container 29 are attached to the drum cartridge 7, located on an opposite side of the first wall 28A of the developing cartridge 8 to the photosensitive layer 17C of the photosensitive drum 17 with regard to the axial direction. In other words, the first wall 28A is located between the protrusive part 71 and the photosensitive layer 17C in the axial direction. The protrusive part 71, further, as shown in FIGS. 2B and 3, protrudes in the axial direction farther outward than the bearing 81 of the electrode 79. The protrusive part 71 includes a first surface 71A on one end of the protrusive part 71 with regard to the movable direction and a second surface 71B on the other end of the protrusive part 71 with regard to the movable direction. The first surface 71A is located closer than the second surface 71B to the developer roller 25. The protrusive part 71 includes a cylindrical inlet 76.

The cylindrical inlet 76 is formed to recede from the first surface 71A of the protrusive part 71 toward the second surface 71B along the movable direction. The cylindrical inlet 76 has a cylindrical form. The cylindrical inlet 76 has one end and the other end with regard to the movable direction. The one end of the cylindrical inlet 76 is open, and the other end of the cylindrical inlet 76 is closed. The cylindrical inlet 76 includes an inlet port 77.

The inlet port 77 is an opening, through which the toner may enter the waste toner container 29. The inlet port 77 is formed through a circumferential surface of the cylindrical inlet 76 to make a passage in an orthogonal direction, which is orthogonal to the movable direction. Preferably, the inlet port 77 may be formed at a bottom of the cylindrical inlet 76.

The protrusive part 71 includes a protrusion 30 analogously to the main part 70.

3.2.3 Shutter 73 and Spring 74

The shutter 73 is, as shown in FIG. 2B, located inside the cylindrical inlet 76. The shutter 73 is movable along the movable direction between a closure position (see FIG. 2B), in which the inlet port 77 is covered, and an open position (see FIG. 7), in which the inlet port 77 is uncovered.

The spring 74 is located between the shutter 73 and an inner surface on the other end of the cylindrical inlet 76. The spring 74 urges the shutter 73 in a direction from the other end toward the one end of the cylindrical inlet 76 to place the shutter 73 at the closure position at an ordinary state.

3.2.4 Arm 36A, Arm 36B, and Spring 37

The arm 36A and the arm 36B are, as shown in FIGS. 2B and 3, spaced apart along the axial direction from each other.

The arm 36A extends in the movable direction from the protrusive part 71 toward the developing cartridge 8. The arm 36A is located between the cylindrical inlet 76 and the first wall 28A in the axial direction. The arm 36A is arranged alongside the first wall 28A along the axial direction. The arm 36A includes a hole 39.

The hole 39 is formed through the arm 36A to make a passage in the axial direction to extend in the movable direction.

The arm 36B is located on an opposite side of the developing cartridge 8 to the arm 36A with regard to the axial direction. In other words, the developing cartridge 8 is located between the arm 36B and the arm 36A in the axial direction. The arm 36B is arranged alongside the second wall 28B along the axial direction. The arm 36B includes a hole 39, analogously to the arm 36A.

The protrusive part 31 in the first wall 28A is inserted in the hole 39 in the arm 36A, and the protrusive part 31 in the second wall 28B is inserted in the hole 39 in the arm 36B so that the holes 39 in the arms 36A, 36B may hold the protrusive parts 31 in the first wall 28A and the second wall 28B, respectively.

Thus, the waste toner container 29 is coupled to the developing cartridge 8 swingably about the protrusive parts 31 and slidably in the movable direction with respect to the developing cartridge 8.

Figure 6:
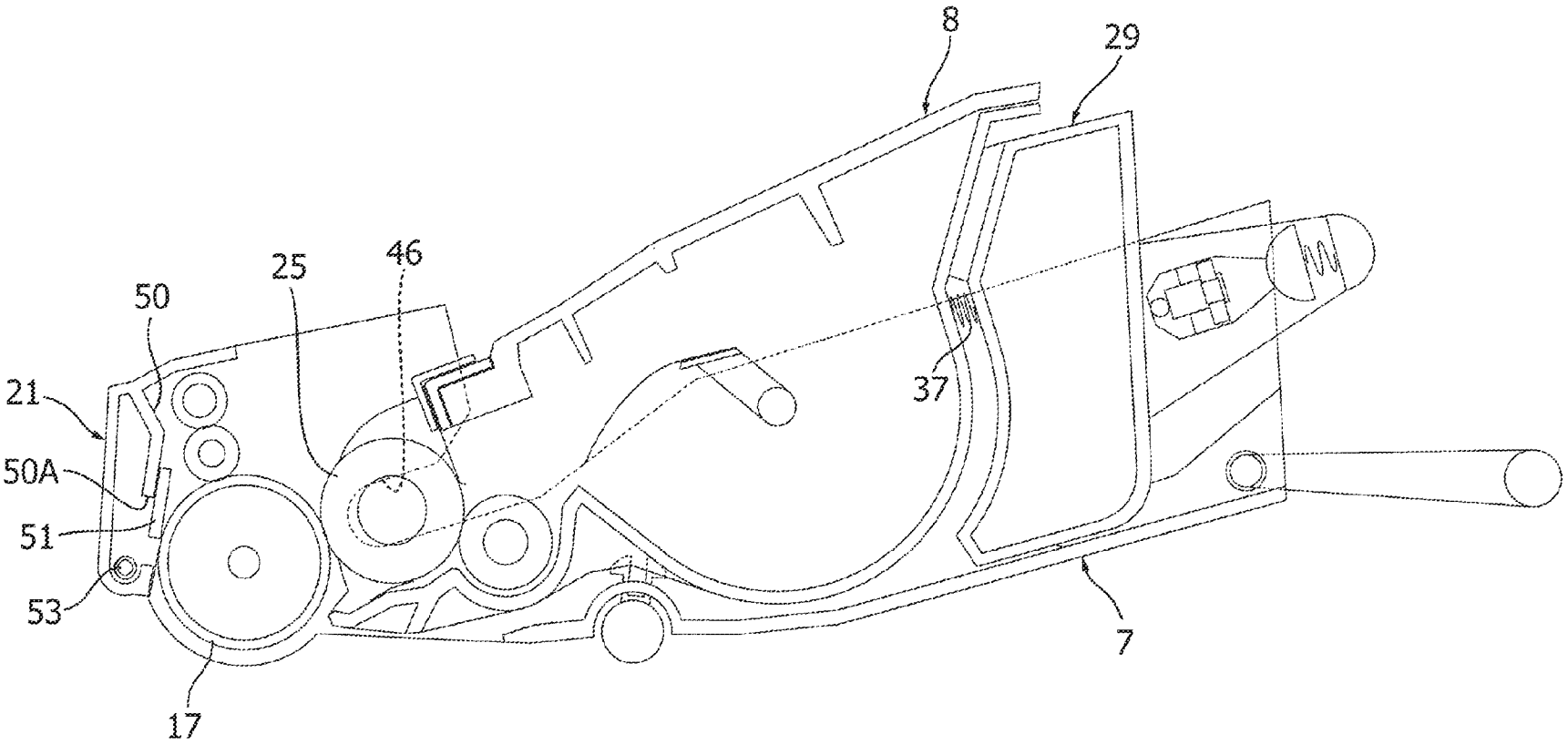
FIG. 6 is a cross-sectional view at a center of the process cartridge according to the first embodiment of the present disclosure.

The spring 37 is located between the main part 70 of the waste toner container 29 and the developing cartridge 8. The spring 37 may, as shown in FIG. 6, apply pressure to urge the developing cartridge 8 toward the photosensitive drum 17, when the developing cartridge 8 and the waste toner container 29 are attached to the drum cartridge 7. In other words, the spring 37 is expandable or contractive along a direction orienting from the developer roller 25 toward the photosensitive drum 17, when the developing cartridge 8 and the waste toner container 29 are attached to the drum cartridge 7. In this regard, the spring 37 may be replaced with any pressure-applier member that may urge the developing cartridge 8 toward the photosensitive drum 17.

4. Detailed Configuration of the Drum Cartridge 7

4.1 Lateral Walls 41A and 41B

The drum cartridge 7 includes, as shown in FIGS. 4 and 5, a lateral wall 41A and a lateral wall 41B.

The lateral walls 41A and 41B are spaced apart along the axial direction from each other. The lateral walls 41A, 41B each extends in the movable direction and spreads in a shape of a plate. The lateral wall 41A supports one end of the photosensitive drum 17 with regard to the axial direction, and the lateral wall 41B supports the other end of the photosensitive drum 17 with regard to the axial direction.

The lateral wall 41A includes a first developer guide 45.

The first developer guide 45 is located on an opposite side of the photosensitive drum 17 to a drum cleaner 51, which will be described later, with regard to the movable direction. In other words, the photosensitive drum 17 is located between the first developer guide 45 and the drum cleaner 51 in the movable direction. The first developer guide 45 extends in the movable direction. The first developer guide 45 is open in a direction toward a side opposite to the drum cleaner 51 across from the photosensitive drum 17.

The lateral wall 41B includes, as shown in FIGS. 5 and 6, a second developer guide 46.

The second developer guide 46 is formed analogously to the first developer guide 45.

Figure 7:
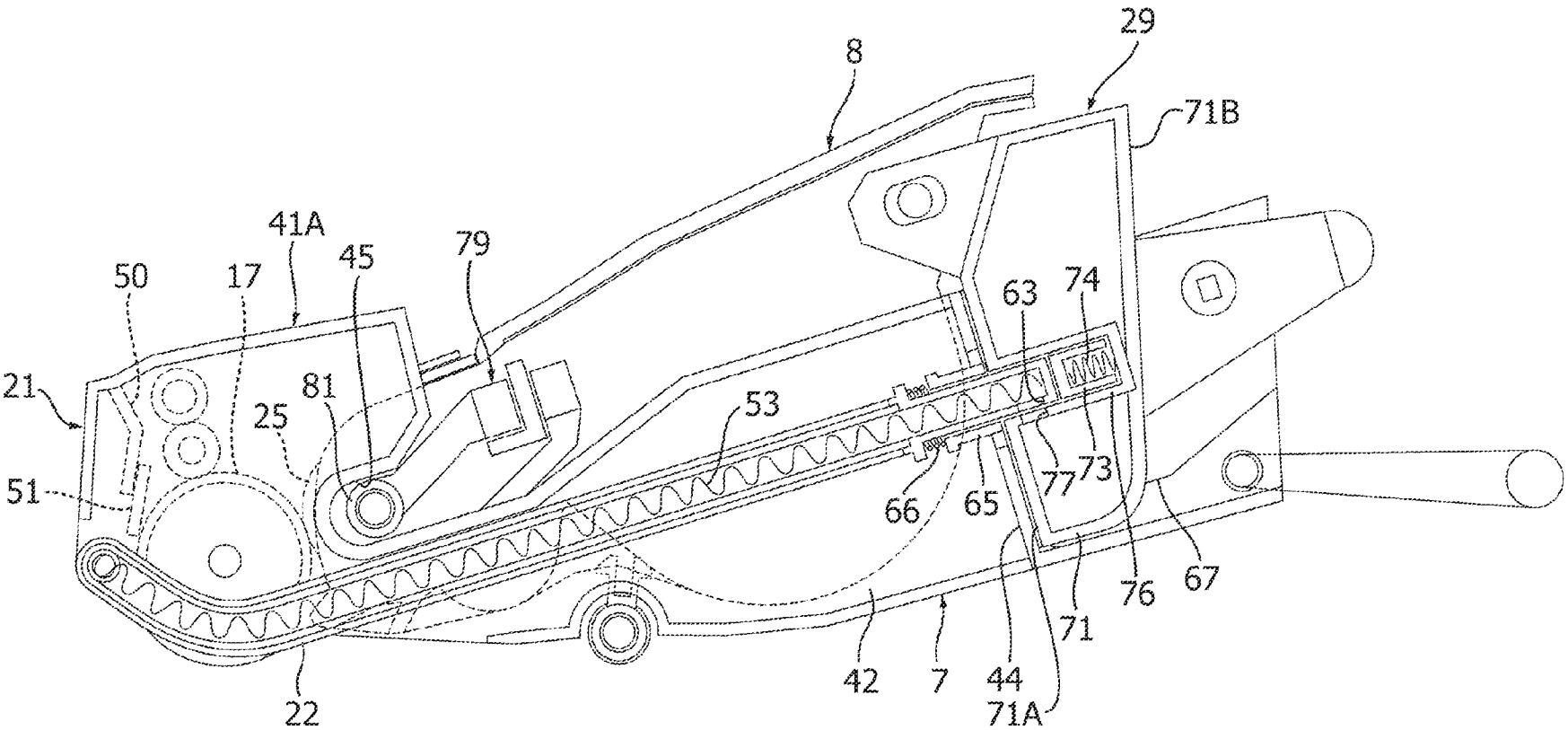
FIG. 7 is a sideward cross-sectional view of the process cartridge according to the first embodiment of the present disclosure.

The first developer guide 45 may, as shown in FIGS. 7 and 8, accept the bearing 81 of the electrode 79, when the developing cartridge 8 is attached to the drum cartridge 7. The first developer guide 45 may guide the developer roller 25 through the bearing 81 when the developing cartridge 8 is being attached to or detached from the drum cartridge 7.

The second developer guide 46 may, as shown in FIGS. 6 and 8, accept the bearing 82, when the developing cartridge 8 is attached to the drum cartridge 7. The second developer guide 46 may guide the developer roller 25 through the bearing 82 when the developing cartridge 8 is being attached to or detached from the drum cartridge 7.

4.2 Photosensitive Drum 17

The photosensitive drum 17 is, when the developing cartridge 8 is attached to the drum cartridge 7, located between the drum cleaner 51 and the developing cartridge 8 in the movable direction. The photosensitive drum 17 includes, as shown in FIGS. 4 and 5, a cylindrical part 17A and a drum shaft 17B.

The cylindrical part 17A longitudinally extends in the axial direction. The cylindrical part 17A is located between the lateral wall 41A and the lateral wall 41B in the axial direction. A circumferential surface of the cylindrical part 17A forms a photosensitive layer 17C, on which an electrostatic latent image may be formed.

The drum shaft 17B longitudinally extends in the axial direction. The drum shaft 17B includes one end and the other end with regard to the axial direction: the one end of the drum shaft 17B is rotatably supported by the lateral wall 41A, and the one end of the drum shaft 17B protrudes outward from the lateral wall 41A. The other end of the drum shaft 17B with regard to the axial direction is rotatably supported by the lateral wall 41B. The other end of the drum shaft 17B with regard to the axial direction protrudes outward from the lateral wall 41B.

4.3 Conveyer Roller 57 and Handle 58

The drum cartridge 7 further includes a conveyer roller 57 and a handle 58.

4.3.1 Conveyer Roller 57

The conveyer roller 57 may, as shown in FIG. 1, convey the sheet P to travel through a position between the conveyer roller 57 and a mating roller (unsigned) in the image forming apparatus 1 to a position between the photosensitive drum 17 and the transfer roller 18. The conveyer roller 57 is located on an opposite side of the photosensitive drum 17 to the fuser 33 with regard to the movable direction In other words, photosensitive drum 17 is located between the conveyer roller 57 and the fuser 33 in the movable direction. At the same time, the conveyer roller 57 is located at a position between the drum cleaner 51 and the waste toner container 29 in the movable direction. The conveyer roller 57 is, as shown in FIG. 5, arranged to longitudinally extend in the axial direction. The conveyer roller 57 includes one end and the other end with regard to the axial direction: the one end of the conveyer roller 57 is supported by the drum cartridge 7 through a supporting member 57A. The one end of the conveyer roller 57 with regard to the axial direction protrudes outward from the lateral wall 41A. The other end of the conveyer roller 57 with regard to the axial direction is supported by the drum cartridge 7 through a supporting member 57B. The other end of the conveyer roller 57 protrudes outward from the lateral wall 41B.

4.3.2 Handle 58

The handle 58 is located on an opposite side of the conveyer roller 57 to the photosensitive drum 17 with regard to the movable direction. In other words, the conveyer roller 57 is located between the handle 58 and the photosensitive drum 17 in the movable direction. The handle 58 is supported by the lateral walls 41A, 41B rotatably to rotate with respect to the lateral walls 41A, 41B.

5. Configuration to Convey Toner 5.1 Cleaner Frame 50 and Drum Cleaner 51

The drum cartridge 7 includes, as shown in FIGS. 5 and 6, a cleaner frame 50 and the drum cleaner 51.

The drum cleaner 51 is arranged to contact the photosensitive drum 17 to remove the toner from the circumferential surface of the photosensitive drum 17. The drum cleaner 51 is, when the developing cartridge 8 is attached to the drum cartridge 7, as shown in FIG. 6, located on an opposite side of the photosensitive drum 17 to the developing cartridge 8 with regard to the movable direction. In other words, the photosensitive drum 17 is located between the drum cleaner 51 and the developing cartridge 8 in the movable direction.

The cleaner frame 50 may include a casing to accommodate the drum cleaner 51 therein. The cleaner frame 50 longitudinally extends in the axial direction and has a hollow cylindrical shape. The cleaner frame 50 includes one end and the other end with regard to the axial direction: the one end of the cleaner frame 50 is coupled to the lateral wall 41A, and the other end of the cleaner frame 50 is coupled to the lateral wall 41B. The cleaner frame 50 includes, as shown in FIG. 6, an opening 50A.

The opening 50A is formed at a position to coincide with the photosensitive drum 17 in the movable direction. The opening 50A is formed to longitudinally extend in the axial direction. The opening 50A is formed through the cleaner frame 50 to make a passage in the movable direction.

The drum cleaner 51 has a shape of a plate and may include a scraper blade. The drum cleaner 51 is fixed to an edge of the opening 50A. The drum cleaner 51 is arranged to contact the circumferential surface of the photosensitive drum 17 at a position downstream from the position, where the photosensitive drum 17 contacts the transfer roller 18, with regard to a rotating direction. The drum cleaner 51 may not necessarily be limited to the plate-shaped scraper blade but may include other cleaner devices, such as a cleaner roller and a cleaner blush, as long as the cleaner device may remove the toner from the circumference of the photosensitive drum 17.

The drum cleaner 51 may scrape the circumferential surface of the photosensitive drum 17 to remove the toner, which remains thereon without being transferred to the sheet P, from the photosensitive drum 17. The toner scraped off from the photosensitive drum 17 may fall through the opening 50A to be caught in the cleaner frame 50. The toner caught in the cleaner frame 50 may be conveyed through a waste toner conveyer tube 22 toward the waste toner container 29 by rotation of a conveyer 53, which will be described below.

5.2 Third Wall 42, Fourth Wall 43, and Fifth Wall 44

The lateral wall 41A includes, as shown in FIG. 5, a third wall 42, a fourth wall 43, and a fifth wall 44.

The third wall 42 is, as shown in FIG. 8, located on an opposite side of the first wall 28A of the developing cartridge 8 to the second wall 28B with regard to the axial direction, when the developing cartridge 8 is attached to the drum cartridge 7. In other words, the first wall 28A is located between the third wall 42 and the second wall 28B in the axial direction. The third wall 42 extends longitudinally in the movable direction. The third wall 42 includes one end and the other end with regard to the movable direction: the one end of the third wall 42 is located closer to the photosensitive drum 17, and the other end of the third wall 42 opposite to the one end is farther from the photosensitive drum 17.

The fourth wall 43 is located on an opposite side of the third wall 42 to the first wall 28A of the developing cartridge 8 with regard to the axial direction, when the developing cartridge 8 and the waste toner container 29 are attached to the drum cartridge 7. In other words, the third wall 42 is located between the fourth wall 43 and the first wall 28A in the axial direction. The fourth wall 43 is arranged alongside the waste toner container 29 along the axial direction. The fourth wall 43 includes one end and the other end with regard to the movable direction: the one end of the fourth wall 43 is located closer to the photosensitive drum 17, and the other end of the fourth wall 43 opposite to the one end is farther from the photosensitive drum 17.

The fifth wall 44 connects the other end of the third wall 42 farther from the photosensitive drum 17 with the one end of the fourth wall 43 closer to the photosensitive drum 17. The fifth wall 44 longitudinally extends in the axial direction. The fifth wall 44 is arranged to face the protrusive part 71 of the waste toner container 29 along the movable direction when the developing cartridge 8 and the waste toner container 29 are attached to the drum cartridge 7. The fifth wall 44 may locate the waste toner container 29 in a predetermined position with respect to the drum cartridge 7. The fifth wall 44 includes, as shown in FIGS. 5 and 7, a hole 44A.

The hole 44A is formed through the fifth wall 44 to make a passage in the movable direction.

5.3 Waste Toner Conveyer Tube 22, Conveyer 53, Shutter 65, and Spring 66

The drum cartridge 7 further includes, as shown in FIGS. 4 and 5, the waste toner conveyer tube 22, the conveyer 53, a shutter 65, and a spring 66.

5.3.1 Waste Toner Conveyer Tube 22

The waste toner conveyer tube 22 may convey the waste toner removed by the drum cleaner 51 from the photosensitive drum 17. The waste toner conveyer tube 22 may connect, as shown in FIGS. 7 and 8, when the developing cartridge 8 and the waste toner container 29 are attached to the drum cartridge 7, the cleaner frame 50 with the waste toner container 29. The waste toner conveyer tube 22 longitudinally extends in the attachable/detachable direction of the developing cartridge 8 and the waste toner container 29 to be attached to or detached from the drum cartridge 7.

The waste toner conveyer tube 22 is, when the developing cartridge 8 is attached to the drum cartridge 7, located on an opposite side of the first wall 28A of the developing cartridge 8 to the second wall 28B with regard to the axial direction. In other words, the first wall 28A is located between the waste toner conveyer tube 22 and the second wall 28B in the axial direction.

The toner removed from the circumferential surface of the photosensitive drum 17 may be conveyed inside the waste toner conveyer tube 22. The waste toner conveyer tube 22 has, as shown in FIGS. 4 and 5, a cylindrical shape. The waste toner conveyer tube 22 longitudinally extends in the movable direction from the cleaner frame 50 to the fifth wall 44 in the lateral wall 41A. Specifically, the waste toner conveyer tube 22 includes a first end portion 22A and a second end portion 22B. Further, the waste toner conveyer tube 22 includes a ring portion 64 and an outlet port 63.

The first end portion 22A is on one end of the waste toner conveyer tube 22 closer to the photosensitive drum 17 with regard to the movable direction. The first end portion 22A is connected to the lateral wall 41A to make a passage to the cleaner frame 50.

The second end portion 22B is on the other end of the waste toner conveyer tube 22 opposite to the first end portion 22A with regard to the movable direction. The second end portion 22B is inserted in the hole 44A formed in the fifth wall 44. The second end portion 22B protrudes from the fifth wall 44 in a direction to be farther away from the photosensitive drum 17.

The ring portion 64 is located at a position closer than the fifth wall 44 to the photosensitive drum 17 with regard to the movable direction. The ring portion 64 expands in a radial direction of the waste toner conveyer tube 22 to form a ring shape and protrude outward from a circumferential surface of the waste toner conveyer tube 22.

The outlet port 63 is located farther than the fifth wall 44 from the photosensitive drum 17 with regard to the movable direction. The outlet port 63 is formed through the circumferential surface of the waste toner conveyer tube 22. Preferably, the outlet port 63 may be formed at a bottom of the waste toner conveyer tube 22 to make a passage at the bottom. The toner may be discharged out of the waste toner conveyer tube 22 through the outlet port 63.

The waste toner conveyer tube 22 is arranged to fit in the cylindrical inlet 76 in the protrusive part 71 along the movable direction when the developing cartridge 8 and the waste toner container 29 are attached to the drum cartridge 7, as shown in FIGS. 7 and 8. Thus, the waste toner conveyer tube 22 is connected with the protrusive part 71 of the waste toner container 29. Meanwhile, when the developing cartridge 8 and the waste toner container 29 are attached to the drum cartridge 7, the outlet port 63 in the waste toner conveyer tube 22 and the inlet port 77 in the cylindrical inlet 76 may face each other. Thus, the outlet port 63 of the waste toner conveyer tube 22 is connected with the inlet port 77 of the cylindrical inlet 76 to make a passage.

Meanwhile, when the developing cartridge 8 is attached to the drum cartridge 7, the waste toner conveyer tube 22 is located closer to the lateral wall 41A with regard to the axial direction than one end of the electric terminal 80 of the electrode 79 farther from the lateral wall 41A. In other words, the one end of the electric terminal 80 of the electrode 79 is farther from the lateral wall 41A than the waste toner conveyer tube 22 with regard to the axial direction, or, the electric terminal 80 protrudes farther outward than the waste toner conveyer tube 22 with regard to the axial direction.

Further, when the developing cartridge 8 is attached to the drum cartridge 7, the waste toner conveyer tube 22 is located closer to the lateral wall 41A with regard to the axial direction than one end of the drum shaft 17B that is farther from the lateral wall 41A. In other words, the drum shaft 17B protrudes farther outward than the waste toner conveyer tube 22 with regard to the axial direction.

Meanwhile, as shown in FIG. 4, the waste toner conveyer tube 22 is located between the conveyer roller 57 and the first developer guide 45. In other words, the waste toner conveyer tube 22 is located at an upper position with respect to the conveyer roller 57.

The waste toner conveyer tube 22 is, when the developing cartridge 8 is attached to the drum cartridge 7, located closer to the lateral wall 41A than the one end of the electric terminal 80 that is farther from the lateral wall 41A. In other words, when the developing cartridge 8 is attached to the drum cartridge 7, the lateral wall 41A and the waste toner conveyer tube 22 are located between the first wall 28A and the one end of the electric terminal 80 in the axial direction; and the waste toner conveyer tube 22 is located between a part of the electric terminal 80, in particular, at least the one end of the electric terminal 80, and the first wall 28A in the axial direction.

The form of the waste toner conveyer tube 22 may not necessarily be limited to the cylindrical shape but may include, for example, tubes with cross-sectional shapes of a rectangle, square, and an oval.

5.3.2 Conveyer 53

The conveyer 53 extends, as shown in FIGS. 4 and 5, in the axial direction inside the cleaner frame 50 and in the movable direction inside the waste toner conveyer tube 22. The conveyer 53 may be in a spiral form. One end of the conveyer 53 is rotatably supported by the latera wall 41B of the cleaner frame 50 through a conveyer gear 53A. The conveyer 53 in the spiral form may rotate to convey the toner in the cleaner frame 50 and the waste toner conveyer tube 22 toward the second end portion 22B of the conveyer tube 22. The other end of the conveyer 53 opposite to the one end is rotatably supported by the second end portion 22B of the waste toner conveyer tube 22. The other end of the conveyer 53 is arranged to adjoin and face the outlet port 63.

The conveyer 53 may be rotated by a driving force from a driving power source, which is not shown, in the image forming apparatus 1 transmitted through the conveyer gear 53A.

5.3.3 Shutter 65 and Spring 66

The shutter 65 is arranged to cover a circumference of the second end portion 22B of the waste toner conveyer tube 22. The shutter 65 has a tubular shape and is movable on the waste toner conveyer tube 22 between a closure position (see FIG. 4), in which the outlet port 63 is closed, and an open position (see FIG. 7), which is closer than the closure position to the ring portion 64 and in which the outlet port 63 is uncovered.

The spring 66 is located between the shutter 65 and the ring portion 64. The spring 66 is arranged to contact the shutter 65 at one end and the ring portion 64 at the other end. The spring 66 tends to urge the shutter 65 toward the closure position at an ordinary state.

5.3.4 Guide Groove 67

The lateral wall 41A includes a guide groove 67.

The guide groove 67 is formed in the fourth wall 43 in the lateral wall 41A. The guide groove 67 is formed on a surface of the fourth wall 43 on a side opposite to the lateral wall 41B with regard to the axial direction. The guide groove 67 is open in an opposite direction to the drum cleaner 51 across from the photosensitive drum 17 with regard to the movable direction. A length of the guide groove 67 in the movable direction is larger than a protrusive length of the waste toner conveyer tube 22 that protrudes from the hole 44A of the fifth wall 44.

The lateral wall 41B includes a guide groove 67 analogously to the lateral wall 41A.

6. Configuration to Lock and Unlock the Waste Toner Container 29 to and from the Drum Cartridge 7

6.1 Groove 88

The lateral wall 41B of the drum cartridge 7 includes a groove 88.

The lateral wall 41B includes one end with regard to the movable direction, at which the lateral wall 41B supports the photosensitive drum 17, and the other end, which is opposite to the one end with regard to the movable direction and farther from the photosensitive drum 17. The groove 88 is located on the other end of the lateral wall 41B. The groove 88 is located at an upper position with respect to the guide groove 67 with regard to the vertical direction. The groove 88 includes a guide portion 89 and a hole 90. In the hole 90, a protrusion 118 in a rod 98B of a gripper 94, which will be described later in detail, may be inserted.

The guide portion 89 is formed to recess in the axial direction to be farther away from the lateral wall 41A and longitudinally extends in the movable direction. The guide portion 89 includes one end with regard to the movable direction closer to the photosensitive drum 17 and the other end opposite to the one end farther from the photosensitive drum 17. The other end of the guide portion 89 is open in the movable direction.

The hole 90 is located on the one end of the groove 88 closer to the photosensitive drum 17. The groove 90 is formed to recess in the axial direction to be farther away from the lateral wall 40A and even farther in the axial direction than the guide portion 89 from the lateral wall 41A.

Meanwhile, the fourth wall 43 in the lateral wall 41A includes the groove 88 analogously to the lateral wall 41B.

6.2 Gripper 94

The waste toner container 29 further includes, as shown in FIGS. 2A and 3, the gripper 94, which may be gripped by a user.

The gripper 94 is located on an opposite side of the main part 70 of the waste toner container 29 to the developing cartridge 8 with regard to the movable direction. In other words, the main part 70 is located between the gripper 94 and the developing cartridge 8 in the movable direction. The gripper 94 includes a fixed part 96, a switcher part 97, a rod 98A, and the rod 98B.

The fixed part 96 includes a first grip 101, an outer wall 102A, an outer wall 102B, an inner wall 103A, and an inner wall 103B.

The first grip 101 is located on an opposite side of the main part 70 to the developing cartridge 8. In other words, the main part 70 is located between the first grip 101 and the developing cartridge 8. The first grip 101 longitudinally extends in the axial direction and may have a semicircular cross-sectional shape.

The outer walls 102A, 102B are spaced apart along the axial direction from each other. The outer wall 102A connects the first grip 101 with the protrusive part 71 in the movable direction as shown in FIG. 3. The outer wall 102B connects the first grip 101 with the main part 70 in the movable direction.

The inner walls 103A, 103B are located at positions between the outer wall 102A and the outer wall 102B in the axial direction. The inner walls 103A, 103B are spaced apart along the axial direction from each other. The inner wall 103 connects the first grip 101 with the main part 70 in the movable direction. The inner wall 103B connects the first grip 101 with the main part 70 in the movable direction.

The switcher part 97 is located at a position between the inner wall 103A and the inner wall 103B in the axial direction and between the main part 70 and the first grip 101 in the movable direction. The switcher part 97 is movably supported by the inner walls 103A, 103B in the fixed part 96 to be movable in the movable direction. The switcher part 97 includes a second grip 107, a wall 108A, a wall 108B, a connector 109, and springs 110. A quantity of the springs 110 may be, for example, two (2).

The second grip 107 is located between the main part 70 and the first grip 101 in the movable direction. The second grip 107 longitudinally extends in the axial direction. The second grip 107 may have a semicircular cross-sectional shape. The second grip 107 includes one end with regard to the axial direction closer to the inner wall 103A and the other end opposite to the one end closer to the inner wall 103B.

The wall 108B extends in the movable direction from the other end of the second grip 107 toward the main part 70. The wall 108B includes one end with regard to the movable direction, which is continuous with the second grip 107, and the other end opposite to the one end closer to the main part 70. The wall 108B includes, as shown in FIGS. 2A and 3, an oblique portion 114 and a hole 115.

The oblique portion 114 is located on the other end of the wall 108B. The oblique portion 114 protrudes in the axial direction from the wall 108B toward the wall 108A. The oblique portion 114 inclines to be closer to the main part 70 as the oblique portion 114 extends closer to the wall 108A. The oblique portion 114 includes one end with regard to the movable direction closer to the second grip 107 and the other end opposite to the one end closer to the connector 109.

The hole 115 is located on the other end of the wall 108B. The hole 115 is formed through the wall 108B to make a passage in the axial direction. The hole 115 longitudinally extends in the movable direction. The hole 115 coincides with the oblique portion 114. In other words, the hole 115 is formed in the oblique portion 114.

The wall 108A extends in the movable direction from the one end of the second grip 107 toward the main part 70. The wall 108A includes, analogously to the wall 108B, an oblique portion 114 and a hole 115. A distance between one end of the oblique portion 114 in the wall 108A and one end of the oblique portion 114 in the wall 108B in the axial direction is larger than a distance between the other end of the oblique portion 114 in the wall 108A and the other end of the oblique portion 114 in the wall 108B.

The connector 109 connects the other end of the wall 108A with the other end of the wall 108B. The connector 109 longitudinally extends in the axial direction.

The springs 110 are located between the second grip 107 in the switcher part 97 and the first grip 101 in the fixed part 96. The springs 110 are spaced apart along the axial direction from each other. The springs 110 may be coil springs that may extend in the movable direction. One end of each spring 110 contacts the first grip 101, and the other end of each spring 110 contacts the second grip 107. The springs 110 tend to urge the switcher part 97 toward the main part 70 to be separated away from the first grip 101 at an ordinary state.

The rod 98A is, as shown in FIG. 3, supported by the outer wall 102A and the inner wall 103A to be movable in the axial direction with respect to the outer wall 102A and the inner wall 103A. The rod 98A extends longitudinally in the axial direction and is arranged to penetrate the outer wall 102A and the inner wall 103A. The rod 98A includes one end with regard to the axial direction closer to the outer wall 102A and the other end opposite to the one end closer to the inner wall 103A. The rod 98A includes a protrusion 118, a boss 119, a ring portion 120, and a spring 121.

Figure 9:
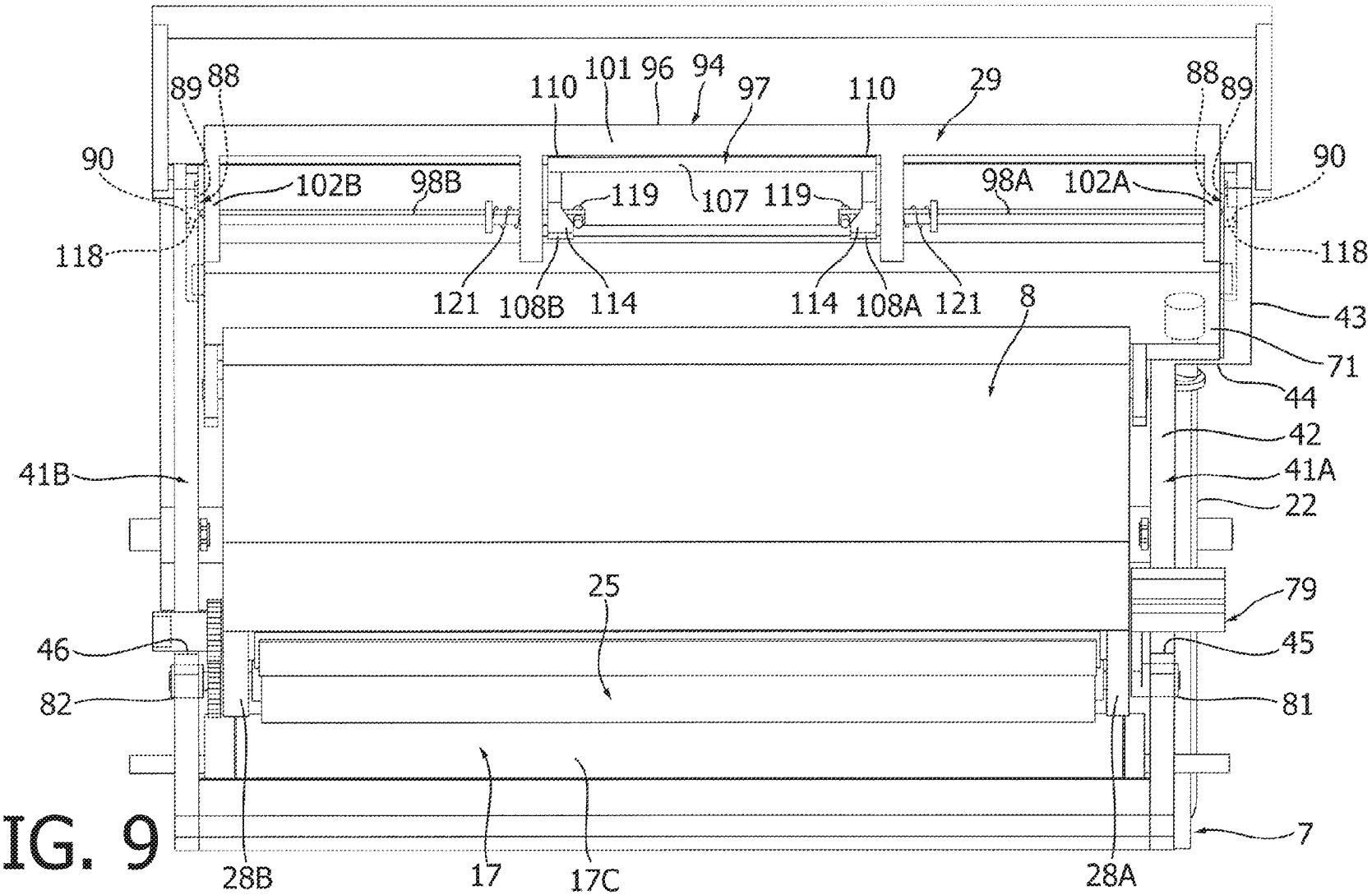
FIG. 9 is a plan view of the process cartridge according to the first embodiment of the present disclosure with the locking protrusion being in a second position.

The protrusion 118 is located on the one end of the rod 98A. An edge of the protrusion 118 is formed obliquely to be closer to the main part 70 as the edge extends in a direction from the one end toward the other end of the rod 98A. The protrusion 118 is, as shown in FIGS. 8 and 9, when the developing cartridge 8 and the waste toner container 29 are attached to the drum cartridge 7, movable between a first position (see FIG. 8) and a second position (see FIG. 9).

The first position of the protrusion 118 is, as shown in FIG. 8, a position where the protrusion 118 protrudes toward the fourth wall 43 and to be accommodated in the hole 90 so that the waste toner container 29 is locked to the drum cartridge 7. The second position of the protrusion 118 is, as shown in FIG. 9, a position where the protrusion 118 is out of the hole 90 so that the waste toner container 29 is released from the drum cartridge 7.

The boss 119 is, as shown in FIG. 3, located on the other end of the rod 98A. The boss 119 longitudinally extends in a direction to intersect with the movable direction and with the axial direction. An extending length of the boss 119 is larger than a length of the hole 115 in the movable direction.

The ring portion 120 is, as shown in FIG. 3, located between the outer wall 102A and the inner wall 103A in the axial direction. The ring portion 120 protrudes outward from a circumferential surface of the rod 98A.

The spring 121 is located between the ring portion 120 and the inner wall 103A. The spring 121 may be a coil spring, which longitudinally extends in the axial direction. The spring 121 contacts the ring portion 120 at one end thereof and the inner wall 103A at the other end thereof with regard to the axial direction. The spring 121 tends to urge the rod 98A along the axial direction in a direction from the other end toward the one end so that the protrusion 118 may be located at the first position at an ordinary state.

The rod 98B is supported by the outer wall 102B and the inner wall 103B to be movable in the axial direction with respect to the outer wall 102B and the inner wall 103B. The rod 98B is in an analogous structure as the rod 98A.

The protrusion 118 in the rod 98B is spaced apart along the axial direction from the protrusion 118 in the rod 98A.

7. Attaching and Detaching Actions

Next, with reference to FIGS. 7 and 8, actions to attach and detach the developing cartridge 8 and the waste toner container 29 to and from the drum cartridge 7 will be described.

In order to attach the developing cartridge 8 and the waste toner container 29 to the drum cartridge 7, the user may push the developing cartridge 8 and the waste toner container 29 against the drum cartridge 7.

As the developing cartridge 8 is pushed, the bearing 81 of the electrode 79 in the developing cartridge 8 may be guided in the first developer guide 45 in the drum cartridge 7, and the bearing 82 in the developing cartridge 8 may be guided in the second developer guide 46 in the drum cartridge 7.

Thus, the developing cartridge 8 may approach the photosensitive drum 17.

Meanwhile, in the waste toner container 29, as shown in FIG. 8, the protrusion 30 in the protrusive part 71 may be guided in the guide groove 67 in the fourth wall 43. Simultaneously, the protrusion 30 in the main part 70 may be guided in the guide groove 67 in the lateral wall 41B.

Accordingly, the protrusion 118 in the rod 98A may be guided in the groove 88 in the fourth wall 43 of the lateral wall 41A. The protrusion 118 in the rod 98A may enter the hole 90 in the groove 88 and may be located at the first position. Analogously, the protrusion 118 in the rod 98B may be guided in the groove 88 in the lateral wall 41B and enter the hole 90 in the groove 88 to be located at the first position.

Thus, the waste toner container 29 may be locked to the drum cartridge 7.

In this regard, the other end of the waste toner conveyer tube 22 is, as shown in FIG. 7, allowed to enter the cylindrical inlet 76 in the protrusive part 71. While the protrusive length of the second end portion 22B of the waste toner conveyer tube 22 from the fifth wall 44 is smaller than the length of the guide groove 67, the second end portion 22B of the waste toner conveyer tube 22 may be guided in the cylindrical inlet 76 smoothly.

Meanwhile the shutter 73 in the developing cartridge 8 may contact the waste toner conveyer tube 22, and the shutter 65 in the drum cartridge 7 may contact the protrusive part 71. When the waste toner container 29 is pushed further, the shutter 73 may be placed to the open position against the urging force of the spring 74, and the shutter 65 may be placed in the open position against the urging force of the spring 66.

Thereby, the outlet port 63 of the waste toner conveyer tube 22 and the inlet port 77 of the cylindrical inlet 76 may face each other, and the outlet port 63 of the waste toner conveyer tube 22 and the inlet port 77 of the cylindrical inlet 76 are connected to make a passage.

Thus, attachment of the developing cartridge 8 to the drum cartridge 7 may be completed.

While the waste toner container 29 is locked to the drum cartridge 7, as shown in FIG. 6, with the spring 37 being located between the waste toner container 29 and the developing cartridge 8, the waste toner container 29 may urge the developing cartridge 8 against the photosensitive drum 17.

In order to detach the developing cartridge 8 from the drum cartridge 7, the user may grab the first grip 101 and the second grip 107 simultaneously (see FIG. 9).

The user grabbing the first grip 101 and the second grip 107 may move the second grip 107 in the switcher part 97 closer to the first grip 101 in the fixed part 96 against the urging force of the springs 110.

Accordingly, the boss 119 in the rod 98A may climb on the oblique portion 114 in the wall 108A. Thereby, the rod 98A may move along the axial direction in a direction to be away from the fourth wall 43 in the lateral wall 41A against the urging force of the spring 121. Meanwhile, the boss 119 in the rod 98B may climb on the oblique portion 114 in the wall 108B. Thereby, the rod 98B may move along the axial direction in a direction to be away from the lateral wall 41B against the urging force of the spring 121.

Thereby, the protrusions 118 in the rods 98A, 98B may exit the holes 90.

Accordingly, the protrusions 118 may move from the first position to the second position.

Thus, the switcher part 97 may switch the positions of the rods 98A, 98B between the first position and the second position.

Figure 11:
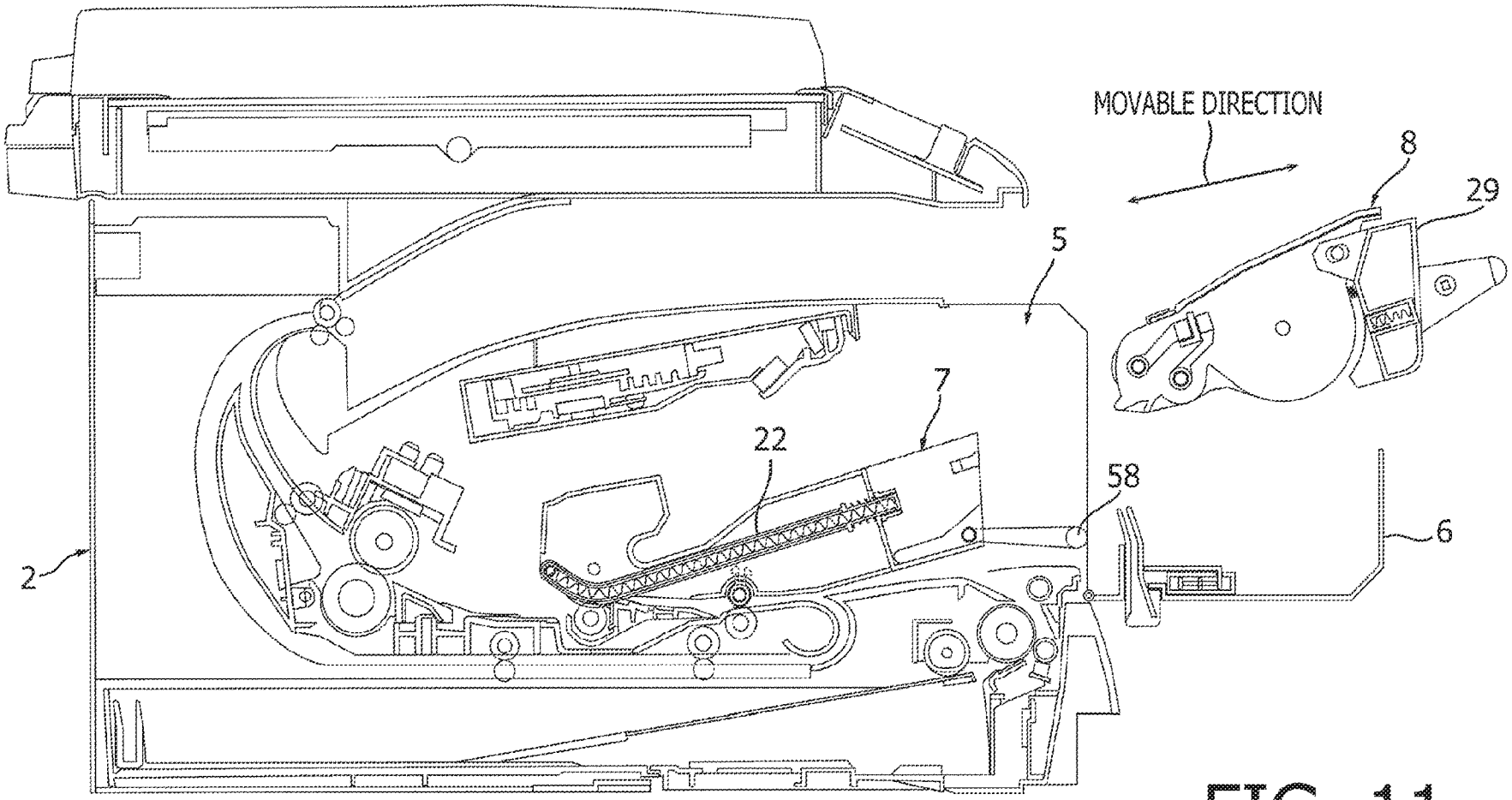
FIG. 11 is a cross-sectional view of the image forming apparatus to illustrate attachment and detachment of the developing cartridge to and from the drum cartridge according to the first embodiment of the present disclosure.

Meanwhile, the user may draw the developing cartridge 8 and the waste toner container 29 out of the drum cartridge 7, as shown in FIG. 11.

The developing cartridge 8 and the waste toner container 29 may thus be removed from the drum cartridge 7.

While the waste toner container 29 is detached from the waste toner conveyer tube 22, the shutter 65 is placed by the urging force of the spring 66 in the closure position to close the outlet port 63.

Further, the shutter 73 is, as shown in FIG. 2B, placed in the closure position by the urging force of the spring 74 to close the inlet port 77.

Meanwhile, in order to attach the process cartridge 3 to the main body 2, the user may place the cover 6 in the open position to expose the opening 5.

Thereafter, the user may attach the process cartridge 3 through the opening 5 to the main body 2.

Further, the user may place the cover 6 in the closure position, as shown in FIG. 1.

Thus, the image forming apparatus 1 may be placed in an operable condition.

In order to detach the process cartridge 3 from the main body 2, the user may grip the handle 58 and manipulate the process cartridge 3 in a sequence reversed from the attaching sequence described above.

In this regard, the user may grip the gripper 94 to detach the process cartridge 3 from the main body, but the user should grip the gripper 94 without pulling the second grip 107 in the switcher part 97 closer to the first grip 101 in the fixed part 96 so that the protrusions 118 should stay in the first position, and the waste toner container 29 may stay locked to the drum cartridge 7.

Thus, the drum cartridge 7, the developing cartridge 8, and the waste toner container 29 may be integrally attached to or detached from the main body 2 when the protrusions 118 are in the first position. Further, the waste toner container 29 is attachable to and detachable from the drum cartridge 7 when the protrusions 118 are in the second position.

Meanwhile, the developing cartridge 8 is, as shown in FIG. 11, attachable to and detachable from the drum cartridge 7 both when the process cartridge 3 is attached to the main body 2 and when the process cartridge 3 is detached from the main body 2.

8. Removal of Toner from the Photosensitive Drum 17

During an image forming operation, the toner once carried on the circumferential surface of the photosensitive drum 17 may adhesively remain thereon without being transferred onto the sheet P.

The toner remaining on the circumferential surface of the photosensitive drum 17 may be, as shown in FIGS. 6 and 7, scraped off by the drum cleaner 51 and removed from the circumferential surface as the photosensitive drum 17 rotates. The removed toner may be stored inside the cleaner frame 50.

The toner in the cleaner frame 50 may be conveyed by the conveyer 53 being rotated to the waste toner conveyer tube 22 and toward the waste toner container 29.

The toner conveyed to the other end of the waste toner conveyer tube 22 may flow into the protrusive part 71 through the outlet port 63 and the inlet port 77 in the cylindrical inlet 76.

Thus, the toner may be stored in the waste toner container 29.

The waste toner container 29 may thus store the toner conveyed by the waste toner conveyer tube 22, and conveyance of the toner may be accomplished.

9. Benefits (1) According to the process cartridge 3 described above, as shown in FIGS. 1 and 6, the waste toner container 29 is located, when the developing cartridge 8 and the waste toner container 29 are attached to the drum cartridge 7, on the opposite side of the developing cartridge 8 to the photosensitive drum 17 rather than on the same side of the developing cartridge 8 as the photosensitive drum 17.

Therefore, while the parts and items to print images on the sheet P may be arranged on the same side of the developing cartridge 8 as the photosensitive drum 17, a capacity volume of the waste toner container 29 may be substantially reserved.

Thus, the toner removed from the circumferential surface of the photosensitive drum 17 may be stored substantially.

(2) According to the process cartridge 3 described above, as shown in FIGS. 8 and 10, with the protrusions 118 in the waste toner container 29 being placed in the first position, not only the waste toner container 29 but also the developing cartridge 8 may be attachable to and detachable from the image forming apparatus 1 integrally with the drum cartridge 7.

In the meantime, as shown in FIGS. 9 and 11, with the protrusions 118 being placed in the second position, the waste toner container 29 may be attachable to and detachable from the drum cartridge 7.

Therefore, the user may switch the positions of the protrusions 118 in the waste toner container 29 between the first position and the second position to select between attachment/detachment of the waste toner container 29, the developing cartridge 8, and the drum cartridge 7; and attachment/detachment of the waste toner container 29 and the developing cartridge 8.

(3) According to the process cartridge 3 described above, as shown in FIG. 8, the protrusions 118 in the rods 98A, 98B may be placed in the first position by as simply as being inserted in the grooves 88.

(4) According to the process cartridge 3 described above, as shown in FIG. 6, the developing cartridge 8 may be pressed against the photosensitive drum 17 by the spring 37 in the waste toner container 29 so that the developer roller 25 may supply the toner to the photosensitive drum 17 steadily and assuredly.

(5) According to the process cartridge 3 described above, as shown in FIG. 11, the movable direction for the developing cartridge 8 and the waste toner container 29 to be attached to or detached from the drum cartridge 7 coincides substantially with the extending direction of the waste toner conveyer tube 22.

Therefore, the waste toner container 29 may be assuredly connected with the waste toner conveyer tube 22 upon attachment of the waste toner container 29 to the drum cartridge 7.

(6) According to the process cartridge 3 described above, the waste toner container 29 includes, further to the main part 70, the protrusive part 71, which is located on the opposite side of the first wall 28A to the photosensitive layer 17C with regard to the axial direction, as shown in FIG. 8.

Therefore, the waste toner container 29 may provide a larger amount of capacity volume to store the waste toner.

(7) According to the process cartridge 3 described above, as shown in FIGS. 7 and 8, the waste toner conveyer tube 22 may be connected with the protrusive part 71 of the waste toner container 29 when the waste toner container 29 is attached to the drum cartridge 7.

Therefore, the waste toner conveyer tube 22 may be assuredly connected with the waste toner container 29 without a complicated connecting procedure.

(8) According to the process cartridge 3 described above, as shown in FIG. 8, the electric terminal 80 in the developing cartridge 8 is located on the opposite side of the waste toner conveyer tube 22 to the first wall 28A with regard to the axial direction when the developing cartridge 8 is attached to the drum cartridge 7.

Therefore, the electric terminal 80 may assuredly receive the power supply from the external power source.

(9) According to the process cartridge 3 described above, as shown in FIGS. 7 and 8, the protrusive part 71 in the waste toner container 29 may be placed in the correct position by confronting the fifth wall 44 along the movable direction so that the waste toner container 29 may be restrained from moving in the movable direction.

Therefore, the waste toner container 29 may assuredly receive the toner from the waste toner conveyer tube 22 to store.

(10) According to the process cartridge 3 described above, as shown in FIG. 5, the fifth wall 44 has the hole 44A, in which the waste toner conveyer tube 22 may be inserted to be connected with the protrusive part 71.

Therefore, the waste toner conveyer tube 22 may be connected with the waste toner container 29 without detouring a longer distance. The process cartridge 3 may be downsized at least in the axial direction compared to a process cartridge with a toner conveyer tube that detours a longer distance around the fifth wall 44.

(11) According to the process cartridge 3 described above, as shown in FIG. 5, a part of the waste toner conveyer tube 22 longitudinally extending in the movable direction is arranged in a range between the conveyer roller 57 and the third wall 42. More specifically, the part of the waste toner conveyer tube 22 is arranged in a range between one end of the conveyer roller 57 closer to the third wall 42 and the third wall 42 with regard to the axial direction. In this arrangement, the waste toner conveyer tube 22 may be prevented from detouring outward with regard to the one end of the conveyer roller 57 closer to the third wall 42.

Therefore, the process cartridge 3 may be downsized at least in the axial direction compared to a process cartridge with a toner conveyer tube that detours outward with respect to the one end of the conveyer roller 57 closer to the third wall 42.

Further, as shown in FIG. 1, the waste toner conveyer tube 22 is arranged in the process cartridge 3 at the upper position with respect to the conveyer roller 57. Therefore, the waste toner conveyer tube 22 may not collide with the conveyer roller 57. Specifically, the waste toner conveyer tube 22 arranged to extend in the range between the one end of the conveyer roller 57 closer to the third wall 42 and the third wall 42 with regard to the axial direction may not interfere with the sheet P being conveyed between the conveyer roller 57 and the mating roller (unsigned) in the image forming apparatus 1.

10. Modified Examples of the First Embodiment

Below will be described varied examples derivable from the first embodiment. In the following examples, items or structures which are substantially the same as or similar to those described in the above embodiment may be denoted by the same reference signs, and description of those may be omitted.

10.1 First Modified Example

In the first embodiment of the present disclosure described above, as shown in FIGS. 6 and 7, the toner removed from the circumferential surface of the photosensitive drum 17 is conveyed to the waste toner container 29 by the conveyer 53, which is in the spiral form.

However, configuration to convey the toner removed from the circumferential surface of the photosensitive drum 17 to the waste toner container 29 may not necessarily be limited to the conveyer 53 in the spiral form.

Figure 12:
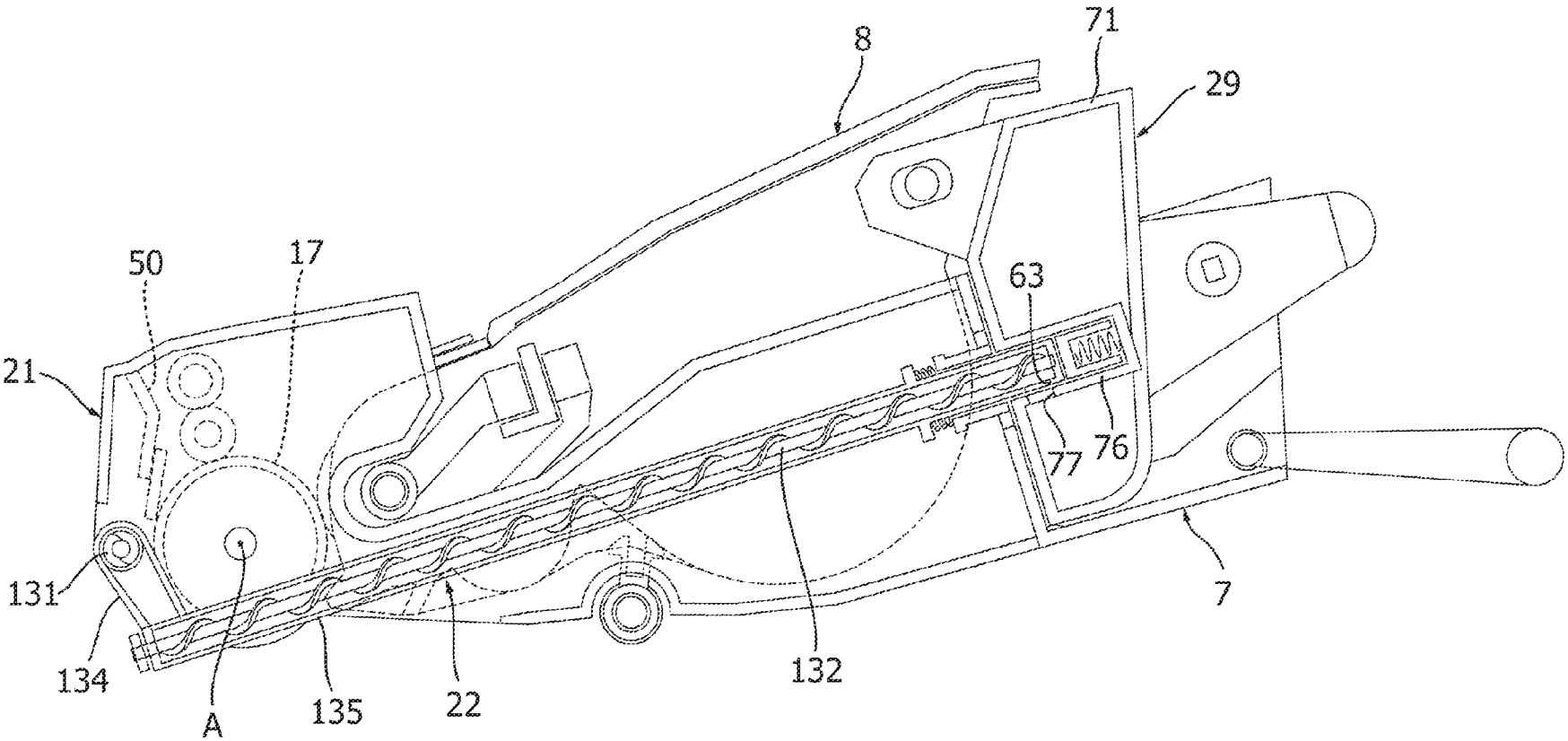
FIG. 12 is a sideward cross-sectional view of the process cartridge in a first modified example according to the first embodiment of the present disclosure.

For example, as shown in FIG. 12, the drum cartridge 7 may be equipped with a first auger screw 131 and a second auger screw 132 in place of the conveyer 53. Further, the waste toner conveyer tube 22 may include a first tube 134 and a second tube 135.

The first tube 134 may longitudinally extend in a direction to intersect with the movable direction and with the axial direction. Preferably, the first tube 134 may longitudinally extend along the vertical direction. One end of the first tube 134 may be connected with the lateral wall 41A to make a passage to the cleaner frame 50. On the other hand, the other end of the first tube 134 opposite to the one end may be located farther than the one end from the drum cleaner 51. Preferably, the other end of the first tube 13 may be located at a position lower than the one end.

The second tube 135 may be connected with the other end of the first tube 134. The second tube 135 may longitudinally extend from the other end of the first tube 134 in the movable direction to the cylindrical inlet 76 in the protrusive part 71. The second tube 135 may be a linear tube and has an outlet port 63, which is analogous to the outlet port 63 in the waste toner conveyer tube 22 described in the above embodiment.

The first auger screw 131 may be located inside the cleaner frame 50. The first auger screw 131 may longitudinally extend in the axial direction.

The second auger screw 132 may be located inside the second tube 135. One end of the second auger screw 132 with regard to the movable direction may face the other end of the first tube 134. The other end of the second auger screw 132 may face the outlet port 63.

The toner scraped off form the circumferential surface of the photosensitive drum 17 and stored inside the cleaner frame 50 may be conveyed by the first auger screw 131 toward the first tube 134.

The toner conveyed to the first tube 134 may then fall through the first tube 134 to flow in the second tube 135.

The toner entering the second tube 135 may be conveyed by the second auger screw 132 toward the protrusive part 71 in the waste toner container 29.

Thus, the toner conveyed to the protrusive part 71 may be stored in the waste toner container 29.

With the modified configuration described above in the first modified example, the benefits achievable by the first embodiment described above may be analogously achieved.

10.2 Second Modified Example

According to the first modified example, as shown in FIG. 12, the second auger screw 132 may convey the toner in the waste toner conveyer tube 22; however, configuration to convey the toner in the second tube 132 in the waste toner conveyer tube 22 may not necessarily be limited to the second auger screw 132.

Figure 13:
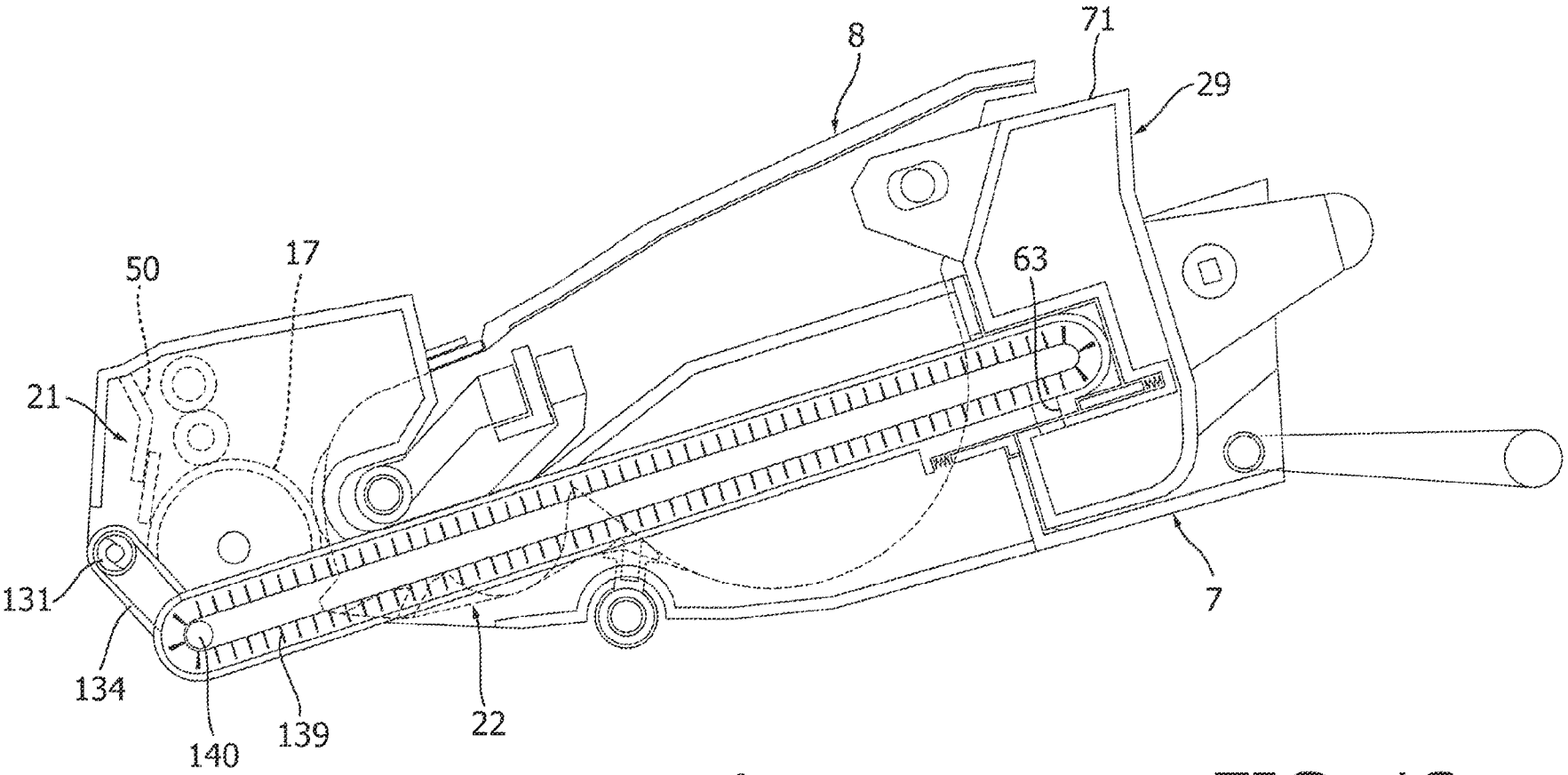
FIG. 13 is a sideward cross-sectional view of the process cartridge in a second modified example according to the first embodiment of the present disclosure.

For example, as shown in FIG. 13, the drum cartridge 7 in the second modified example may be equipped with a belt 139 and a belt roller 140 in place of the second auger screw 132.

The belt 139 may be located inside the second tube 135. The belt 139 may longitudinally extend in an entire length range of the second tube 135 along the movable direction. The belt 139 may face the outlet port 63.

The belt roller 140 may be located on an inner side of the belt 139. The belt roller 140 may drive the belt 139 to circulate by a driving force supplied from an external power source, which is not shown.

The toner exiting the first tube 134 and entering the second tube 135 may be conveyed by the belt 139 toward the protrusive part 71 in the waste toner container 29.

With the modified configuration described above in the second modified example, the benefits achievable by the first embodiment may be analogously achieved.

10.3 Third Modified Example of the First Embodiment

Figure 14:
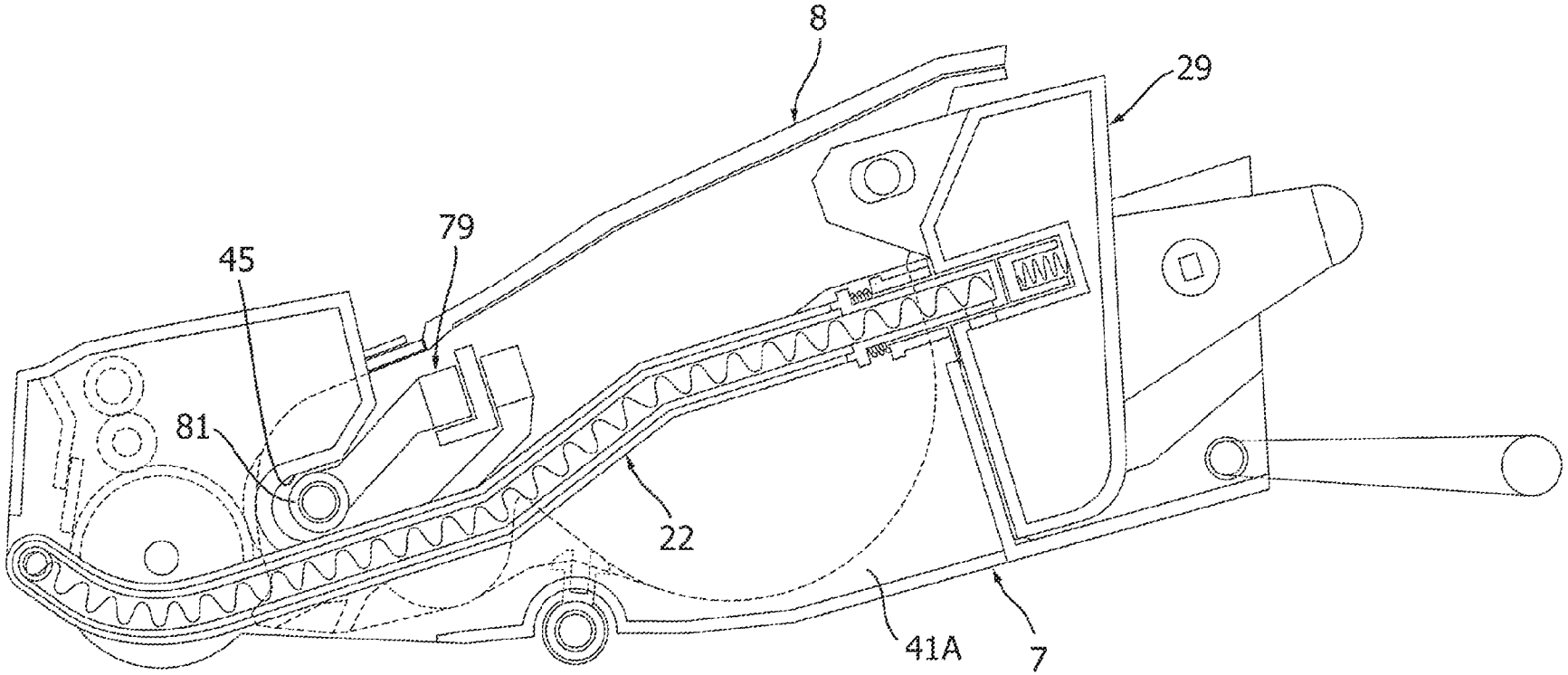
FIG. 14 is a sideward cross-sectional view of the process cartridge in a third modified example according to the first embodiment of the present disclosure.

According to the first embodiment described above, as shown in FIG. 7, the waste toner conveyer tube 22 longitudinally extends in the movable direction. In this regard, in the third modified example, as shown in FIG. 14, the waste toner conveyer tube 22 may longitudinally extend along the first developer guide 45 in the lateral wall 41A.

Specifically, the waste toner conveyer tube 22 may partly extend along an edge of the first developer guide 45 in the lateral wall 41A.

With this arrangement, when the developing cartridge 8 is attached to the drum cartridge 7, the first developer guide 45 and the waste toner conveyer tube 22 may guide the bearing 81.

Therefore, the developing cartridge 8 may be attached to the drum cartridge 7 more assuredly.

10.4. Fourth Modified Example

According to the first embodiment described above, as shown in FIG. 3, the electric terminal 80 in the electrode 79 may be arranged on the first wall 28A in the developing cartridge 8.

Figure 15:
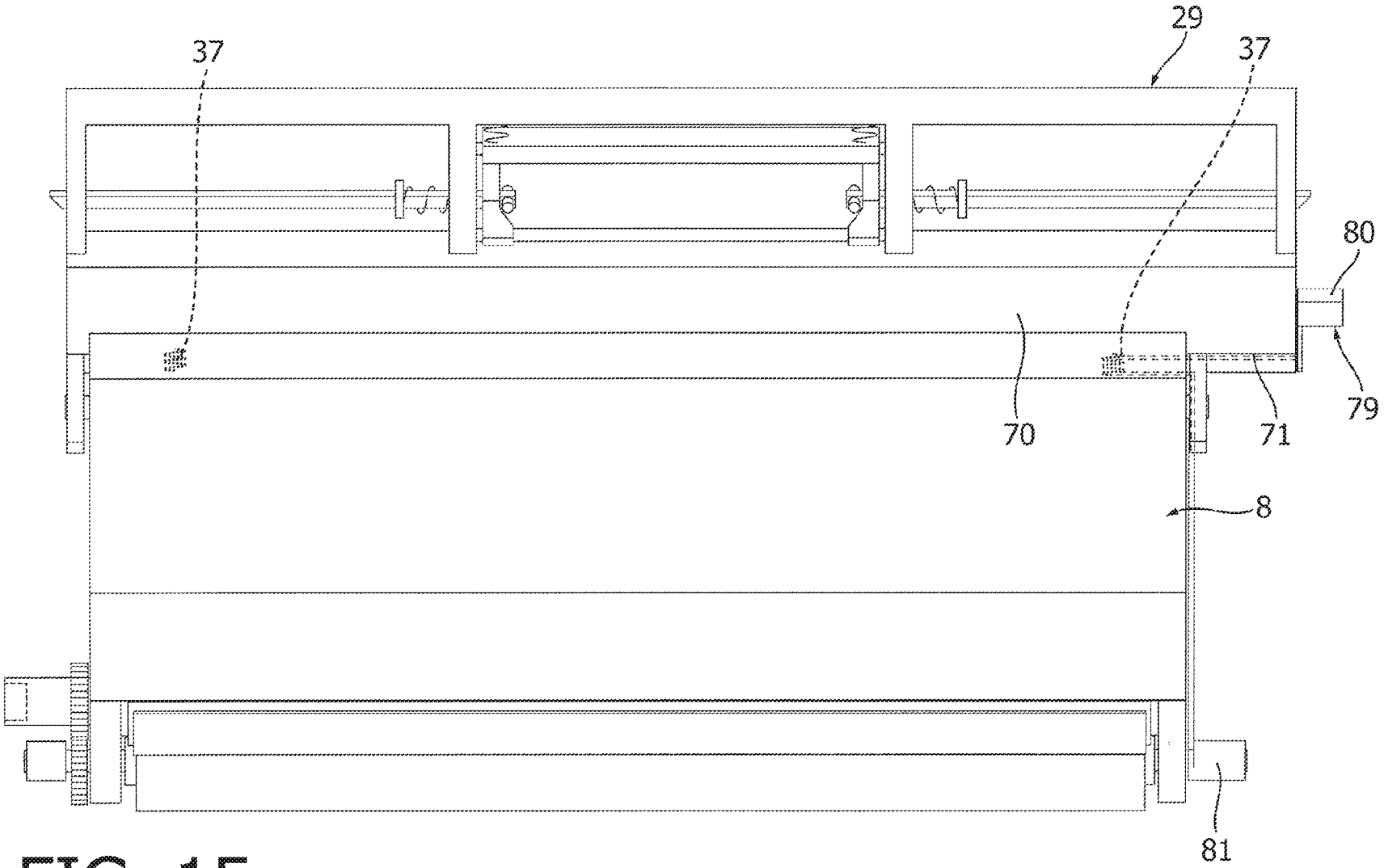
FIG. 15 is a sideward cross-sectional view of the process cartridge in a fourth modified example according to the first embodiment of the present disclosure.

In this regard, the electric terminal 80 in the fourth modified example may be arranged, as shown in FIG. 15, in the waste toner container 29. Specifically, the electric terminal 80 may be arranged on the protrusive part 71 in the waste toner container 29. The electric terminal 80 may protrude outward with respect to the protrusive part 71 in the axial direction.

The electric terminal 80 may be electrically connected with the bearing 81 through the spring 37. In other words, power from an external power source may be supplied to the developer roller 25 through the spring 37.

According to the fourth modified example, with the electric terminal 80 arranged on the waste toner container 29, which is attached to be fixed to the drum cartridge 7, the connection to transmit the power may be more stably secured, compared to the electric terminal 80 arranged on the developing cartridge 8, which is not fixed to the developing cartridge 8 in the first embodiment.

10.5 More Examples of the First Embodiment

The configuration of the process cartridge 3 may not necessarily be limited to the embodiment and the examples described above.

For another example, the spring 37 may not necessarily be arranged on the waste toner container 29 but may be arranged on the developing cartridge 8. With the spring 37 arranged on the developing cartridge 8, the spring 37 may be urged against the waste toner container 29, and a repelling force from the spring 37 may urge the developing cartridge 8 against the photosensitive drum 17.

For another example, the waste toner container 29 may not necessarily be swingably attached to the developing cartridge 8 to be swingable with respect to the developing cartridge 8 about the protrusive part 31. The developing cartridge 8 and the waste toner container 29 may be attachable to the drum cartridge 7 independently. When the developing cartridge 8 and the waste toner container 29 are independently attachable to the drum cartridge 7, the waste toner container 29 may be attached to or detached from the drum cartridge 7 while the developing cartridge 8 is or is not attached to the drum cartridge 7. Likewise, the developing cartridge 8 may be attached to or detached from the drum cartridge 7 while the waste toner container 29 is or is not attached to the drum cartridge 7.

II. Second Embodiment

In the first embodiment described above, the developing cartridge 8, which contains the developer roller 25, and the waste toner container 29 may be attachable to and detachable from the drum cartridge 7, which contains the photosensitive drum 17, the drum cleaner 51, and the waste toner conveyer tube 22.

In this regard, while the photosensitive drum 17 and the developer roller 25 that are separable from each other operate, in order to maintain or adjust the contact and the distance between the photosensitive drum 17 and the developer roller 25 at a preferable condition, it may be preferable that the developing cartridge 8 is movable relatively to the drum cartridge 7. According to a second embodiment described below, a process cartridge and an image forming apparatus, in which the toner removed by a drum cleaner may be conveyed to the waste toner container assuredly while the contact between the photosensitive drum and the developer roller may be maintained steadily, is provided.

1. Overall Configuration of Image Forming Apparatus 201

In the following description, items or structures which are identical or substantially similar to those described in the first embodiment may be denoted by the same reference signs, and description of those may be omitted.

1.1 Main Body 202

The image forming apparatus 1 in the second embodiment includes, analogously to the first embodiment, a main body 202, a process cartridge 203, the transfer roller 18, and the fuser 33. The main body 202 includes an opening 205 and a cover 206. The opening 205 is in a substantially analogous form to the opening 205 in the first embodiment. The cover 206 is movable between a closure position (see FIG. 16), in which the cover 206 closes the opening 205, and an open position (see FIG. 25), in which the opening 205 is exposed.

1.2 Process Cartridge 203

The process cartridge 203 may be attached to and detached from the main body 202 through the opening 205. The process cartridge 203 includes a drum cartridge 207, a developing cartridge 208, and a waste toner container 229.

1.2.1 Drum Cartridge 207

The drum cartridge 207 includes the photosensitive drum 17, the drum cleaner 51, the cleaner frame 50, and a waste toner container 222.

The photosensitive drum 17 includes the rotation shaft A and is rotatable about the rotation shaft A. An axial direction of the photosensitive drum 17 may intersect orthogonally with the movable direction of the process cartridge 203.

1.2.2 Developing Cartridge 208

The developing cartridge 208 includes the developer roller 25 and a casing 208A. The casing 208A includes a toner storage 228 that may store the toner to be supplied to the photosensitive drum 17. The developing cartridge 208 is movable to be attached to and detached from the drum cartridge 207. The developing cartridge 208 is located on an opposite side of the photosensitive drum 17 to the fuser 33 with regard to the attachable/detachable direction of the developing cartridge 8. In other words, the photosensitive drum 17 is located between the developing cartridge 208 and the fuser 33 in the attachable/detachable direction of the developing cartridge 8. The process cartridge 203 is movable with respect to the main body 202 in the movable direction to be attached to or detached from the main body 202.

The developing cartridge 208 includes a first agitator 268 and a second agitator 69.

The toner storage 228 includes a main part 35 and a contact part 36.

The main part 35 is located on an opposite side of the developer roller 25 to the photosensitive drum 17 with regard to the movable direction. In other words, the developer roller 25 is located between the main part 35 and the photosensitive drum 17 in the movable direction. The main part 35 may contain the toner therein. The main part 35 forms a first inner room 235A. In other words, the main part 35 includes the first inner room 235A.

The contact part 36 is located on an opposite side of the main part 35 to the developer roller 25 with regard to the movable direction. In other words, the main part 35 is located between the contact part 36 and the developer roller 25 in the movable direction. The contact part 36 protrudes outward from the main part 35 in the movable direction. Specifically, the contact part 36 protrudes outward from the main part 35 in an orthogonal direction, which is orthogonal to an axial direction of the developer roller 25. The contact part 36 communicates with the main part 35. The contact part 36 forms a second inner room 236A. In other words, the contact part 36 includes the second inner room 236A that is in communication with the first inner room 235A in the main part 35.

The first agitator 268 is located inside the main part 35 in the toner storage 228. The first agitator 268 may agitate the toner stored inside the main part 35, i.e., in the first inner room 235A.

The second agitator 69 is located inside the contact part 36 in the toner storage 228. The second agitator 69 may agitate the toner stored inside the contact part 36, i.e., in the second inner room 236A. Further, the second agitator 69 may pass the toner from the contact part 36 to the main part 35.

The developer roller 25 is arranged to contact the photosensitive drum 17. The developer roller 25 may supply the toner in the toner storage 228 to the photosensitive drum 17 through the contact.

1.2.3 Waste Toner Container 229

The waste toner container 229 may accommodate the toner removed from the photosensitive drum 17. The waste toner container 229 is detachably attached to the drum cartridge 207.

1.3 Transfer Roller 18

The transfer roller 18 is arranged to contact the photosensitive drum 17. The transfer roller 18 may transfer a toner image carried on the photosensitive drum 17 to a sheet P.

1.4 Fuser 33

The fuser 33 is, when the process cartridge 203 is attached to the main body 202, located on an opposite side of the process cartridge 203 to the cover 206 with regard to the movable direction of the process cartridge 203. In other words, process cartridge 203 is located between the fuser 33 and the cover 206 in the movable direction.

2. Detailed Configuration of the Developing Cartridge 208

2.1 Toner Storage 228

The toner storage 228 includes, as shown in FIGS. 17A-17B and 18, includes a first lateral wall 228A and a second lateral wall 228B.

The first lateral wall 228A and the second lateral wall 228B are spaced apart along the axial direction from each other. The first lateral wall 228A is located at one end of the toner storage 228 with regard to the axial direction. The first lateral wall 228A includes one end closer to the developer roller 25 and the other end farther from the developer roller 25 with regard to the movable direction. The second lateral wall 228B is located at the other end of the toner storage 228 with regard to the axial direction. The second lateral wall 228B is located on an opposite side of the toner storage 228 to the first lateral wall 228A with regard to the axial direction. In other words, the toner storage 228 is located between the second lateral wall 228B and the first lateral wall 228A in the axial direction. The second lateral wall 228B includes one end closer to the developer roller 25 and the other end farther from the developer roller 25 with regard to the movable direction.

In the toner storage 228, between the one end of the first lateral wall 228A and the one end of the second lateral wall 228B with regard to the movable direction, formed is the main part 35; and between the other end of the first lateral wall 228A and the second lateral wall 228B with regard to the movable direction, formed is the contact part 36.

2.2 Developer Roller 25

The developer roller 25 is arranged to longitudinally extend in the axial direction and is partly exposed outside the developing cartridge 208. The developer roller 25 includes the shaft 25A and the roller body 25B.

The shaft 25A longitudinally extends in the axial direction and is supported on the first lateral wall 228A at one end thereof and on the second wall 228B at the other end thereof. The one end of the shaft 25A protrudes farther outward than the first lateral wall 228A along the axial direction, and the other end of the shaft 25A protrudes farther outward than the second lateral wall 228B along the axial direction.

The roller body 25B is arranged on a circumference of the shaft 25A. The roller body 25B is located between the first lateral wall 228A and the second lateral wall 228B.

2.3 Protrusions 237

The first lateral wall 228 includes, as shown in FIGS. 17B and 18, protrusions 237. A quantity of the protrusions 237 may be, for example, two (2).

The protrusions 237 are located on the other end of the first lateral wall 228A with regard to the axial direction. The protrusions 237 are spaced apart along the movable direction from each other. The protrusions 237 protrude outward in a direction to be away from the second lateral wall 28B along the axial direction. The protrusions 237 each has a cylindrical shape.

The second lateral wall 228B includes, analogously to the first lateral wall 228A, two (2) protrusions 237.

3. Detailed Configuration of the Waste Toner Container 229

3.1 Location of the Waste Toner Container 229

The waste toner container 229 may accommodate the toner conveyed through the waste toner conveyer tube 222. The waste toner container 229 is, as shown in FIG. 17A, located on an opposite side of the main part 35 of the toner storage 228 to the developer roller 25. In other words, the main part 35 is located between the waste toner container 229 and the developer roller 25. The waste toner container 229 is arranged alongside the contact part 36 of the toner storage 228 along an intersecting direction, which intersects with the movable direction. Preferably, the waste toner container 229 may be located at a position lower than the contact part 36.

Figure 16:
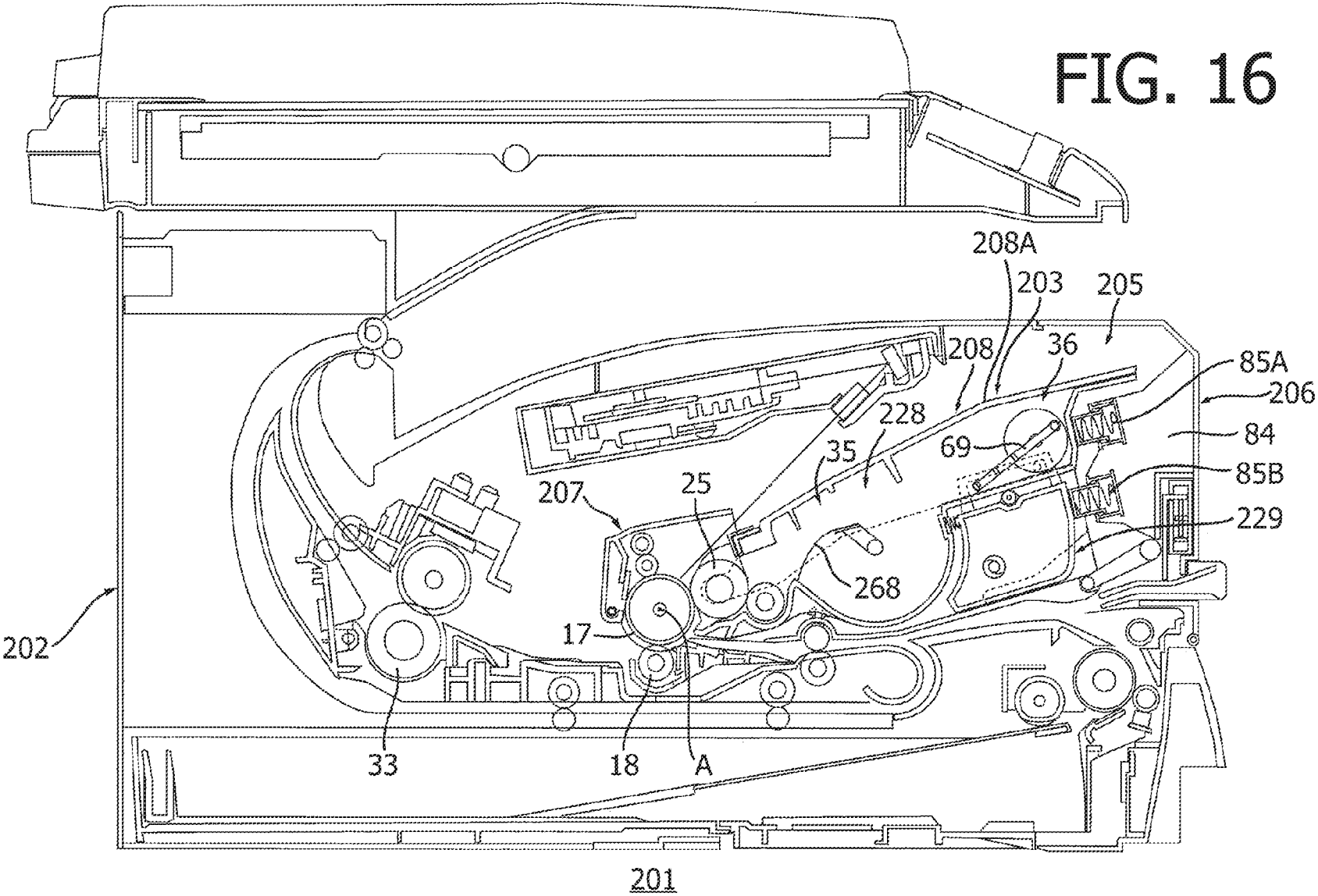
FIG. 16 is a cross-sectional view at a center of an image forming apparatus according to a second embodiment of the present disclosure with a sideward cross-sectional view of a process cartridge viewed at a line E-E shown in FIG. 23.

The waste toner container 229 is, when the developing cartridge 208 and the waste toner container 229 are attached to the drum cartridge 207, as shown in FIG. 16, located on an opposite side of the developer roller 25 to the photosensitive drum 17 with regard to the movable direction. In other words, the developer roller 25 is located between the waste toner container 229 and the photosensitive drum 17 in the movable direction.

3.2 Configuration of the Waste Toner Container 229

A capacity volume of the waste toner container 229 may be, for example, greater than or equal to 5% and smaller than or equal to 50%, or more preferably, greater than or equal to 10% and smaller than or equal to 30%, of a capacity volume of the toner storage 228. Thus, an approximate upper limit of the capacity volume of the waste toner container 229 may be determined based on the capacity volume of the toner storage 228.

The waste toner container 229 includes, as shown in FIGS. 17B and 18, a third lateral wall 229A, a fourth lateral wall 29B, a first part 270, a second part 271, an auger screw 272, a shutter 273, and a spring 274.

3.2.1 Third Lateral Wall 229A and Fourth Latera Wall 229B

The third lateral wall 229A and the fourth lateral wall 229B are spaced apart along the axial direction from each other.

The third lateral wall 229A is located on one end of the waste toner container 229 with regard to the axial direction. The third lateral wall 229A is, when the developing cartridge 208 and the waste toner container 229 are attached to the drum cartridge 207, as shown in FIGS. 18 and 23, located on an opposite side of the first lateral wall 228A to the second lateral wall 228B with regard to the axial direction. In other words, the first lateral wall 228A is located between the third lateral wall 229A and the second lateral wall 228B in the axial direction. The third lateral wall 229A is located on an opposite side of the one end of the shaft 25A to the first lateral wall 228A with regard to the axial direction. In other words, the one end of the shaft 25A is located between the third lateral wall 229A and the first lateral wall 228A in the axial direction. The third lateral wall 229A includes protrusions 30. A quantity of the protrusions 30 may be, for example, two (2).

The protrusions 30 are spaced apart along the movable direction from each other. The protrusions 30 protrude outward from the third lateral wall 229A in an opposite direction from the second lateral wall 228B along the axial direction.

The fourth lateral wall 229B is located on the other end of the waste toner container 229 with regard to the axial direction. The fourth lateral wall 229B is located on an opposite side of the first lateral wall 228A to the third lateral wall 229A with regard to the axial direction. In other words, the first lateral wall 228A is located between the fourth lateral wall 229B and the third lateral wall 229A in the axial direction. The fourth lateral wall 229B includes, analogously to the third lateral wall 29A, two (2) protrusions 30.

3.2.2 First Part 270

The first part 270 is, when the developing cartridge 208 and the waste toner container 229 are attached to the drum cartridge 207, located between the first lateral wall 228A and the fourth lateral wall 229B in the axial direction. The first part 270 coincides with the main part 35 of the toner storage 228 along the movable direction, as shown in FIGS. 17A and 18. Further, the first part 270 coincides with the contact part 36 of the toner storage 228 along the intersecting direction.

3.2.3 Second Part 271

The second part 271 is, when the developing cartridge 208 and the waste toner container 229 are attached to the drum cartridge 207, as shown in FIGS. 18 and 23, located between the first lateral wall 228A and the third lateral wall 229A in the axial direction.

The second part 271 protrudes in the axial direction outward farther than the first lateral wall 228A. Further, the second part 271 protrudes outward farther than the one end of the shaft 25A in the axial direction. The second part 271 communicates with the first part 270. The second part 271 includes, as shown in FIGS. 17B and 18, a first surface 270A on one end thereof and a second surface 270B on the other end thereof with regard to the movable direction. The first surface 270A is located closer than the second surface 270B to the developer roller 25. The second part 271 includes a cylindrical inlet 276.

The cylindrical inlet 276 is formed to recede from the first surface 270A toward the second surface 270B along the movable direction. The cylindrical inlet 276 has a cylindrical form. The cylindrical inlet 276 has one end and the other end with regard to the movable direction. The one end of the cylindrical inlet 276 is open, and the other end of the cylindrical inlet 276 is closed. The cylindrical inlet 276 includes an inlet port 277.

The inlet port 277 is an opening, through which the toner may enter the waste toner container 229. The inlet port 277 is, as shown in FIG. 17B, formed on a circumference of the cylindrical inlet 276 on an opposite side of the shutter 273 to the contact part 36 of the toner storage 228 with regard to the intersecting direction. In other words, the shutter 273 is located between the inlet port 277 and the contact part 36 in the intersecting direction. The inlet port 277 is formed through a circumferential surface of the cylindrical inlet 276 to make a passage. Preferably, the inlet port 277 may be formed at a bottom of the cylindrical inlet 276.

3.2.4 Auger Screw 272

The auger screw 272 is, as shown in FIGS. 17A-17B, located inside the first part 270 and the second part 271. The auger screw 272 extends longitudinally in the axial direction. One end of the auger screw 272 with regard to the axial direction is supported rotatably by the fourth lateral wall 229B, and the other end of the auger screw 272 with regard to the axial direction is, although not shown, supported rotatably by the third lateral wall 29A. The other end of the auger screw 272 is located to coincide with the inlet port 277 along the intersecting direction. The auger screw 272 may convey the toner entering the second part 271 through the inlet port 277 toward the first part 270.

3.2.5 Shutter 273 and Spring 274

The shutter 273 is, as shown in FIG. 17B, located inside the cylindrical inlet 276. The shutter 273 is movable along the movable direction between a closure position (see FIG. 17B), in which the inlet port 277 is covered, and an open position (see FIG. 22), in which the inlet port 277 is uncovered.

The spring 274 is located between the shutter 273 and an inner surface on the other end of the cylindrical inlet 276. The spring 274 urges the shutter 273 to place the shutter 273 at the closure position at an ordinary state.

3.3 Slidable Configuration of the Developing Cartridge 208 to the Waste Toner Container 229

The waste toner container 29 includes, as shown in FIGS. 17B and 18, rollers 87, a first supporting part 88A, a second supporting part 88B, and springs 89. A quantity of the rollers 87 may be, for example, two (2); and a quantity of the springs 89 may be, for example, two (2).

The rollers 87 are spaced apart along the axial direction from each other. The rollers 87 are, as shown in FIG. 17A, arranged to protrude from the first part 270 of the waste toner container 229 toward the contact part 36. The rollers 87 are rotatably supported by the first part 270. The rollers 87 may contact the contact part 36 of the toner storage 228, as shown in FIGS. 17A and 21, when the developing cartridge 208 and the waste toner container 229 are attached to the drum cartridge 207.

The first supporting part 88A and the second supporting part 88B are, as shown in FIG. 18, spaced apart along the axial direction from each other.

The first supporting part 88A longitudinally extends, as shown in FIG. 17B, from the second part 271 toward the contact part 36 of the toner storage 228. The first supporting part 88A is arranged alongside the first lateral wall 228A along the axial direction. The first supporting part 88A includes a first section 91, a second section 92, and a connector section 93.

The first section 91 and the second section 92 are spaced apart along the movable direction from each other. A distance between the first section 91 and the second section 92 along the movable direction is longer than a distance between the two protrusions 37.

The first section 91 is located between the protrusions 37 and the developer roller 25 in the movable direction. The first section 91 longitudinally extends in the intersecting direction. The first section 91 includes one end continuous with the second part 271 of the waste toner container 229 and the other end opposite from the one end and farther from the second part 271.

The second section 92 is located on an opposite side of the protrusions 37 to the developer roller 25 with regard to the movable direction. In other words, the protrusions 37 are located between the second section 92 and the developer roller 25 in the movable direction. The second section 92 includes one end, which is continuous with the second part 271 of the waste toner container 229, and the other end opposite to the one end and farther from the second part 71.

The connector section 93 connects the other end of the first section 91 with the other end of the second section 92. The connector section 93 is located on an opposite side of the protrusions 37 to the second part 271 of the waste toner container 229 with regard to the intersecting direction. In other words, the protrusions 37 are located between the connector section 93 and the second part 271 in the intersecting direction. The connector section 93 longitudinally extends in the movable direction.

The second supporting part 88B is, as shown in FIGS. 17A-17B, in an identical form to the first supporting part 88A.

The springs 89 are, as shown in FIGS. 17A and 18, spaced apart along the axial direction from each other. The springs 89 are located between the first part 270 and the main part 35 of the toner storage 228. The springs 89 may, when the developing cartridge 208 and the waste toner container 229 are attached to the drum cartridge 207, apply pressure to the developing cartridge 208 to urge the developing cartridge 208 against the photosensitive drum 17, as shown in FIG. 21.

Thus, the developing cartridge 208 and the waste toner container 229 are coupled with each other but are movable relatively to each other in the movable direction. The contact part 36 of the toner storage 228 is, when the developing cartridge 208 and the waste toner container 229 are attached to the drum cartridge 207, as shown in FIGS. 21 and 24, placed to contact the waste toner container 229 along a contacting direction, which intersects with the axial direction and with the orthogonal direction. Meanwhile, the contact part 36 of the toner storage 228 is slidable with respect to the waste toner container 229 in the orthogonal direction. The movable configuration of the contact part 36 with respect to the waste toner container 29 will be described later in detail.

4. Detailed Configuration of the Drum Cartridge 207

4.1 Lateral Walls 40A, 40B, and Bottom Wall 241

The drum cartridge 207 includes, as shown in FIGS. 19 and 20, a lateral wall 40A, a lateral wall 40B, and a bottom wall 241.

The lateral walls 40A and 40B are spaced apart along the axial direction of the photosensitive drum 17 from each other. The lateral walls 40A, 40B each extends in the movable direction and spreads in a shape of a plate. The lateral wall 40A supports one end of the photosensitive drum 17 with regard to the axial direction, and the lateral wall 41B supports the other end of the photosensitive drum 17 with regard to the axial direction.

The lateral wall 40A and the lateral wall 40B include a first developer guide 45 and a second developer guide 46, respectively, which are substantially analogous to the first developer guide 45 and the second developer guide 46 described above in the first embodiment.

The developing cartridge 208 is, when attached to the drum cartridge 207, movable along the first developer guide 45 and the second developer guide 46 in the orthogonal direction between a contact position (see FIG. 21), in which the developer roller 25 contacts the photosensitive drum 17, and a separate position (see FIG. 24), in which the developer roller 25 is separated from the photosensitive drum 17.

The bottom wall 241 is, as shown in FIGS. 19 and 20, located between the lateral wall 40A and the lateral wall 40B. The bottom wall 41 longitudinally extends in the movable direction.

4.2 Photosensitive Drum 17

The photosensitive drum 17 is, as shown in FIGS. 21 and 23, in an analogous configuration to the photosensitive drum 17 described in the first embodiment above. The photosensitive drum 17 includes the cylindrical part 17A, the drum shaft 17B, and the handle 58.

4.3 Handle 58

The handle 58 is supported by the bottom wall 241 to be movable relatively to the bottom wall 41.

The handle 58 extends in a direction to be farther away from the photosensitive drum 17 along the movable direction.

5. Configuration to Convey Toner in the Drum Cartridge 207

5.1 Cleaner Frame 50 and Drum Cleaner 51

The drum cartridge 207 includes the cleaner frame 50 and the drum cleaner 51, which are analogous to those described in the first embodiment above.

One end of the cleaner frame 50 with regard to the axial direction is coupled to the lateral wall 40A, and the other end of the cleaner frame 50 with regard to the axial direction is coupled to the lateral wall 40B.

5.2 Fifth Lateral Wall 242, Sixth Lateral Wall 243, and Connecting Wall 244

The lateral wall 40A includes, as shown in FIG. 20, a fifth lateral wall 242, a sixth lateral wall 243, and a connecting wall 244.

The fifth lateral wall 242 extends along a waste toner conveyer tube 222, which will be described later in detail, in the movable direction. The fifth lateral wall 242 is, as shown in FIG. 23, located on an opposite side of the first lateral wall 228A of the developing cartridge 208 to the second lateral wall 228B with regard to the axial direction, when the developing cartridge 208 and the waste toner container 229 are attached to the drum cartridge 207. In other words, the first lateral wall 228A is located between the fifth lateral wall 242 and the second lateral wall 228B in the axial direction. The fifth lateral wall 242 includes one end and the other end with regard to the movable direction: the one end of the fifth lateral wall 242 is located closer to the photosensitive drum 17, and the other end of the fifth lateral wall 242 opposite to the one end is farther from the photosensitive drum 17.

The sixth lateral wall 243 extends along the waste toner conveyer tube 222 in the movable direction. The sixth lateral wall 243 is located on an opposite side of the fifth lateral wall 242 to the first lateral wall 228A of the developing cartridge 208 with regard to the axial direction, when the developing cartridge 208 and the waste toner container 229 are attached to the drum cartridge 207. In other words, the fifth lateral wall 242 is located between the sixth lateral wall 243 and the first lateral wall 228A in the axial direction. The sixth lateral wall 243 is arranged alongside the waste toner container 229 along the axial direction. The sixth lateral wall 243 includes one end and the other end with regard to the movable direction: the one end of the sixth lateral wall 243 is located closer to the photosensitive drum 17, and the other end of the sixth lateral wall 243 opposite to the one end is farther from the photosensitive drum 17.

The connecting wall 244 connects the other end of the fifth lateral wall 242 farther from the photosensitive drum 17 with the one end of the sixth lateral wall 243 closer to the photosensitive drum 17. The connecting wall 244 is arranged to face a part of the waste toner container 229 along an extending direction of the waste toner conveyer tube 222 when the developing cartridge 208 and the waste toner container 229 are attached to the drum cartridge 207. Specifically, the connecting wall 244 may face the second part 271 of the waste toner container 229 along the movable direction. In this arrangement, the connecting wall 244 may locate the waste toner container 229 in a predetermined position with respect to the drum cartridge 207. The connecting wall 244 includes, as shown in FIGS. 20 and 22, a hole 244A.

The hole 244A is formed through the connecting wall 244 to make a passage in the movable direction.

5.3 Waste Toner Conveyer Tube 222, Conveyer 53, Shutter 65, and Spring 66

The drum cartridge 207 further includes, as shown in FIGS. 19 and 20, the waste toner conveyer tube 222, the conveyer 53, the shutter 65, and the spring 66.

5.3.1 Waste Toner Conveyer Tube 222

The toner removed from the circumferential surface of the photosensitive drum 17 may be conveyed inside the waste toner conveyer tube 222. In other words, the waste toner conveyer tube 222 may convey the toner removed by the drum cleaner 51 from the photosensitive drum 17. The waste toner conveyer tube 222 may connect, as shown in FIGS. 22 and 23, when the developing cartridge 208 is attached to the drum cartridge 207, the cleaner frame 50 with the waste toner container 229. Specifically, when the developing cartridge 208 and the waste toner container 229 are attached to the drum cartridge 207, the waste toner conveyer tube 222 may be connected with the second part 271. The waste toner conveyer tube 222 is, when the developing cartridge 208 is attached to the drum cartridge 207, located on an opposite side of the first lateral wall 228A of the developing cartridge 208 to the second lateral wall 228B with regard to the axial direction. In other words, the first lateral wall 228A may be located between the waste toner conveyer tube 222 and the second lateral wall 228B when the developing cartridge 208 is attached to the drum cartridge 207.

The waste toner conveyer tube 222 has, as shown in FIGS. 19 and 20, the cylindrical shape, analogously to the waste toner conveyer tube 22 illustrated in the first embodiment. The waste toner conveyer tube 222 longitudinally extends in the movable direction from the cleaner frame 50 to the connecting wall 244 in the lateral wall 40A. Specifically, the waste toner conveyer tube 222 includes the first end portion 22A and the second end portion 22B, which are analogous to those in the waste toner conveyer tube 22 illustrated in the first embodiment. Further, the waste toner conveyer tube 222 includes the ring portion 64 and the outlet port 263, which are analogous to those in the waste toner conveyer tube 22 illustrated in the first embodiment.

The first end portion 22A is connected to the lateral wall 40A to make a passage to the cleaner frame 50.

The second end portion 22B is inserted in the hole 244A formed in the connecting wall 244. The second end portion 22B protrudes from the connecting wall 244 in a direction to be farther away from the photosensitive drum 17.

The ring portion 64 is located at a position closer than the connecting wall 244 to the photosensitive drum 17 with regard to the movable direction.

The outlet port 263 is located farther than the connecting wall 244 from the photosensitive drum 17 with regard to the movable direction.

The waste toner conveyer tube 222 is arranged to fit in the cylindrical inlet 276 in the protrusive part 271 along the movable direction when the developing cartridge 208 and the waste toner container 229 are attached to the drum cartridge 207, as shown in FIGS. 22 and 23. Thus, the waste toner conveyer tube 222 is connected with the second part 271 of the waste toner container 229. Meanwhile, when the developing cartridge 208 and the waste toner container 229 are attached to the drum cartridge 207, the outlet port 263 in the waste toner conveyer tube 222 and the inlet port 277 in the cylindrical inlet 276 may face each other. Thus, the outlet port 263 of the waste toner conveyer tube 222 is connected with the inlet port 277 of the cylindrical inlet 276 to make a passage.

5.3.2 Conveyer 53

The conveyer 53 in the drum cartridge 207 may be in an analogous form to the conveyer 53 in the drum cartridge 7 illustrated in the first embodiment. One end of the conveyer 53 is rotatably supported by the latera wall 40B of the cleaner frame 50 through the conveyer gear 53A. The other end of the conveyer 53 opposite to the one end is rotatably supported by the second end portion 222B of the waste toner conveyer tube 222. The other end of the conveyer 53 is arranged to adjoin and face the outlet port 263 of the waste toner conveyer tube 222.

5.3.3 Shutter 65 and Spring 66

The shutter 65 and the spring 66 may be in analogous forms to the shutter 65 and the spring 66 respectively in the drum cartridge 7 illustrated in the first embodiment.

5.3.4 Guide Groove 67

The lateral wall 40A includes a guide groove 67, which is substantially analogous to the guide groove 67 in the lateral wall 41A illustrated in the first embodiment.

The guide groove 67 is formed in the sixth lateral wall 243 in the lateral wall 40A. The guide groove 67 is formed on a surface of the sixth lateral wall 243 on a side opposite to the lateral wall 40B with regard to the axial direction. The guide groove 67 is open in an opposite direction to the drum cleaner 51 across from the photosensitive drum 17 with regard to the movable direction. A length of the guide groove 67 in the movable direction is larger than a protrusive length of the waste toner conveyer tube 222 that protrudes from the hole 244A of the connecting wall 244.

The lateral wall 40B includes a guide groove 67 analogously to the lateral wall 40A.

5.4 Supporting Part 84, First Spring 85A, and Second Spring 85B

The cover 206 includes, as shown in FIG. 16, a supporting part 84, a first spring 85A, and a second spring 85B.

The supporting part 84 extends in the movable direction toward the process cartridge 203 attached to the main body 202. The supporting part 84 includes one end and the other end with regard to the movable direction: the one end is continuous with the cover 206, and the other end is closer than the one end to the process cartridge 203.

The first spring 85A and the second spring 85B may apply pressure to the process cartridge 203 when the cover 206 is in the closure position and when the process cartridge 203 is attached to the main body 202.

The first spring 85A is supported on the other end of the supporting part 84. The first spring 85A may, when the process cartridge 203 is attached to the main body 202, contact the developing cartridge 8 to urge the developing cartridge 208 toward the photosensitive drum 17.

The second spring 85B is supported on the other end of the supporting part 84. The second spring 85B is arranged alongside the first spring 85A along the intersecting direction. Preferably, the second spring 85B may be located at a lower position than the first spring 85A. The second spring 85B may, when the process cartridge 203 is attached to the main body 202, contact the waste toner container 229 to urge the waste toner container 229 toward the drum cartridge 7.

Thus, the first spring 85A and the second spring 85B may restrain the developing cartridge 208 and the waste toner container 229 from moving with respect to the drum cartridge 7 in the movable direction to be separated from the drum cartridge 7 when the process cartridge 203 is attached to the main body 2.

6. Attaching and Detaching Actions of the Developing Cartridge 208 and the Waste Toner Container 229 to and from the Drum Cartridge 207

Next, with reference to FIGS. 22 and 23, actions to attach and detach the developing cartridge 208 to and from the drum cartridge 207 will be described.

In order to attach the developing cartridge 208 to the drum cartridge 207, the user may push the developing cartridge 208 against the drum cartridge 207.

As the developing cartridge 208 is pushed, the one end of the shaft 25A of the developer roller 25 may be guided in the first developer guide 45 in the drum cartridge 207, and the other end of the shaft 25A may be guided in the second developer guide 46 in the drum cartridge 207.

Thus, the developing cartridge 208 may approach the photosensitive drum 17.

Meanwhile, as shown in FIG. 23, the protrusions 30 on the third lateral wall 229A may be guided in the guide groove 67 in the sixth lateral wall 243. Simultaneously, the protrusions 30 on the fourth lateral wall 229B may be guided in the guide groove 67 in the lateral wall 40B.

Accordingly, as shown in FIG. 22, the second end portion 222B of the waste toner conveyer tube 222 may enter the cylindrical inlet 276 in the second part 271.

Meanwhile, the shutter 273 in the developing cartridge 208 may contact the second end portion 222B of the waste toner conveyer tube 222, and the shutter 65 in the drum cartridge 207 may contact the second portion 271. When the developing cartridge 208 is pushed further, the shutter 273 may be placed to the open position against the urging force of the spring 274, and the shutter 65 may be placed in the open position against the urging force of the spring 66.

Thereby, the outlet port 263 of the waste toner conveyer tube 222 and the inlet port 277 of the cylindrical inlet 276 may face each other, and the outlet port 263 of the waste toner conveyer tube 222 and the inlet port 277 of the cylindrical inlet 276 are connected to make a passage.

Thus, attachment of the developing cartridge 208 to the drum cartridge 207 may be completed.

In order to detach the developing cartridge 208 from the drum cartridge 207, the user may move the developing cartridge 208 in a reversed sequence from the sequence of the attaching action described above.

Next, the drum cartridge 207 with the developing cartridge 208 attached thereto, i.e., the process cartridge 203, may be attached to the main body 202.

In order to attach the process cartridge 203 to the main body 202, the user may place the cover 206 in the open position to expose the opening 205.

Thereafter, the user may attach the process cartridge 203 through the opening 205 to the main body 202.

Further, the user may place the cover 206 in the closure position, as shown in FIG. 16.

Thus, the image forming apparatus 201 may be placed in an operable condition.

In order to detach the process cartridge 203 from the main body 202, the user may grip the handle 58 and manipulate the process cartridge 203 in a sequence reversed from the attaching sequence described above (see FIG. 25).

Meanwhile, the developing cartridge 208 is, as shown in FIG. 26, attachable to and detachable from the drum cartridge 207 both when the process cartridge 203 is attached to the main body 202 and when the process cartridge 203 is detached from the main body 202.

7. Removal of Toner from the Photosensitive Drum 17

The toner remaining on the circumferential surface of the photosensitive drum 17 may be scraped off by the drum cleaner 51 and removed from the circumferential surface as the photosensitive drum 17 rotates, analogously to the first embodiment. The removed toner may be stored inside the cleaner frame 50.

The toner may be conveyed from the cleaner frame 50 by rotation of the conveyer 53 and in the waste toner conveyer tube 222 toward the waste toner container 229.

The toner conveyed to the second end portion 222B of the waste toner conveyer tube 222 may flow into the second part 271 through the outlet port 263 and the inlet port 277 in the cylindrical inlet 276.

The toner in the second part 271 may be conveyed toward the first part 270 by the auger screw 272 and stored in the first part 270, and conveyance of the toner may be accomplished.

8. Movability of the Developing Cartridge 208 Relatively to the Waste Toner Container 229

As shown in FIG. 16, the developing cartridge 208 may be located at a predetermined position in the drum cartridge 207 by the urging force of the first spring 85B when the developing cartridge 208 and the waste toner container 229 are attached to the drum cartridge 207. Meanwhile, the waste toner container 229 may be located at a predetermined position in the drum cartridge 207 by the urging force of the second spring 85B.

In this regard, as the image forming operation starts, the developing cartridge 208 may move between the contact position (see FIG. 21), in which the developer roller 25 contacts the photosensitive drum 17, and the separate position (see FIG. 24), in which the developer roller 25 is separated from the photosensitive drum 17.

Accordingly, the developing cartridge 208 may move along the movable direction relatively to the waste toner container 229. Specifically, the developing cartridge 208 may move relatively to the waste toner container 229 such that the protrusions 37 may move in the movable direction to approach the second section 92 of the first supporting part 88A and the second section 92 of the second supporting part 88B.

Meanwhile, the developing cartridge 208 may move smoothly on the rollers 87 in the waste toner container 229.

Thus, the main part 35 in the developing cartridge 208 may compress the springs 89 and move to be closer to the waste toner container 229 against the urging force of the springs 89.

Thus, while the waste toner container 229 may be maintained steady with respect to the drum cartridge 207, the developing cartridge 208 alone may move relatively to the drum cartridge 207.

Accordingly, the toner may be removed from the circumference of the photosensitive drum 17 and conveyed to the waste toner container 229 through the waste toner conveyer tube 22 assuredly.

9. Benefits (1) According to the process cartridge 203 described above, as shown in FIGS. 21 and 24, the developing cartridge 208 includes the contact part 36 that protrudes outward from the main part 35 along the movable direction.

The contact part 36 may contact the waste toner container 229 along the contacting direction, when the developing cartridge 208 and the waste toner container 229 are attached to the drum cartridge 207, and may slidably move in the movable direction with respect to the waste toner container 229.

Therefore, when the developing cartridge 208 and the waste toner container 229 are attached to the drum cartridge 207, the developing cartridge 208 may move in the movable direction relatively to the waste toner container 229 assuredly.

Accordingly, as shown in FIGS. 21 and 22, while the contact between the photosensitive drum 17 and the developer roller 25 may be maintained steadily, the toner removed by the drum cleaner 51 may be conveyed assuredly to the waste toner container 229, which is steadily attached to the drum cartridge 207.

Meanwhile, with the contact part 36 in the developing cartridge 208, the capacity volume for the developing cartridge 208 to store the toner may be increased.

(2) According to the process cartridge 203 described above, as shown in FIGS. 17A-17B, the waste toner container 229 has the rollers 87; therefore, the developing cartridge 208 may move smoothly relatively to the waste toner container 229.

(3) According to the process cartridge 203 described above, as shown in FIGS. 21 and 24, the developing cartridge 208 may move relatively to the waste toner container 229 in the movable direction.

Therefore, while the developing cartridge 208 and the waste toner container 229 are attached to the drum cartridge 207, the developing cartridge 208 may move along the movable direction between the contact position and the separate position.

10. Modified Example of the Second Embodiment

Below will be described varied examples derivable from the second embodiment. In the following examples, items or structures which are identical or substantially similar to those described in the above embodiment may be denoted by the same reference signs, and description of those may be omitted.

10.1 First Modified Example

The first modified example of the second embodiment will be described with reference to FIGS. 27A-27B. In the second embodiment described above, as shown in FIGS. 17A-17B, the developing cartridge 208 includes the protrusions 37 while the waste toner container 229 includes the first supporting part 88A and the second supporting part 88B. The waste toner container 229 further includes the rollers 87.

In this respect, as shown in FIGS. 27A-27B, the developing cartridge 208 may include a first supporting part 101A and a second supporting part 101B while the waste toner container 229 may include protrusions 2102. The developing cartridge 208 may further include rollers 2103. A quantity of the rollers 2103 may be, for example, two (2).

Specifically, the waste toner container 229 may include, further to the third lateral wall 229A and the fourth lateral wall 229B, a seventh lateral wall 229C.

The seventh lateral wall 229C may be located between the third lateral wall 229A and the fourth lateral wall 229B in the axial direction.

The first part 270 may be located between the fourth lateral wall 229B and the seventh lateral wall 229C.

The waste toner container 229 may have one end portion farther from the developer roller 25 and another end portion closer to the developer roller 25, and the second part 271 may be located on the one end portion of the waste toner container 229 farther from the developer roller 25. The second part 271 may protrude outward along the axial direction from the seventh lateral wall 229C. The second part 271 may be located between the third lateral wall 229A and the seventh lateral wall 229C in the axial direction.

The seventh lateral wall 229C includes one of the protrusions 102.

The protrusion 102 is located between the main part 35 of the toner storage 228 and the second part 271 of the waste toner container 229 in the movable direction. The protrusion 102 may protrude outward in a direction to be away from the seventh lateral wall 229C along the axial direction.

The fourth lateral wall 229B may include another one of the protrusions 102, analogously to the seventh lateral wall 29C, which protrude outward along the axial direction.

Meanwhile, the developing cartridge 208 may include the first supporting part 101A and the second supporting part 101B.

The first supporting part 101A may extend, as shown in FIG. 27A, from the toner storage 228 toward the waste toner container 229. The first supporting part 101A may be arranged alongside the seventh lateral wall 229C along the axial direction. The first supporting part 101A may include a first portion 106 and a second portion 107.

The first portion 106 may extend from the main part 35 toward the waste toner container 229 along the movable direction. The first portion 106 may be located on an opposite side of the protrusion 102 to the contact part 36 with regard to the intersecting direction. In other words, the protrusion 102 may be located between the first portion 106 and the contact part 36 in the intersecting direction. The first portion 106 may include one end, which is continuous with the main part 35, and the other end, which is opposite to the one end and farther from the main part 35.

The second portion 107 may extend from the contact part 36 toward the waste toner container 229 along the intersecting direction. The second portion 107 may be located on an opposite side of the protrusion 102 to the main part 35 with regard to the movable direction. In other words, the protrusion 102 may be located between the second portion 107 and the main part 35 in the movable direction. The second part 107 may be continuous with the other end of the first portion 106.

The second supporting part 101B may extend, as shown in FIG. 27B, from the toner storage 228 toward the waste toner container 229. The second supporting part 101B may be arranged alongside the second lateral wall 228B along the axial direction. The second supporting part 101B may be in an identical form to the first supporting part 101A.

Meanwhile, the contact part 36 may include rollers 2103. A quantity of the rollers 2103 may be, for example, two (2).

The rollers 2103 may be spaced apart along the axial direction from each other. The rollers 2103 may protrude from the contact part 36 toward the first part 270. The rollers 2103 may be rotatably supported by the contact part 36. The rollers 2103 may, when the developing cartridge 208 and the waste toner container 229 are attached to the drum cartridge 207, contact the first part 270 of the waste toner container 229.

Meanwhile, the waste toner container 229 may further include a gripper 2109.

The gripper 2109 may extend in an opposite direction to the developer roller 25 across from the first agitator 268. The gripper 2109 may be gripped by the user when the user attaches the developing cartridge 208 and the waste toner container 229 to the drum cartridge 207.

Thus, according to the first modified example, analogously to the second embodiment described above, the contact part 36 in the toner storage 28 may move slidably in the movable direction with respect to the waste toner container 229 when the developing cartridge 208 and the waste toner container 229 are attached to the drum cartridge 207.

According to the first modified example, as shown in FIGS. 27A-27B, the contact part 36 in the toner storage 228 may include the rollers 2103; therefore, the developing cartridge 208 may move relatively to the waste toner container 229 smoothly.

With the modified configuration described above in the first modified example, the benefits achievable by the second embodiment described above may be analogously achieved.

10.2 Second Modified Example

According to the second embodiment described above, as shown in FIGS. 17A-17B, the developing cartridge 208 is movable relatively to the waste toner container 229, which is equipped with the rollers 87.

Meanwhile, according to the second modified example, the waste toner container 229 may include, as shown in FIG. 28A, a first protrusion 113 in place of the rollers 87.

The protrusion 113 may protrude in the contacting direction from the waste toner container 229 toward the contact part 36. The first protrusion 113 may contact the contact part 36 when the developing cartridge 208 and the waste toner container 229 are attached to the drum cartridge 207.

The contact part 36 may slide on the first protrusion 113. Thus, the contact part 36 in the toner storage 228 may slidably move with respect to the waste toner container 229 in the movable direction, analogously to the second embodiment described above.

According to the second modified example of the second embodiment, as shown in FIG. 28A, the waste toner container 229 may be equipped with the first protrusion 113; therefore, a contact area, at which the contact part 36 contacts the waste toner container 229, may be reduced.

Therefore, when the contact part 36 contacts the first protrusion 113 and slides on the first protrusion 113 to move with respect to the waste toner container 229, friction between the contact part 36 and the waste toner container 229 may be moderated.

Thus, the developing cartridge 208 may move relatively to the waste toner container 229 more smoothly.

With the modified configuration described above in the second modified example, the benefits achievable by the second embodiment described above may be analogously achieved.

10.3 Third Modified Example

While the waste toner container 229 in the second modified example may be equipped with the first protrusion 113 as shown in FIG. 28A, according to a third modified example, the contact part 36 in the toner storage 228 may be equipped with a second protrusion 115, as shown in FIG. 28B.

The second protrusion 115 may protrude from the contact part 36 toward the waste toner container 229. The second protrusion 115 may, when the developing cartridge 208 and the waste toner container 229 are attached to the drum cartridge 207, contact the waste toner container 229.

The second protrusion 115 may slide on the waste toner container 229. Thus, the contact part 36 in the toner storage 228 may slidably move with respect to the waste toner container 229 in the movable direction, analogously to the second modified example described above.

According to the third modified example of the second embodiment, as shown in FIG. 28B, the waste toner container 229 may be equipped with the second protrusion 115; therefore, a contact area, at which the contact part 36 contacts the waste toner container 229, may be reduced.

Therefore, when second protrusion 115 contacts the waste toner container 229, and the contact part 36 slides to move with respect to the waste toner container 229, friction between the contact part 36 and the waste toner container 229 may be moderated.

Thus, the developing cartridge 208 may move relatively to the waste toner container 229 more smoothly.

With the modified configuration described above in the third modified example, the benefits achievable by the second embodiment described above may be analogously achieved.

III. Third Embodiment

A third embodiment according to the present disclosure will be described below. In the following description, items or structures which are identical or substantially similar to those described in the previous embodiments may be denoted by the same reference signs, and description of those may be omitted.

1. Overall Configuration of Image Forming Apparatus 301

As shown in FIG. 29, the image forming apparatus 301 includes a main body 302, a process cartridge 303 which is attachable to and detachable from the main body 302, and a fuser 33.

1.1 Main Body 2

The main body 2 includes an opening 305 and a cover 306.

Arrangement of the opening 305, the cover 306, the process cartridge 303, and the fuser 33 in the main body 302 may be substantially analogous to the arrangement of the opening 5, the cover 6, the process cartridge 3, and the fuser 33 in the main body 2 in the first embodiment.

1.2 Process Cartridge 3

The process cartridge 303 may be attached to and detached from the main body 302 through the opening 305. The process cartridge 303 includes a drum cartridge 307 and a developing cartridge 308.

1.2.1 Drum Cartridge 307

The drum cartridge 307 includes a photosensitive drum 17, a transfer roller 18, a drum cleaner 51, a cleaner frame 50, which may be substantially analogous to those described in the first embodiment, and a waste toner conveyer tube 322.

1.2.2 Developing Cartridge 308

The developing cartridge 308 includes a developer roller 25 and a toner storage 328. The developer roller 25 may be substantially analogous to the developer roller 25 described in the first embodiment and is arranged to contact the photosensitive drum 17. The developer roller 25 may supply toner in the developing cartridge 308, in particular the toner storage 328, to the photosensitive drum 17 through the contact. The toner storage 328 may store the toner to be supplied to the photosensitive drum 17. The developing cartridge 308 is detachably attached to the drum cartridge 307, analogously to the developing cartridge 8 in the first embodiment. The developing cartridge 308 and the fuser 33 are, when the process cartridge 303 is attached to the main body 2, located on opposite sides of the photosensitive drum 17 with regard to the attachable/detachable direction of the developing cartridge 308 to and from the drum cartridge 307 through the opening 305. In other words, the photosensitive drum 17 is located between the developing cartridge 308 and the fuser 33 in the attachable/detachable direction of the developing cartridge 308.

The developing cartridge 308 includes a casing 308A and a plurality of agitators 368.

The casing 308A includes the toner storage 328 that may contain the toner to be supplied to the photosensitive drum 17. The toner storage 328 extends the movable direction of the process cartridge 303 in an opposite direction to the photosensitive drum 17 across from the developer roller 25 with regard to the movable direction of the process cartridge 303.

The agitators 368 are located inside the toner storage 328 at positions spaced apart along an extending direction of the toner storage 328 from each other. The agitators 368 may stir the toner in the toner storage 328.

1.3 Fuser 33

The fuser 33 in the image forming apparatus 301 may be substantially analogous to the fuser 33 in image forming apparatus 1 in the first embodiment.

2. Detailed Configuration of the Developing Cartridge 308

2.1 Toner Storage 328

The casing 308A of the developing cartridge 308 includes, as shown in FIGS. 30A-30B and 31, a first lateral wall 328A, a second lateral wall 328B, and a divider wall 328C.

The first lateral wall 328A and the second lateral wall 328B are spaced apart along the axial direction of the photosensitive drum 17 from each other. The first lateral wall 328A is located at one end of the toner storage 328 with regard to the axial direction, and the second lateral wall 328B is located at the other end of the toner storage 328 with regard to the axial direction. The first lateral wall 328A and the second lateral wall 328B may form an inner room inside the casing 308A.

The divider wall 328C extends in the axial direction and connects the first lateral wall 328A and the second lateral wall 328B with each other. The divider wall 328C divides the inner room into a first room 328D and a second room 329A. The first room 328D is formed in the toner storage 328. In other words, the toner storage 328 includes the first room 328D. The divider wall 328C may be formed integrally and inseparably with the first lateral wall 328A and the second lateral wall 328B. The divider wall 328C may be formed in, for example resin. The first lateral wall 328A, the second lateral wall 328B, and the divider wall 328C may be formed in injection molding in the same resin.

2.2 Developer Roller 25

The developer roller 25 is arranged to longitudinally extend in the axial direction and is partly exposed outside the developing cartridge 308. The developer roller 25 includes a shaft 25A and a roller body 25B, which may be substantially analogous to those described in the first embodiment.

The shaft 25A longitudinally extends in the axial direction and is supported on the first lateral wall 328A at one end thereof and on the second wall 328B at the other end thereof.

The roller body 25B is arranged on a circumference of the shaft 25A. The roller body 25B is located between the first lateral wall 328A and the second lateral wall 328B.

2.3 Electrode 79 and Bearing 82

The developing cartridge 308 further includes, as shown in FIGS. 30B and 31, an electrode 79 and a bearing 82.

The electrode 79 may receive electricity to be applied to the developer roller 25 from a power source of the image forming apparatus 301, which is not shown. The electrode 79 is located on an opposite side of the first lateral wall 328A to the second lateral wall 328B. In other words, the first lateral wall 328A is located between the electrode 79 and the second lateral wall 328B. The electrode 79 includes an electric terminal 80 and a bearing 81.

The electric terminal 80 is arranged on the first lateral wall 328A. The electric terminal 80 protrudes from the side of the first lateral wall 328A outward in a direction opposite from the second lateral wall 328B in the axial direction.

The bearing 81 is connected with the electric terminal 80. The bearing 81 is arranged to fit with one end of the shaft 25A with regard to the axial direction. The bearing 81 is located on an opposite side of the first lateral wall 328A to the roller body 25B with regard to the axial direction. In other words, the first lateral wall 328A is located between the bearing 81 and the roller body 25B in the axial direction.

The electric terminal 80 in the electrode 79 may be in contact with an electrode (not shown) so that electricity input to the electric terminal 80 may be applied to the developer roller 25 transmitted through the bearing 81.

The bearing 82 is arranged to fit with the other end of the shaft 25A with regard to the axial direction. The bearing 82 is located on an opposite side of the second lateral wall 328B to the roller body 25B. In other words, the second lateral wall 328B is located between the bearing 82 and the roller body 25B.

3. Detailed Configuration of the Waste Toner Container 329

The developing cartridge 308 further includes, as shown in FIGS. 30A-30B, a waste toner container 329.

The waste toner container 329 may accommodate the toner removed from the photosensitive drum 17. The waste toner container 329 is located closer than the developer roller 25 to the toner storage 328 with regard to the movable direction. The waste toner container 329 is arranged alongside the toner storage 328 along an intersecting direction, which intersects with the movable direction. Preferably, the waste toner container 329 may be located at a position lower than the toner storage 328. The waste toner container 329 includes the second room 329A.

The waste toner container 329 is located on an opposite side of the developer roller 25 to the photosensitive drum 17 with regard to the movable direction, when the developing cartridge 308 is attached to the drum cartridge 307. In other words, the developer roller 25 is located between the waste toner container 329 and the photosensitive drum 17 in the movable direction.

A capacity volume of the waste toner container 329 may be, for example, greater than or equal to 5% and smaller than or equal to 50%, or more preferably, greater than or equal to 10% and smaller than or equal to 30%, of a capacity volume of the toner storage 328. Thus, an approximate upper limit of the capacity volume of the waste toner container 329 may be determined based on the capacity volume of the toner storage 328.

The waste toner container 329 includes, as shown in FIGS. 30A-30B and 31, a main part 370, a protrusive part 371, an auger screw 372, a shutter 373, and a spring 374.

3.1 Main Part 370

The main part 370 is, as shown in FIGS. 30A and 31, located between the first lateral wall 328A and the second lateral wall 328B in the toner storage 328 in the axial direction. The main part 370 is, as shown in FIGS. 30A-30B, arranged to coincide with the toner storage 328 along the intersecting direction.

3.2 Protrusive Part 371

The waste toner container 329 may have one end portion farther from the developer roller 25 and another end portion closer to the developer roller 25, and the protrusive part 371 may be located on the one end portion of the waste toner container 329 farther from the developer roller 25. The protrusive part 371 may protrude outward along the axial direction from the first lateral wall 229A, as shown in FIGS. 30B and 31. In other words, the first lateral wall 328A is located between the protrusive part 371 and the main part 70 in the axial direction. The protrusive part 371 protrudes in the axial direction outward farther than the bearing 81. The protrusive part 371 communicates with the main part 370. The protrusive part 371 includes a first surface 371A on one end thereof and a second surface 371B on the other end thereof with regard to the movable direction. The first surface 371A is located closer than the second surface 371B to the developer roller 25. The protrusive part 371 includes a cylindrical inlet 376.

The cylindrical inlet 376 is formed to recede from the first surface 371A toward the second surface 371B along the movable direction. The cylindrical inlet 376 has a cylindrical form. The cylindrical inlet 376 has one end and the other end with regard to the movable direction. The one end of the cylindrical inlet 376 is open, and the other end of the cylindrical inlet 376 is closed. The cylindrical inlet 376 includes an inlet port 377.

The inlet port 377 is an opening, through which the toner may enter the waste toner container 329. The inlet port 377 is, as shown in FIG. 30B, formed on a circumference of the cylindrical inlet 376 on an opposite side of the shutter 273 to the toner storage 328 with regard to the intersecting direction. In other words, the shutter 273 is located between the inlet port 377 and the toner storage 328 in the intersecting direction. The inlet port 377 is formed through a circumferential surface of the cylindrical inlet 376 to make a passage. Preferably, the inlet port 377 may be formed at a bottom of the cylindrical inlet 376. The inlet port 377 is formed to extend in the attachable/detachable direction of the developing cartridge 308 to and from the drum cartridge 307.

3.3 Auger Screw 372

The auger screw 372 is, as shown in FIGS. 30A-30B, located inside the main part 370 and the protrusive part 371. The auger screw 372 extends longitudinally in the axial direction. One end of the auger screw 372 with regard to the axial direction is supported rotatably by the main part 270, and the other end of the auger screw 372 with regard to the axial direction is supported rotatably by the protrusive part 371. The other end of the auger screw 372 is located to coincide with the inlet port 377 along the intersecting direction. The auger screw 372 may convey the toner entering the protrusive part 371 through the inlet port 377 toward the main part 370.

3.4 Shutter 373 and Spring 374

The shutter 373 is, as shown in FIG. 30B, located inside the cylindrical inlet 376. The shutter 373 is movable along the movable direction between a closure position (see FIG. 30B), in which the inlet port 377 is covered, and an open position (see FIG. 35), in which the inlet port 377 is uncovered.

The spring 374 is located between the shutter 373 and an inner surface on the other end of the cylindrical inlet 376. The spring 374 urges the shutter 373 to place the shutter 373 at the closure position at an ordinary state.

4. Detailed Configuration of the Drum Cartridge 307

4.1 Third Lateral Wall 341, Fourth Lateral Wall 342, and Connecting Wall 343

The drum cartridge 307 includes, as shown in FIGS. 32 and 33, a third lateral wall 341, a fourth lateral wall 342, and a connecting wall 343.

4.1.1 Third Lateral Wall 341 and Fourth Lateral Wall 342

The third lateral wall 341 and the fourth lateral wall 342 are spaced apart along the axial direction of the photosensitive drum 17 from each other. The third lateral wall 341 and the fourth lateral wall 342 each extends in the movable direction and spreads in a shape of a plate. The third lateral wall 341 supports one end of the photosensitive drum 17 with regard to the axial direction, and the fourth lateral wall 342 supports the other end of the photosensitive drum 17 with regard to the axial direction.

The third lateral wall 341 and the fourth lateral wall 342 include a first developer guide 45 (see FIGS. 35 and 36) and a second developer guide 46 (see FIGS. 33 and 36), respectively, which are substantially analogous to the first developer guide 45 and the second developer guide 46 described above in the first embodiment.

The first developer guide 45 and the second developer guide 46 may accept the bearing 81 of the electrode 79 and the bearing 82, respectively, when the developing cartridge 308 is attached to the drum cartridge 307, to guide the developer roller 25.

4.1.2 Connecting Wall 343

The connecting wall 343 is, as shown in FIGS. 32 and 33, between the third lateral wall 341 and the fourth lateral wall 342. The connecting wall 343 extends in the movable direction and includes a plurality of rollers 56.

The rollers 56 are spaced apart from one another. The rollers 56 are arranged to protrude from a surface of the connecting wall 343. The rollers 56 are rotatably supported by the connecting wall 343. The rollers 56 may, as shown in FIG. 34, when the developing cartridge 308 is attached to the drum cartridge 307, support the waste toner container 329. The rollers 56 are slidable with respect to the waste toner container 329; therefore, the developing cartridge 308 with the waste toner container 329 may move on the rollers 56 with respect to the drum cartridge 307 smoothly.

4.2 Photosensitive Drum 17

The photosensitive drum 17 may be, as shown in FIGS. 32 and 33, in an analogous configuration to the photosensitive drum 17 described in the first embodiment above. The photosensitive drum 17 includes the cylindrical part 17A and the drum shaft 17B.

The cylindrical part 17A is located between the third lateral wall 341 and the fourth lateral wall 342 in the axial direction.

The drum shaft 17B includes one end and the other end with regard to the axial direction: the one end of the drum shaft 17B is rotatably supported by the third lateral wall 341, and the one end of the drum shaft 17B protrudes outward from the third lateral wall 341. The other end of the drum shaft 17B with regard to the axial direction is rotatably supported by the fourth lateral wall 342. The other end of the drum shaft 17B with regard to the axial direction protrudes outward from the fourth lateral wall 342.

4.3 Conveyer Roller 57 and Handle 58

The drum cartridge 307 further includes a conveyer roller 57 and a handle 58, which may be in analogous forms to the conveyer roller 57 and the handle 58 described in the first embodiment.

4.3.1 Conveyer Roller 57

The conveyer roller 57 is located on an opposite side of the photosensitive drum 17 to the fuser 33 with regard to the movable direction. The conveyer roller 57 is, as shown in FIGS. 32 and 33, arranged to longitudinally extend in the axial direction. One end of the conveyer roller 57 with regard to the axial direction is supported by the connecting wall 343 through a supporting member 57A. The one end of the conveyer roller 57 with regard to the axial direction protrudes outward from the third lateral wall 341. The other end of the conveyer roller 57 with regard to the axial direction is supported by the connecting wall 343 through a supporting member 57B. The other end of the conveyer roller 57 protrudes outward from the fourth lateral wall 342.

4.3.2 Handle 58

The handle 58 may be substantially analogous to the handle 58 described in the first embodiment but is supported by the connecting wall 343 rotatably to rotate with respect to the connecting wall 343.

5. Configuration to Convey Toner in the Drum Cartridge 307

5.1 Cleaner Frame 50 and Drum Cleaner 51

The drum cartridge 307 includes the cleaner frame 50 and the drum cleaner 51, which may be substantially analogous to those described in the first embodiment above.

The drum cleaner 51 is, when the developing cartridge 308 is attached to the drum cartridge 307, as shown in FIG. 34, located on an opposite side of the photosensitive drum 17 to the developing cartridge 308 with regard to the movable direction. In other words, the photosensitive drum 17 is located between the drum cleaner 51 and the developing cartridge 308 in the movable direction.

One end of the cleaner frame 50 with regard to the axial direction is coupled to the third lateral wall 341, and the other end of the cleaner frame 50 with regard to the axial direction is coupled to the fourth lateral wall 342.

The drum cleaner 51 may scrape the circumferential surface of the photosensitive drum 17 to remove the toner, which remains thereon without being transferred to the sheet P, from the photosensitive drum 17. The toner scraped off from the photosensitive drum 17 may fall through the opening 50A to be caught in the cleaner frame 50. The toner caught in the cleaner frame 50 may be conveyed through the waste toner conveyer tube 322 toward the waste toner container 329 by rotation of a conveyer 53, which will be described below.

5.2 Indentation 47

As shown in FIG. 32, the third lateral wall 341 includes an indentation 47.

The indentation 47 is located on an opposite side of the first developer guide 45 to the photosensitive drum 17 with regard to the movable direction. In other words, the first developer guide 45 is located between the indentation 47 and the photosensitive drum 17 in the movable direction. The third lateral wall 341 may be partly cut off at an edge on an opposite side of the conveyer roller 57 to the photosensitive drum 17 toward the photosensitive drum 17 to form the indentation 47. The indentation 47 is formed through the third lateral wall 341 in the axial direction and extends in the movable direction. The indentation 47 is formed at a position, as shown in FIG. 35, in which the indentation 47 may accept the protrusive part 371 of the waste toner container 329 when the developing cartridge 308 is attached to the drum cartridge 307. In other words, the indentation 47 is formed at a position coincident with the protrusive part 371 of the waste toner container 329 along the axial direction. An edge of the indentation 47 forms a protrusion guide 48, which may guide the protrusive part 371 of the waste toner container 29 in the developing cartridge 308. In other words, the protrusion guide 48 may adjoin the protrusive part 371 of the waste toner container 29 when the developing cartridge 308 is attached to the drum cartridge 307.

The protrusion guide 48 extends along the movable direction for the developing cartridge 308 to move with respect to the drum cartridge 308, analogously to the first developer guide 45 and the second developer guide 46.

5.3 Waste Toner Conveyer Tube 322, Conveyer 53, Shutter 65, and Spring 66

The drum cartridge 307 further includes, as shown in FIGS. 32 and 33, the waste toner conveyer tube 322, the conveyer 53, the shutter 65, and the spring 66.

5.3.1 Waste Toner Conveyer Tube 322

The toner removed from the circumferential surface of the photosensitive drum 17 may be conveyed inside the waste toner conveyer tube 322. In other words, the waste toner conveyer tube 322 may convey the toner removed by the drum cleaner 51 from the photosensitive drum 17. The waste toner conveyer tube 322 may connect, as shown in FIGS. 35 and 36, when the developing cartridge 308 is attached to the drum cartridge 307, the cleaner frame 50 with the waste toner container 329. The waste toner conveyer tube 322 is, as shown in FIGS. 32 and 33, located on an opposite side of the third lateral wall 341 to the fourth lateral wall 342 with regard to the axial direction. In other words, the third lateral wall 341 is located between the waste toner conveyer tube 322 and the fourth lateral wall 342 in the axial direction. The waste toner conveyer tube 322 longitudinally extends in the movable direction. The waste toner conveyer tube 322 is arranged alongside the transfer roller 18 along the axial direction. The waste toner conveyer tube 322 includes a first conveyer tube 61 and a second conveyer tube 62.

The first conveyer tube 61 has a cylindrical shape and extends longitudinally along the movable direction from the cleaner frame 50 to the indentation 47. Specifically, the first conveyer tube 61 includes a first end portion 61A and a second end portion 61B.

The first end portion 61A is on one end of the first conveyer tube 61 closer to the photosensitive drum 17 with regard to the movable direction. The first end portion 61A is connected to the third lateral wall 341 to make a passage to the cleaner frame 50.

The second end portion 61B is on the other end of the first conveyer tube 61 opposite to the first end portion 61A with regard to the movable direction. The second end portion 61B is located closer than the indentation 47 in the third lateral wall 341 to the photosensitive drum 17.

The first conveyer tube 61 further includes a first section 61C, a second section 61D, and a third section 61E at positions between the first end portion 61A and the second end portion 61B.

The first section 61C is located closer than the conveyer roller 57 to the photosensitive drum 17 with regard to the movable direction. The first section 61C is continuous with the first end portion 61A. The first section 61C is located closer than the photosensitive drum 17 to the developer roller 18. The first section 61A coincides with the transfer roller 18 along the axial direction at least partly.

The second section 61D is located on an opposite side of the conveyer roller 57 to the photosensitive drum 17 with regard to the movable direction. In other words, the conveyer roller 57 is located between the second section 61D and the photosensitive drum 17 in the movable direction. The second section 61D is continuous with the second end portion 61B. The second section 61D is located closer than the first section 61C to the third lateral wall 61C with regard to the axial direction.

The third section 61E is located between the first section 61C and the second section 16D in the movable direction. The third section 61E is continuous with the first section 61C and with the second section 61D. The third section 61E is located at an upper position with respect to the conveyer roller 57. The third section 61E is located closer than the one end of the conveyer roller 57 to the third lateral wall 41. In other words, the one end of the conveyer roller 57 protrudes outward farther than the waste toner conveyer tube 322 with regard to the axial direction. Specifically, a length between the third lateral wall 341 and the one end of the conveyer roller 57 is larger than a length between the third lateral wall 341 and the waste toner conveyer tube 322.

The second conveyer tube 62 extends from an end portion of the indentation 47 closer to the photosensitive drum 17 with regard to the movable direction in a direction to be away from the photosensitive drum 17. The second conveyer tube 62 includes a first end portion 62A and a second end portion 62B. The second conveyer tube 62 further includes a ring portion 364 and an outlet port 363.

The first end portion 62A is on one end of the second conveyer tube 62 closer to the photosensitive drum 17 with regard to the movable direction. The first end portion 62A coincides with the end portion of the indentation 47 closer to the photosensitive drum 17 along the axial direction. The first end portion 62A is connected with the second end portion 61B of the first conveyer tube 61. Thereby, the second conveyer tube 62 communicates with the first conveyer tube 61.

The second end portion 62B is on the other end of the second conveyer tube 62 opposite to the first end portion 62A with regard to the movable direction.

The ring portion 364 expands in a radial direction of the waste toner conveyer tube 322 to form a ring shape and protrude outward from a circumferential surface of the waste toner conveyer tube 322. The second conveyer tube 62 may be supported by the third lateral wall 341 at the ring portion 364 being fixed to the third lateral wall 341.

The outlet port 363 is formed through the circumferential surface of the waste toner conveyer tube 322. Preferably, the outlet port 363 may be formed at a bottom of the waste toner conveyer tube 322 to make a passage at the bottom. The toner may be discharged out of the waste toner conveyer tube 322 through the outlet port 363. The outlet port 363 is formed extend longitudinally in the attachable/detachable direction for the developing cartridge 308 to and from the drum cartridge 307. A length of the outlet port 363 in the waste toner conveyer tube 322 in the movable direction is smaller than a length of the inlet port 377 in the waste toner container 329 in the movable direction. In other words, the length of the inlet port 377 in the waste toner container 329 with regard to the movable direction is larger than the length of the outlet port 363 in the waste toner conveyer tube 322 with regard to the movable direction.

The second conveyer tube 62 in the waste toner conveyer tube 322 is arranged to fit in the cylindrical inlet 376 in the protrusive part 371 along the movable direction when the developing cartridge 308 is attached to the drum cartridge 307. Thus, the waste toner conveyer tube 322 is connected with the protrusive part 371 of the waste toner container 329. Meanwhile, when the developing cartridge 308 is attached to the drum cartridge 307, the outlet port 363 in the second conveyer tube 62 and the inlet port 377 in the cylindrical inlet 376 face each other. Thus, the outlet port 363 of the second conveyer tube 62 is connected with the inlet port 377 of the cylindrical inlet 376 to make a passage.

Meanwhile, when the developing cartridge 308 is attached to the drum cartridge 307, as shown in FIG. 36, the waste toner conveyer tube 322 is located on an opposite side of the first lateral wall 328A to the roller body 25B of the developer roller 25 with regard to the axial direction. In other words, the first lateral wall 328A is located between the waste toner conveyer tube 322 and the roller body 25B of the developer roller 25.

Meanwhile, when the developing cartridge 308 is attached to the drum cartridge 307, the waste toner conveyer tube 322 is located closer to the third lateral wall 341 with regard to the axial direction than one end of the electric terminal 80 of the electrode 79 farther from the third lateral wall 341. In other words, the one end of the electric terminal 80 of the electrode 79 is farther from the third lateral wall 341 than the waste toner conveyer tube 322 with regard to the axial direction, or, the electric terminal 80 protrudes farther outward than the waste toner conveyer tube 322 with regard to the axial direction. Thus, the electric terminal 80 is located on an opposite side of the waste toner conveyer tube 322 to the first lateral wall 328A with regard to the axial direction, when the developing cartridge 308 is attached to the drum cartridge 307. In other words, the waste toner conveyer tube 311 is located between the electric terminal 80 and the first lateral wall 328A in the axial direction.

Further, when the developing cartridge 308 is attached to the drum cartridge 307, the waste toner conveyer tube 322 is located closer to the third lateral wall 341 with regard to the axial direction than one end of the drum shaft 17B that is farther from the third lateral wall 341. In other words, the drum shaft 17B protrudes farther outward than the waste toner conveyer tube 322 with regard to the axial direction.

5.3.2 Conveyer

The conveyer 53 in the drum cartridge 307 may be in an analogous form to the conveyer 53 in the drum cartridge 7 illustrated in the first embodiment. One end of the conveyer 53 is rotatably supported by the fourth lateral wall 342 of the cleaner frame 50 through the conveyer gear 53A. The other end of the conveyer 53 opposite to the one end is rotatably supported by the second end portion 62B of the second conveyer tube 62 in the waste toner conveyer tube 322. The other end of the conveyer 53 is arranged to adjoin and face the outlet port 363 of the second conveyer tube 62.

5.3.3 Shutter 65 and Spring 66

The shutter 65 and the spring 66 may be in analogous forms to the shutter 65 and the spring 66 respectively in the drum cartridge 7 described in the first embodiment.

The shutter 65 is arranged to cover a circumference of the second conveyer tube 62. The shutter 65 is movable on the second conveyer tube 62 between a closure position (see FIG. 32), in which the outlet port 363 is closed, and an open position (see FIG. 35), which is closer than the closure position to the ring portion 364 and in which the outlet port 363 is uncovered.

The spring 66 is located between the shutter 65 and the ring portion 364. The spring 66 is arranged to contact the shutter 65 at one end and the ring portion 364 at the other end. The spring 66 tends to urge the shutter 65 toward the closure position at an ordinary state.

5.4 Supporting Part 384 and Spring 385

The cover 306 includes, as shown in FIG. 29, a supporting part 384 and a spring 385.

The supporting part 384 extends in the movable direction toward the process cartridge 303 attached to the main body 302. The supporting part 384 includes one end and the other end with regard to the movable direction: the one end is continuous with the cover 306, and the other end is closer than the one end to the process cartridge 303.

The spring 385 is supported on the other end of the supporting part 384. The spring 385 may, when the process cartridge 303 is attached to the main body 302, contact the developing cartridge 308 to urge the developing cartridge 308 toward the photosensitive drum 17.

Thus, the spring 385 may restrain the developing cartridge 308 from moving with respect to the drum cartridge 307 in the movable direction to be separated from the drum cartridge 307 when the process cartridge 303 is attached to the main body 302.

6. Attaching and Detaching Actions of the Developing Cartridge 308 to and from the Drum Cartridge 307

Next, with reference to FIGS. 35 and 36, actions to attach and detach the developing cartridge 308 to and from the drum cartridge 307 will be described.

In order to attach the developing cartridge 308 to the drum cartridge 307, the user may push the developing cartridge 308 against the drum cartridge 307.

As the developing cartridge 308 is pushed, the bearing 81 of the electrode 79 in the developing cartridge 308 may be guided in the first developer guide 45 in the drum cartridge 307, and the bearing 82 in the developing cartridge 308 may be guided in the second developer guide 46 in the drum cartridge 307. Meanwhile, the protrusive part 371 of the waste toner container 329 in the developing cartridge 308 may be guided in the protrusion guide 48 in the drum cartridge 307.

Thus, the developing cartridge 308 may approach the photosensitive drum 17.

In this regard, the second conveyer tube 62 in the waste toner conveyer tube 322 may be, as shown in FIG. 35, allowed to enter the cylindrical inlet 376 in the protrusive part 371.

Meanwhile the shutter 373 in the developing cartridge 308 may contact the second conveyer tube 62, and the shutter 65 in the drum cartridge 307 may contact the protrusive part 371. When the developing cartridge 308 is pushed further, the shutter 373 may be placed to the open position against the urging force of the spring 374, and the shutter 65 may be placed in the open position against the urging force of the spring 66.

Thereby, the outlet port 363 in the second conveyer tube 61 and the inlet port 377 in the cylindrical inlet 376 may face each other, and the outlet port 363 in the waste toner conveyer tube 322 and the inlet port 377 in the cylindrical inlet 376 are connected to make a passage.

Thus, attachment of the developing cartridge 308 to the drum cartridge 307 may be completed.

In order to detach the developing cartridge 308 from the drum cartridge 307, the user may move the developing cartridge 308 in a reversed sequence from the sequence of the attaching action described above.

Next, the drum cartridge 307 with the developing cartridge 308 attached thereto, i.e., the process cartridge 303, may be attached to the main body 302, as shown in FIG. 38.

In order to attach the process cartridge 303 to the main body 302, the user may place the cover 306 in the open position to expose the opening 305.

Thereafter, the user may attach the process cartridge 303 through the opening 305 to the main body 302.

Further, the user may place the cover 306 in the closure position, as shown in FIG. 29.

Thus, the image forming apparatus 301 may be placed in an operable condition.

In order to detach the process cartridge 303 from the main body 302, the user may grip the handle 58 and manipulate the process cartridge 303 in a sequence reversed from the attaching sequence described above (see FIG. 38).

When the process cartridge 303 is attached to the main body 302, the waste toner conveyer tube 322 is placed at a position closer than the conveyer roller 57 to the opening 305 with regard to the movable direction.

Meanwhile, the developing cartridge 308 is, as shown in FIG. 39, attachable to and detachable from the drum cartridge 307 both when the process cartridge 303 is attached to the main body 302 and when the process cartridge 303 is detached from the main body 302.

7. Removal of Toner from the Photosensitive Drum 17

The toner remaining on the circumferential surface of the photosensitive drum 17 may be scraped off by the drum cleaner 51 and removed from the circumferential surface as the photosensitive drum 17 rotates, analogously to the first embodiment. The removed toner may be stored inside the cleaner frame 50.

The toner may be conveyed from the cleaner frame 50 by rotation of the conveyer 53 and in the waste toner conveyer tube 322, through the first conveyer tube 61 and the second conveyer tube 62, toward the waste toner container 329.

The toner conveyed to the second conveyer tube 62 may flow into the protrusive part 371 through the outlet port 363 in the second conveyer tube 62 and the inlet port 377 in the cylindrical inlet 376.

The toner in the protrusive part 371 may be conveyed toward the main part 370 by the auger screw 372 and stored in the main part 370, and conveyance of the toner may be accomplished.

8. Benefits (1) According to the process cartridge 303 described above, as shown in FIGS. 29 and 34, the divider wall 328C divides the inner room in the developing cartridge 308 into the first room 328D and the second room 329A.

Therefore, when a user attempts to replace the developing cartridge 308, in which the toner storage 328 no longer contains the toner, with a new developing cartridge 308, in which the toner storage 328 is filled with the toner, the user may simultaneously replace the used waste toner container 329, which is filled with the waste toner, with a new waste toner container 329, which may be unused and empty. In other words, it may not be necessary that the user replace the exhausted toner storage 328 and the toner-filled waste toner container 329 separately. Therefore, the user may be released from the burden to replace the toner storage 328 and the waste toner container 329 separately.

(2) According to the process cartridge 303 described above, as show in FIGS. 30B and 31, the waste toner container 329 may include, additionally to the main part 370, the protrusive part 371, which is located on the opposite side of the first lateral wall 328A of the toner storage 328 to the main part 370 with regard to the axial direction.

Therefore, the waste toner container 329 may store a substantial amount of the waste toner.

(3) According to the process cartridge 303 described above, as shown in FIGS. 33, 35, 37, and 38, the waste toner conveyer tube 322 may be arranged on the opposite side of the first lateral wall 328A to the second lateral wall 328B so that the waste toner conveyer tube 322 may be connected with the protrusive part 371 when the waste toner container 329 is attached to the drum cartridge 307.

Therefore, a size of the toner storage 328 may not necessarily be limited by the waste toner conveyer tube 322.

(4) According to the process cartridge 303 described above, as shown in FIGS. 35 and 36, the third lateral wall 341 includes the indentation 47; therefore, when the developing cartridge 308 is attached to the drum cartridge 307, the protrusive part 371 of the waste toner container 329 may be fitted in the indentation 47 without colliding with the drum cartridge 307.

(5) According to the process cartridge 303 described above, as shown in FIG. 35, the protrusion guide 48 to guide the protrusive part 371 of the waste toner container 329 is formed in the indentation 47 in the third lateral wall 341.

Therefore, the indentation 47 may assuredly guide the protrusive part 371 when the developing cartridge 308 is attached to the drum cartridge 307.

(6) According to the process cartridge 303 described above, as shown in FIGS. 34 and 35, the protrusion guide 48, the first developer guide 45, and the second developer guide 46 extend in the movable direction; therefore, the developing cartridge 308 may be assuredly guided to be attached to or detached from the drum cartridge 307 by the protrusion guide 48, the first developer guide 45, and the second developer guide 46.

(7) According to the process cartridge 303 described above, as shown in FIG. 35, the waste toner conveyer tube 322 may be connected with the protrusive part 371 when the developing cartridge 308 is attached to the drum cartridge 307.

Therefore, the waste toner conveyer tube 322 may be assuredly connected with the waste toner container 329.

Meanwhile, the protrusive part 371 may be guided by the protrusion guide 48 so that the cylindrical inlet 376 may be drawn to the waste toner conveyer tube 322 smoothly.

(8) According to the process cartridge 303 described above, as shown in FIG. 36, the electric terminal 80 may be located on the opposite side of the waste toner conveyer tube 322 to the first wall 28A with regard to the axial direction when the developing cartridge 308 is attached to the drum cartridge 307.

Therefore, the electric terminal 80 may assuredly receive the power supply from the external power source.

Meanwhile, when the process cartridge 303 is being attached to or detached from the drum cartridge 307, the electric terminal (not shown) in the main body 302 may be prevented from colliding with the waste toner conveyer 322 in the process cartridge 303.

(9) According to the process cartridge 303 described above, as shown in FIG. 36, the drum shaft 17B protrudes farther outward than the waste toner conveyer tube 322 with regard to the axial direction; therefore, the process cartridge 303 may be guided on the drum shaft 17B to be assuredly attached to the main body 302.

(10) According to the process cartridge 303 described above, as shown in FIG. 37, the waste toner conveyer tube 322 may at least partly coincide with the transfer roller 18, of which dimension is smaller than the diameter of the photosensitive drum 17, in the view along the axial direction, so that the process cartridge 303 may be downsized compared to a process cartridge, in which a waste toner conveyer tube does not coincide with a transfer roller.

(11) According to the process cartridge 303 described above, as shown in FIG. 34, with the rollers 56 in the drum cartridge 7, which may contact the waste toner container 329, the developing cartridge 308 may be moved smoothly to be attached to or detached from the drum cartridge 307.

Meanwhile, the developing cartridge 308 may need to be movable in a direction, along which the developer roller 25 and the photosensitive drum 17 contact each other, so that the positional relation between the developer roller 25 and the photosensitive drum 17 may be maintained. In this regard, with the rollers 56, the developing cartridge 308 may be movable with respect to the drum cartridge 17 preferably, and the positional relation between the developing roller 25 and the photosensitive drum 17 may be maintained correctly.

(12) According to the process cartridge 303 described above, as shown in FIGS. 35 and 37, the length of the inlet port 377 in the waste toner container 329 with regard to the movable direction may be larger than the length of the outlet port 363 in the waste toner conveyer tube 322 with regard to the movable direction.

Therefore, while the developing cartridge 308 may move relatively to the drum cartridge 307 in the movable direction, the inlet port 377 may catch the toner discharged through the outlet port 363 assuredly.

(13) According to the process cartridge 303 described above, as shown in FIGS. 38 and 39, the movable direction, along which the process cartridge 303 may move to be attached to or detached from the main body 302, and the attachable/detachable direction of the developing cartridge 308 to and from the drum cartridge 307 may be coincident.

Therefore, the user may either attach/detach the developing cartridge 308 alone to/from the main body 2; or may attach/detach the process cartridge 303, in which the developing cartridge 308 is attached to the drum cartridge 307, to/from the main body 302.

(14) According to the image forming apparatus 301 described above, as shown in FIG. 29, the conveyer roller 57 may be placed in the efficient position in the process cartridge 303 to convey the sheet P.

The conveyer roller 57 may, as shown in FIG. 36, protrude farther outward than the waste toner conveyer tube 322; therefore, the process cartridge 303 may be guided in the main body 2 stably.

(15) According to the image forming apparatus 301 described above, as shown in FIGS. 35 and 36, the waste toner conveyer tube 322 may be placed in the efficient position in the process cartridge 303.

(16) According to the image forming apparatus 301 described above, as shown in FIG. 38, the waste toner conveyer tube 322 may convey the toner to the waste toner container 329 securely.

According to the image forming apparatus 301 described above, as shown in FIG. 29, the waste toner container 329 may be located on the opposite side of the photosensitive drum 17 to the fuser 33 with regard to the movable direction. Therefore, while the fuser 33 may be located in the vicinity of the photosensitive drum 17, a substantial capacity volume of the waste toner container 329 may be reserved.

Thus, the waste toner container 329 may store the large volume of the waste toner.

9. Modified Example of the Third Embodiment

Below will be described a varied example derivable from the third embodiment. In the following example, items or structures which are substantially the same as or similar to those described in the above embodiment may be denoted by the same reference signs, and description of those may be omitted.

In the third embodiment of the present disclosure described above, as shown in FIGS. 34 and 35, the toner removed from the circumferential surface of the photosensitive drum 17 may be conveyed to the waste toner container 329 by the conveyer 53, which is in the spiral form.

However, configuration to convey the toner removed from the circumferential surface of the photosensitive drum 17 to the waste toner container 329 may not necessarily be limited to the conveyer 53 in the spiral form.

For example, as shown in FIG. 40, the drum cartridge 307 may be equipped with a first auger screw 391 and a second auger screw 392 in place of the conveyer 53. Further, the waste toner conveyer tube 322 may include a first tube 394 and a second tube 395.

The first tube 394 may longitudinally extend along an aligning direction for the photosensitive drum 17 and the transfer roller 18. One end of the first tube 394 may be connected with the third lateral wall 341 to make a passage to the cleaner frame 50. On the other hand, the other end of the first tube 394 opposite to the one end may be located closer than the one end to the transfer roller 18. Preferably, the other end of the first tube 394 may be located at a position lower than the one end.

The second tube 395 may be connected with the other end of the first tube 394. The second tube 395 may longitudinally extend from the other end of the first tube 394 in the movable direction to the cylindrical inlet 376 in the protrusive part 371. The second tube 395 may be a linear tube and has an outlet port 363, which is analogous to the outlet port 363 in the waste toner conveyer tube 322 described in the above embodiment.

The first auger screw 391 may be located inside the cleaner frame 50. The first auger screw 391 may longitudinally extend in the axial direction.

The second auger screw 392 may be located inside the second tube 395. One end of the second auger screw 395 with regard to the movable direction may face the other end of the first tube 394. The other end of the second auger screw 392 may face the outlet port 363.

The toner scraped off form the circumferential surface of the photosensitive drum 17 and stored inside the cleaner frame 50 may be conveyed by the first auger screw 391 toward the first tube 394.

The toner conveyed to the first tube 394 may then fall through the first tube 394 to flow in the second tube 395.

The toner entering the second tube 395 may be conveyed by the second auger screw 392 toward the protrusive part 371 in the waste toner container 329.

Thus, the toner conveyed to the protrusive part 371 may be stored in the waste toner container 329.

Although examples to carry out the invention have been described, those skilled in the art will appreciate that there are numerous variations and permutations of the process cartridge and the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

What is claimed is:

1. A process cartridge detachably attachable to an image forming apparatus, comprising a drum cartridge and a developing cartridge, the drum cartridge comprising:

a photosensitive drum;

a cleaner configured to remove toner from the photosensitive drum; and a waste toner conveyer tube for conveying waste toner removed by the cleaner, and the developing cartridge comprising:

a developing roller rotatable about a shaft;

a waste toner container configured to accommodate the waste toner removed by the cleaner;

a first lateral wall supporting the shaft; and a second lateral wall supporting the shaft, the second lateral wall being spaced apart from the first lateral wall along a first direction, wherein the first lateral wall is disposed between the waste toner conveyer tube and the second lateral wall in the first direction.

2. The process cartridge according to claim 1, wherein the drum cartridge comprises:

a first wall comprising a cartridge guide; and a second wall spaced apart from the first wall along the first direction; and wherein, when the developing cartridge is attached to the drum cartridge, the developing cartridge is guided by the cartridge guide on the first wall of the drum cartridge.

3. The process cartridge according to claim 1, wherein the drum cartridge comprises:

a first wall comprising a cartridge guide; and a second wall spaced apart from the first wall along the first direction;

wherein the developing cartridge comprises a boss extending along a second direction;

wherein the developing roller develops an image on the photosensitive drum by toner, the developing roller extending in the second direction; and wherein, when the developing cartridge is attached to the drum cartridge, the boss on the developing cartridge is guided by the cartridge guide on the first wall of the drum cartridge.

4. The process cartridge according to claim 3, wherein, when the developing cartridge is attached to the drum cartridge, the developing roller of the developing cartridge is movable with respect to the photosensitive drum of the drum cartridge.

5. The process cartridge according to claim 1, wherein, when the developing cartridge is attached to the drum cartridge, the waste toner conveyer tube of the drum cartridge is inserted in the waste toner container of the developing cartridge in an extending direction in which the waste toner conveyer tube extends.

6. The process cartridge according to claim 1, wherein the drum cartridge comprises:

a first wall comprising a cartridge guide; and a second wall spaced apart from the first wall along the first direction;

wherein the developing roller develops an image on the photosensitive drum by toner; and wherein, when the developing cartridge is attached to the drum cartridge, the shaft of the developing roller is guided by the cartridge guide on the first wall of the drum cartridge.

* * * * *